US006303556B1

(12) United States Patent
Kott et al.

(10) Patent No.: US 6,303,556 B1
(45) Date of Patent: Oct. 16, 2001

(54) HARD SURFACE CLEANING COMPOSITIONS COMPRISING MODIFIED ALKYBENZENE SULFONATES

(75) Inventors: Kevin Lee Kott, Cincinnati; Jeffrey John Scheibel, Loveland; Roland George Severson, Cincinnati; Thomas Anthony Cripe, Loveland; James Charles Theophile Roger Burckett-St. Laurent; Joseph Paul Morelli, both of Cincinnati, all of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/464,314

(22) Filed: Dec. 15, 1999

Related U.S. Application Data

(60) Provisional application No. 60/116,508, filed on Jan. 20, 1999.

(51) Int. Cl.[7] ..... C11D 17/00

(52) U.S. Cl. ..... 510/357; 510/424; 510/426; 510/428

(58) Field of Search ..... 510/357, 424, 510/426, 428

(56) References Cited

U.S. PATENT DOCUMENTS

| | | | |
|---|---|---|---|
| 2,477,382 | 7/1949 | Lewis | 260/671 |
| 2,564,072 | 8/1951 | Lien et al. | 260/671 |
| 3,196,174 | 7/1965 | Cohen | 260/505 |
| 3,238,249 | 3/1966 | Mirviss et al. | 260/505 |
| 3,312,745 | 4/1967 | Habeshaw et al. | 260/638 |
| 3,341,614 | 9/1967 | Wirth et al. | 260/671 |
| 3,351,654 | 11/1967 | Gudelis | 260/505 |
| 3,355,484 | 11/1967 | Bloch | 260/505 |
| 3,427,342 | 2/1969 | Brooks et al. | 260/458 |
| 3,442,964 | 5/1969 | Oldham | 260/671 |
| 3,442,965 | 5/1969 | Oldham | 260/671 |
| 3,491,030 | 1/1970 | Fields | 252/161 |
| 3,492,364 | 1/1970 | Jones et al. | 260/671 |
| 3,562,797 | 2/1971 | Hu | 260/683.3 |
| 3,674,885 | 7/1972 | Griesinger et al. | 260/671 |
| 4,235,810 | 11/1980 | Osselet et al. | 260/505 |
| 4,259,193 | 3/1981 | Tirtiaux et al. | 252/33 |
| 4,301,316 | 11/1981 | Young | 585/455 |
| 4,301,317 | 11/1981 | Young | 585/455 |
| 4,447,664 | 5/1984 | Murchison et al. | 585/323 |
| 4,533,651 | 8/1985 | Masters et al. | 502/117 |
| 4,587,374 | 5/1986 | Peters | 585/670 |
| 4,645,623 | 2/1987 | Dolan et al. | 252/558 |
| 4,731,497 | 3/1988 | Grey | 585/455 |
| 4,855,527 | 8/1989 | Page et al. | 585/527 |
| 4,870,038 | 9/1989 | Page et al. | 502/62 |
| 4,959,491 | 9/1990 | Threlkel | 562/94 |
| 4,962,256 | 10/1990 | Le et al. | 585/467 |

(List continued on next page.)

FOREIGN PATENT DOCUMENTS

| | | | |
|---|---|---|---|
| 39394/89 | 2/1990 | (AU) | C07C/2/02 |
| 2201953 | 10/1997 | (CA) | C07C/5/27 |
| 42 24 947 | 2/1994 | (DE) | C11D/3/386 |
| 42 36 698 | 2/1994 | (DE) | C11D/3/386 |
| 0 321 177 | 6/1989 | (EP) | C01B/33/34 |
| 0 364 012 | 4/1990 | (EP) | C07C/303/24 |
| 0 466 558 | 1/1992 | (EP) | C07C/15/107 |
| 0 469 940 | 2/1992 | (EP) | C07C/15/107 |
| 0 807 616 | 11/1997 | (EP) | C07C/2/70 |
| 2697246 | 4/1994 | (FR) | C07C/15/107 |
| 936 882 | 9/1963 | (GB) . | |
| 2 083 490 | 3/1982 | (GB) . | |
| 2 278 125 | 11/1994 | (GB) | C11D/1/12 |
| 793972 | 1/1981 | (SU) | C07C/2/22 |
| WO 88/07030 | 9/1988 | (WO) | C07C/2/32 |
| WO 95/17961 | 7/1995 | (WO) | B01J/29/06 |
| WO 95/18084 | 7/1995 | (WO) | C07C/5/27 |
| WO 95/21225 | 8/1995 | (WO) | C09K/7/00 |
| WO 97/01521 | 1/1997 | (WO) | C07C/1/04 |
| WO 97/29063 | 8/1997 | (WO) | C07C/15/107 |
| WO 97/29064 | 8/1997 | (WO) | C07C/15/107 |
| WO 97/47573 | 12/1997 | (WO) | C07C/2/66 |
| WO 0012451 | 2/1999 | (WO) . | |
| WO 9905084 | 2/1999 | (WO) . | |

OTHER PUBLICATIONS

"Petroleum–Based Raw Materials for Anionic Surfactants", Surfactant Science Series, vol. 7, Part 1, Chapter 2, pp. 11–86, Ed. W. M. Linfield, Marcel Dekker, Inc., New York (1996), no month available.

Nooi, J. R., et al., "Isomerization Reactions Occuring on Alkylation of Benzene with Some Branched Long–Chain 1–Alkenes", Recueil, vol. 88, No. 4, pp. 398–410 (1969), no month available.

Research Disclosure No. 41412, "Hydrocarbon Mixture", Research Disclolsure, vol. 414 (Oct. 1998).

U.S. application No. 09/479,369, filed Jan. 7, 2000, Scheibel et al.

U.S. application No. 09/478,908, filed Jan. 7, 2000, Scheibel et al.

U.S. application No. 09/479,365, filed Jan. 7, 2000, Kott et al.

U.S. application No. 09/478,909, filed Jan. 7, 2000, Scheibel et al.

U.S. application No. 09/478,906, filed Jan. 7, 2000, Scheibel et al.

U.S. application No. 09/479,364, filed Jan. 7, 2000, Connor et al.

U.S. application No. 09/461,590, filed Dec. 15, 1999, Kott et al.

*Primary Examiner*—Necholus Ogden
(74) *Attorney, Agent, or Firm*—I. S. Robinson; C. Brant Cook; K. W. Zerby

(57) ABSTRACT

This invention relates to hard surface cleaning compositions which include modified alkylbenzene sulfonate surfactant mixtures.

33 Claims, No Drawings

U.S. PATENT DOCUMENTS

| | | | |
|---|---|---|---|
| 4,973,788 | 11/1990 | Lin et al. | 585/511 |
| 4,990,718 | 2/1991 | Pelrine | 585/455 |
| 4,996,386 | 2/1991 | Hamilton, Jr. et al. | 585/646 |
| 5,026,933 | 6/1991 | Blain et al. | 585/7 |
| 5,030,785 | 7/1991 | Huss, Jr. et al. | 585/456 |
| 5,087,788 | 2/1992 | Wu | 585/512 |
| 5,146,026 | 9/1992 | Berna Tejero et al. | 585/467 |
| 5,177,280 | 1/1993 | Juguin et al. | 585/323 |
| 5,196,574 | 3/1993 | Kocal | 562/94 |
| 5,196,624 | 3/1993 | Threlkel et al. | 585/513 |
| 5,196,625 | 3/1993 | Threlkel et al. | 585/513 |
| 5,198,595 | 3/1993 | Lee et al. | 585/467 |
| 5,210,060 | 5/1993 | Radiowski et al. | 505/202 |
| 5,243,116 | 9/1993 | Lee et al. | 585/467 |
| 5,245,072 | 9/1993 | Giancobbe et al. | 560/99 |
| 5,246,566 | 9/1993 | Miller | 208/27 |
| 5,258,566 | 11/1993 | Kresge et al. | 585/467 |
| 5,302,732 | 4/1994 | Steigieder et al. | 554/98 |
| 5,326,928 | 7/1994 | Benazzi et al. | 585/820 |
| 5,334,793 | 8/1994 | Kocal | 585/323 |
| 5,344,997 | 9/1994 | Kocal | 568/628 |
| 5,401,896 | 3/1995 | Kuehl et al. | 585/455 |
| 5,491,271 | 2/1996 | Marinangeli et al. | 585/468 |
| 5,510,306 | 4/1996 | Murray | 502/64 |
| 5,602,292 | 2/1997 | Perego et al. | 585/750 |
| 5,625,105 | 4/1997 | Lin et al. | 585/511 |
| 5,811,612 | 9/1998 | Girotti et al. | 585/467 |
| 5,811,623 | 9/1998 | Ryu et al. | 585/671 |

HARD SURFACE CLEANING COMPOSITIONS COMPRISING MODIFIED ALKYBENZENE SULFONATES

CROSS REFERENCE

This application claims priority under Title 35, United States Code 119(e) from Provisional Application Ser. No. 60/116,508, filed Jan. 20, 1999.

FIELD OF THE INVENTION

This invention relates to hard surface cleaning products comprising particular types of improved alkylbenzene sulfonate surfactant mixtures adapted for use by controlling compositional parameters, especially a 2/3-phenyl index and a 2-methyl-2-phenyl index.

BACKGROUND OF THE INVENTION

The developer and formulator of surfactants for hard surface cleaning must consider a wide variety of possibilities with limited (sometimes inconsistent) information, and then strive to provide overall improvements in one or more of a whole array of criteria, including performance in the presence of free calcium in complex mixtures of surfactants and polymers, e.g. cationic polymers, formulation changes, enzymes, various changes in consumer habits and practices, and the need for biodegradability.

Further, hard surface cleaning should employ materials that enhance the tolerance of the system to hardness, especially to avoid the precipitation of the calcium salts of anionic surfactants. Precipitation of the calcium salts of anionic surfactants is known to cause unsightly deposits on hard surfaces, especially dark hard surfaces. In addition, precipitation of surfactants can lead to losses in performance as a result of the lower level of available cleaning agent. In the context provided by these preliminary remarks, the development of improved alkylbenzene sulfonates for use in hard surface cleaning compositions is clearly a complex challenge. The present invention relates to improvements in such surfactant compositions.

It is an aspect of the present invention to provide mixtures of the modified alkylbenzene sulfonate surfactant mixtures which are formulatable to provide cleaning compositions having one or more advantages, including greater product stability at low temperatures, increased resistance to water hardness, greater efficacy in surfactant systems, filming and streaking, improved removal of greasy or particulate body soils, and the like.

BACKGROUND ART

U.S. Pat. Nos. 5,659,099, 5,393,718, 5,256,392, 5,227,558, 5,139,759, 5,164,169, 5,116,794, 4,840,929, 5,744,673, 5,522,984, 5,811,623, 5,777,187, WO 9,729,064, WO 9,747573, WO 9,729,063, U.S. Pat. Nos. 5,026,933; 4,990,718; 4,301,316; 4,301,317; 4,855,527; 4,870,038; 2,477,382; EP 466,558, Jan. 15, 1992; EP 469,940, Jan. 5, 1992; FR 2,697,246, Apr. 29, 1994; ; SU 793,972, Jan. 7, 1981; U.S. Pat. Nos. 2,564,072; 3,196,174; 3,238,249; 3,355,484; 3,442,964; 3,492,364; 4,959,491; WO 88/07030, Sep. 9, 1990; U.S. Pat. Nos. 4,962,256, 5,196,624; 5,196,625; EP 364,012 B, Feb. 15, 1990; U.S. Pat. Nos. 3,312,745; 3,341,614; 3,442,965; 3,674,885; 4,447,664; 4,533,651; 4,587,374; 4,996,386; 5,210,060; 5,510,306; WO 95/17961, Jul. 6, 1995; WO 95/18084; U.S. Pat. Nos. 5,510,306; 5,087,788; 4,301,316; 4,301,317; 4,855,527; 4,870,038; 5,026,933; 5,625,105 and U.S. Pat. No. 4,973,788. See Vol 56 in "Surfactant Science" series, Marcel Dekker, New York, 1996, including in particular Chapter 2 entitled "Alkylarylsulfonates: History, Manufacture, Analysis and Environmental Properties", pages 39–108, "Surfactant Science" series, Vol 73, Marcel Dekker, New York, 1998 and "Surfactant Science" series, Vol 40, Marcel Dekker, New York, 1992. See also copending U.S. patent applications Ser. No. 60/053,319 filed on Jul. 21, 1997, Ser. No. 60/053,318, filed on Jul. 21, 1997, Ser. No. 60/053,321, filed on Jul. 21, 1997, Ser. No. 60/053,209, filed on Jul. 21, 1997, Ser. No. 60/053,328, filed on Jul. 21, 1997, Ser. No. 60/053,186, filed on Jul. 21, 1997 and the art cited therein. Documents referenced herein are incorporated in their entirety.

SUMMARY OF THE INVENTION

The present invention provides a hard surface cleaning compositions comprising a modified alkylbenzene sulfonate surfactant mixtures and a conventional surface cleansing additive.

Specifically, the first embodiment of the present invention comprises a hard surface cleaning composition comprising:

(i) from about 0.01% to about 95%, preferably from about 1% to about 50%, preferably from about 2% to about 30%, by weight of composition of a modified alkylbenzene sulfonate surfactant mixture comprising:

(a) from about 60% to about 95%, preferably from about 65% to about 90%, more preferably from about 70% to about 85%, by weight of surfactant mixture, a mixture of branched alkylbenzene sulfonates having formula (I):

(I)

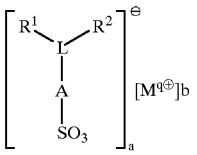

wherein L is an acyclic aliphatic moiety consisting of carbon and hydrogen, said L having two methyl termini and said L having no substituents other than A, $R^1$ and $R^2$; and wherein said mixture of branched alkylbenzene sulfonates contains two or more, preferably at least three, optionally more, of said branched alkylbenzene sulfonates differing in molecular weight of the anion of said formula (I) and wherein said mixture of branched alkylbenzene sulfonates has a sum of carbon atoms in $R^1$, L and $R^2$ of from 9 to 15, preferably from 10 to 14;

an average aliphatic carbon content, i.e., based on $R^1$, L and $R^2$ and excluding A, of from about 10.0 to about 14.0 carbon atoms, preferably from about 11.0 to about 13.0, more preferably from about 11.5 to about 12.5; M is a cation or cation mixture, preferably M is selected from H, Na, K, Ca, Mg and mixtures thereof, more preferably M is selected from H, Na, K and mixtures thereof, more preferably still, M is selected from H, Na, and mixtures thereof, M having a valence q, typically from 1 to 2, preferably 1; a and b are integers selected such that said branched alkylbenzene sulfonates are electroneutral (a is typically from 1 to 2, preferably 1, b is 1); $R^1$ is $C_1$–$C_3$ alkyl, preferably $C_1$–$C_2$ alkyl, more preferably methyl; $R^2$ is selected from H and $C_1$–$C_3$ alkyl (preferably H and $C_1$–$C_2$ alkyl, more preferably H and methyl, more preferably H and methyl provided that in at least about 0.5, more preferably 0.7, more preferably 0.9 to 1.0 mole fraction of said branched alkylbenzene sulfonates, $R^2$ is H); A is a benzene moiety (typically A is the moiety —$C_6H_4$—, with the $SO_3$ moiety of Formula (I) in para-position to the L moiety, though in some proportion, usually no more than about 5%, preferably from 0 to 5% by weight, the $SO_3$ moiety is ortho- to L); and (b) from about 5% to about 40%, preferably from about 10% to about 35%, more preferably from about 15% to about 30%, by weight of surfactant mixture, of a mixture of nonbranched alkylbenzene sulfonates having formula (II):

(II)

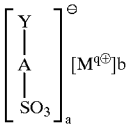

wherein a, b, M, A and q are as defined hereinbefore and Y is an unsubstituted linear aliphatic moiety consisting of carbon and hydrogen having two methyl termini, and wherein said Y has a sum of carbon atoms of from 9 to 15, preferably from 10 to 14, and said Y has an average aliphatic carbon content of from about 10.0 to about 14.0, preferably from about 11.0 to about 13.0, more preferably 11.5 to 12.5 carbon atoms; and wherein said modified alkylbenzene sulfonate surfactant mixture is further characterized by a 2/3-phenyl index of from about 275 to about 10,000, preferably from about 350 to about 1200, more preferably from about 500 to about 700; and also preferably wherein said modified alkylbenzene sulfonate surfactant mixture has a 2-methyl-2-phenyl index of less than about 0.3, preferably less than about 0.2, more preferably less than about 0.1, more preferably still, from 0 to 0.05;

(ii) from about 0.001% to 99.9% by weight of a conventional surface cleansing additive;

wherein said composition is further characterized by a 2/3-phenyl index of from about 275 to about 10,000.

In accordance with the second embodiments of the present invention, there are encompassed herein a number of alternate embodiments, such as those in which there is blending of the novel modified alkylbenzene sulfonate surfactant mixture of the invention with one or more other alkylbenzene sulfonate surfactants. In practical terms, such blending is usually encompassed before sulfonation and detergent formulation, but the outcome is a hard surface cleaning composition containing a blend of the novel modified alkylbenzene sulfonate surfactant with other, known, alkylbenzene sulfonates. Such alternate embodiments of the invention nonlimitingly include those termed herein as "medium 2/3-phenyl surfactant system". Such surfactant system essentially contain useful amounts of the modified alkylbenzene sulfonate surfactant, along with other known alkylbenzene sulfonates subject to specific provisions of the 2/3-phenyl index of the overall composition. Such hard surface cleaning compositions include:

(i) from about 0.1% to about 95% by weight of composition of a medium 2/3-phenyl surfactant system consisting essentially of:

(1) from 1% preferably at least about 5%, more preferably at least about 10%) to about 60% (preferably less than about 50%, more preferably less than about 40%), by weight of surfactant system of a first alkylbenzene sulfonate surfactant, wherein said first alkylbenzene sulfonate surfactant is a modified alkylbenzene sulfonate surfactant mixture, said surfactant mixture comprising:

(a) from about 60% to about 95% by weight of surfactant mixture, a mixture of branched alkylbenzene sulfonates having formula (I):

(I)

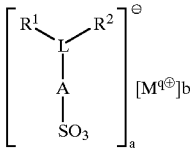

wherein L is an acyclic aliphatic moiety consisting of carbon and hydrogen, said L having two methyl termini and said L having no substituents other than A, $R^1$ and $R^2$; and wherein said mixture of branched alkylbenzene sulfonates contains two or more of said branched alkylbenzene sulfonates differing in molecular weight of the anion of said formula (I) and wherein said mixture of branched alkylbenzene sulfonates has a sum of carbon atoms in $R^1$, L and $R^2$ of from 9 to 15;

an average aliphatic carbon content of from about 10.0 to about 14.0 carbon atoms; M is a cation or cation mixture having a valence q; a and b are integers selected such that said branched alkylbenzene sulfonates are electroneutral; $R^1$ is $C_1$–$C_3$ alkyl; $R^2$ is selected from H and $C_1$–$C_3$ alkyl; A is a benzene moiety; and (b) from about 5% to about 40% by weight of surfactant mixture, of a mixture of nonbranched alkylbenzene sulfonates having formula (II):

(II)

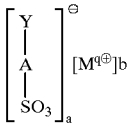

wherein a, b, M, A and q are as defined hereinbefore and Y is an unsubstituted linear aliphatic moiety consisting of carbon and hydrogen having two methyl termini, and wherein said Y has a sum of carbon atoms of from 9 to 15, preferably from 10 to 14, and said Y has an average aliphatic carbon content of from about 10.0 to about 14.0; and wherein said modified alkylbenzene sulfonate surfactant mixture is further characterized by a 2/3-phenyl index of from about 275 to about 10,000; and (2) from 40% (preferably at least about 50%, more preferably at least about 60%) to about 99% (preferably less than about 95%, more preferably less than about 90%), by weight of surfactant system of a second alkylbenzene sulfonate surfactant, wherein said second alkylbenzene sulfonate surfactant is an alkylbenzene sulfonate surfactant mixture other than said modified alkylbenzene sulfonate surfactant mixture (1) (typically said second alkylbenzene sulfonate surfactant is a commercial $C_{10}$–$C_{14}$ linear alkylbenzene sulfonate surfactant, e.g., DETAL® process LAS or HF process LAS though in general any commercial linear (LAS) or branched (ABS, TPBS) type can be used); and wherein said second alkylbenzene sulfonate surfactant has a 2/3-phenyl index of from about 75 to about 160;

provided that said medium 2/3-phenyl surfactant system has a 2/3-phenyl index of from about 160 to about 275, (preferably from about 170 to about 265, more preferably from about 180 to about 255);

(ii) from about 0.001% to 99.9% by weight of a conventional surface cleansing additive.

In a third embodiment the present invention comprises a hard surface cleaning composition comprising:

(i) a modified alkylbenzene sulfonate surfactant mixture comprising the product of a process comprising the steps of:

(I) alkylating benzene with an alkylating mixture;

(II) sulfonating the product of (I); and (III) neutralizing the product of (II);

wherein said alkylating mixture comprises:

(a) from about 1% to about 99.9%, by weight of alkylating mixture of branched $C_9$–$C_{20}$ monoolefins, said branched monoolefins having structures identical with those of the branched monoolefins formed by dehydrogenating branched paraffins of formula $R^1LR^2$ wherein L is an acyclic aliphatic moiety consisting of carbon and hydrogen and containing two terminal methyls; $R^1$ is $C_1$ to $C_3$ alkyl; and $R^2$ is selected from H and $C_1$ to $C_3$ alkyl; and (b) from about 0.1% to about 85%, by weight of alkylating mixture of $C_9$–$C_{20}$ linear aliphatic olefins;

wherein said alkylating mixture contains said branched $C_9$–$C_{20}$ monoolefins having at least two different carbon numbers in said $C_9$–$C_{20}$ range, and has a mean carbon content of from about 9.0 to about 15.0 carbon atoms; and wherein said components (a) and (b) are at a weight ratio of at least about 15:85;

(ii) from about 0.001% to 99.9% by weight of a conventional surface cleansing additive;

wherein said composition is further characterized by a 2/3-phenyl index of from about 275 to about 10,000.

In a fourth embodiment the present invention comprises a hard surface cleaning composition comprising:

(i) a modified alkylbenzene sulfonate surfactant mixture consisting essentially of the product of a process comprising the steps, in sequence, of:

(I) alkylating benzene with an alkylating mixture;

(II) sulfonating the product of (I); and (III) neutralizing the product of (II);

wherein said alkylating mixture comprises:

(a) from about 1% to about 99.9%, by weight of alkylating mixture of a branched alkylating agent selected from the group consisting of:

(A) $C_9$–$C_{20}$ internal monoolefins $R^1LR^2$ wherein L is an acyclic olefinic moiety consisting of carbon and hydrogen and containing two terminal methyls;

(B) $C_9$–$C_{20}$ alpha monoolefins $R^1AR^2$ wherein A is an acyclic alpha-olefinic moiety consisting of carbon and hydrogen and containing one terminal methyl and one terminal olefinic methylene;

(C) $C_9$–$C_{20}$ vinylidene monoolefins $R^1BR^2$ wherein B is an acyclic vinylidene olefin moiety consisting of carbon and hydrogen and containing two terminal methyls and one internal olefinic methylene;

(D) $C_9$–$C_{20}$ primary alcohols $R^1QR^2$ wherein Q is an acyclic aliphatic primary terminal alcohol moiety consisting of carbon, hydrogen and oxygen and containing one terminal methyl;

(E) $C_9$–$C_{20}$ primary alcohols $R^1ZR^2$ wherein Z is an acyclic aliphatic primary nonterminal alcohol moiety consisting of carbon, hydrogen and oxygen and containing two terminal methyls; and (F) mixtures thereof;

wherein in any of (A)–(F), said $R^1$ is $C_1$ to $C_3$ alkyl and said $R^2$ is selected from H and $C_1$ to $C_3$ alkyl; and (b) from about 0.1% to about 85%, by weight of alkylating mixture of $C_9$–$C_{20}$ linear alkylating agent selected from $C_9$–$C_{20}$ linear aliphatic olefins, $C_9$–$C_{20}$ linear aliphatic alcohols and mixtures thereof;

wherein said alkylating mixture contains said branched alkylating agents having at least two different carbon numbers in said $C_9$–$C_{20}$ range, and has a mean carbon content of from about 9.0 to about 15.0 carbon atoms; and wherein said components (a) and (b) are at a weight ratio of at least about 15:85;

(ii) from about 0.001% to 99.9% by weight of a conventional surface cleansing additive;

wherein said composition is further characterized by a 2/3-phenyl index of from about 275 to about 10,000.

In a fifth embodiment the present invention comprises a hard surface cleaning composition comprising:

(i) from about 0.01% to about 95% by weight of composition of a modified alkylbenzene sulfonate surfactant mixture comprising:

(a) from about 60% to about 95% by weight of surfactant mixture, a mixture of branched alkylbenzene sulfonates having formula (I):

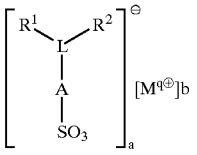

(I)

wherein L is an acyclic aliphatic moiety consisting of carbon and hydrogen, said L having two methyl termini and said L having no substituents other than A, $R^1$ and $R^2$; and wherein said mixture of branched alkylbenzene sulfonates contains two or more of said branched alkylbenzene sulfonates differing in molecular weight of the anion of said formula (I) and wherein said mixture of branched alkylbenzene sulfonates has a sum of carbon atoms in $R^1$, L and $R^2$ of from 9 to 15;

an average aliphatic carbon content of from about 10.0 to about 14.0 carbon atoms; M is a cation or cation mixture having a valence q; a and b are integers selected such that said branched alkylbenzene sulfonates are electroneutral; $R^1$ is $C_1$–$C_3$ alkyl; $R^2$ is selected from H and $C_1$–$C_3$ alkyl; A is a benzene moiety; and (b) from about 5% to about 40% by weight of surfactant mixture, of a mixture of nonbranched alkylbenzene sulfonates having formula (II):

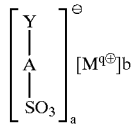

(II)

wherein a, b, M, A and q are as defined hereinbefore and Y is an unsubstituted linear aliphatic moiety consisting of carbon and hydrogen having two methyl termini, and wherein said Y has a sum of carbon atoms of from 9 to 15, preferably from 10 to 14, and said Y has an average aliphatic carbon content of from about 10.0 to about 14.0; and wherein said modified alkylbenzene sulfonate surfactant mixture is further characterized by a 2/3-phenyl index of from about 275 to about 10,000 and wherein said modified alkylbenzene sulfonate surfactant mixture has a 2-methyl-2-phenyl index of less than about 0.3;

(ii) from about 0.001% to 99.9% by weight of a conventional surface cleansing additive; and (iii) from about 0.00001% to about 99.9% of composition of a surfactant selected from the group consisting of anionic surfactants other than those of (i), nonionic surfactants, zwitterionic surfactants, cationic surfactants, amphoteric surfactant and mixtures thereof;

wherein said composition is further characterized by a 2/3-phenyl index of from about 275 to about 10,000; provided that when said composition comprises any alkylbenzene sulfonate surfactant other than said modified alkylbenzene sulfonate surfactant mixture, said composition is further characterized by an overall 2/3-phenyl index of at least about 200, wherein said overall 2/3-phenyl index is determined by measuring 2/3-phenyl index, as defined herein, on a blend of said modified alkylbenzene sulfonate surfactant mixture and said any other alkylbenzene sulfonate to be added to said composition, said blend, for purposes of measurement, being prepared from aliquots of said modified alkylbenzene sulfonate surfactant mixture and said other alkylbenzene sulfonate not yet exposed to any other of the components of said composition; and further provided that when said composition comprises any alkylbenzene sulfonate surfactant other than said modified alkylbenzene sulfonate surfactant mixture, said composition is further characterized by an overall 2-methyl-2-phenyl index of less than about 0.3, wherein said overall 2-methyl-2-phenyl index is to be determined by measuring 2-methyl-2-phenyl index, as defined herein, on a blend of said modified alkylbenzene sulfonate surfactant mixture and any other alkylbenzene sulfonate to be added to said composition, said blend, for purposes of measurement, being prepared from aliquots of said modified alkylbenzene sulfonate surfactant mixture and said other alkylbenzene sulfonate not yet exposed to any other of the components of said composition.

In a sixth embodiment the present invention also includes a method of cleaning a hard surface by administering an effective amount of a hard surface cleaning composition as hereinbefore defined.

In a seventh embodiment the present invention also includes a method for cleaning a hard surface by administering an effective amount of a diluted aqueous solution of the hard surface cleaning compositions as hereinbefore defined.

In an eighth embodiment, the present compositions (according to any of the present compositional embodiments) can be used in combination with an implement for cleaning a surface, the implement preferably comprising:

a. a handle; and b. a removable cleaning pad comprising a suberabsorbent material and having a plurality of substantially planar surfaces, wherein each of the substantially planar surfaces contacts the surface being cleaned, and preferably a pad structure which has both a first layer and a second layer, wherein the first layer is located between the scrubbing layer and the second layer and has a smaller width than the second layer.

Depending on the means used for attaching the cleaning pad to the cleaning implement's handle, it may be preferable for the cleaning pad to further comprise a distinct attachment layer. In these embodiments, the absorbent layer would be positioned between the scrubbing layer and the attachment layer.

The hard surface cleaning composition and, preferably, the implement of the present invention are compatible with all hard surface substrates, including wood, vinyl, linoleum, no wax floors, ceramic, Formica®, porcelain, glass, wall board, and the like.

These and other aspects, features and advantages will be apparent from the following description and the appended claims.

All percentages, ratios and proportions herein are on a weight basis unless otherwise indicated. All documents cited herein are hereby incorporated by reference.

DETAILED DESCRIPTION OF THE INVENTION

The hard surface cleaning compositions of this invention comprise a modified alkylbenzene sulfonate surfactant mixture. The essential and optional components of the modified alkylbenzene sulfonate surfactant mixture and other optional materials of the hard surface cleaning compositions herein, as well as composition form, preparation and use, are described in greater detail as follows: (All concentrations and ratios are on a weight basis unless otherwise specified.) The invention, on the other hand, is not intended to encompass any wholly conventional hard surface cleaning compositions, such as those based exclusively on linear alkylbenzene sulfonates made by any process, or exclusively on known unacceptably branched alkylbenzene sulfonates such as ABS or TPBS.

The surfactant system will be present in the hard surface cleaning composition at preferably at least about 0.5%, more preferably, at least about 1%, even more preferably at least about 2%, even more preferably still at least about 5%, even more preferably still at least about 8%, most preferably at least about 10%, by weight. Furthermore, the surfactant system will be present in the hard surface cleaning composition at preferably at less than about 90%, more preferably less than about 75%, even more preferably less than about 50%, even more preferably less than about 35%, even more preferably less than about 20%, most preferably less than about 15%, by weight.

The conventional surface cleansing additive will be present in the hard surface cleaning composition at preferably at least about 0.5%, more preferably, at least about 1%, even more preferably at least about 2%, even more preferably still at least about 5%, even more preferably still at least about 8%, most preferably at least about 10%, by weight.

Furthermore, the conventional surface cleansing additive will be present in the hard surface cleaning composition at preferably at less than about 90%, more preferably less than about 75%, even more preferably less than about 50%, even more preferably less than about 35%, even more preferably less than about 20%, most preferably less than about 15%, by weight. This conventional surface cleansing additive is selected from the group comprising builders, bleaching compounds, aqueous liquid carrier, co-solvents, polymeric additives, pH adjusting materials, hydrotropes, co-surfactants and mixtures thereof, all of which are hereinafter defined.

As used herein, "hard surfaces", typically refers to floors, walls, windows, kitchen and bathroom furniture, appliances and dishes.

It is preferred that when the hard surface cleaning compositions of the present invention comprise any alkylbenzene sulfonate surfactant other than said modified alkylbenzene sulfonate surfactant mixture (for example as a result of blending into the detergent composition one or more commercial, especially linear, typically linear $C_{10}$–$C_{14}$, alkylbenzene sulfonate surfactants), said composition is further characterized by an overall 2/3-phenyl index of at least about 200, preferably at least about 250, more preferably at least about 350, more preferably still, at least about 500, wherein said overall 2/3-phenyl index is determined by measuring 2/3-phenyl index, as defined herein, on a blend of said modified alkylbenzene sulfonate surfactant mixture and said any other alkylbenzene sulfonate to be added to said composition, said blend, for purposes of measurement, being prepared from aliquots of said modified alkylbenzene sulfonate surfactant mixture and said other alkylbenzene sulfonate not yet exposed to any other of the components of said composition; and further provided that when said composition comprises any alkylbenzene sulfonate surfactant other than said modified alkylbenzene sulfonate surfactant mixture (for example as a result of blending into the composition one or more commercial, especially linear, typically linear $C_{10}$–$C_{14}$, alkylbenzene sulfonate surfactants), said composition is further characterized by an overall 2-methyl-2-phenyl index of less than about 0.3, preferably from 0 to 0.2, more preferably no more than about 0.1, more preferably still, no more than about 0.05, wherein said overall 2-methyl-2-phenyl index is to be determined by measuring 2-methyl-2-phenyl index, as defined herein, on a blend of said modified alkylbenzene sulfonate surfactant mixture and any other alkylbenzene sulfonate to be added to said composition, said blend, for purposes of measurement, being prepared from aliquots of said modified alkylbenzene sulfonate surfactant mixture and said other alkylbenzene sulfonate not yet exposed to any other of the components of said composition. These provisions may appear somewhat unusual, however they are consistent with the spirit and scope of the present invention, which encompasses a number of economical but less preferred approaches in terms of overall cleaning performance, such as blending of the modified alkylbenzene sulfonate surfactants with conventional linear alkylbenzene sulfonate surfactants either during synthesis or during formulation into the detergent composition. Moreover, as is well known to practitioners of detergent analysis, a number of detergent adjuncts (paramagnetic materials and sometimes even water) are capable of interfering with methods for determining the parameters of alkylbenzene sulfonate surfactant mixtures as described hereinafter. Hence wherever possible, analysis should be conducted on dry materials before mixing them into the compositions.

Moreover, the invention encompasses the addition of useful hydrotrope precursors and/or hydrotropes, such as $C_1$–$C_8$ alkylbenzenes, more typically toluenes, cumenes, xylenes, naphthalenes, or the sulfonated derivatives of any such materials, minor amounts of any other materials, such as tribranched alkylbenzene sulfonate surfactants, dialkylbenzenes and their derivatives, dialkyl tetralins, wetting agents, processing aids, and the like. It will be understood that, with the exception of hydrotropes, it will not be usual practice in the present invention to include any such materials. Likewise it will be understood that such materials, if and when they interfere with analytical methods, will not be included in samples of compositions used for analytical purposes.

A preferred modified alkylbenzene sulfonate surfactant mixture according to first embodiment of the present invention has M selected from H, Na, K and mixtures thereof, said a=1, said b=1, said q=1, and said modified alkylbenzene sulfonate surfactant mixture has a 2-methyl-2-phenyl index of less than about 0.3, preferably less than about 0.2, more preferably from 0 to about 0.1.

Such a modified alkylbenzene sulfonate surfactant mixture according can be made as the product of a process using as catalyst a zeolite selected from mordenite, offretite and H-ZSM-12 in at least partially acidic form, preferably an acidic mordenite (in general certain forms of zeolite beta can be used as an alternative but are not preferred). Embodiments described in terms of their making, as well as suitable catalysts, are all further detailed hereinafter.

Another preferred hard surface cleaning composition according to the first embodiment of the invention wherein said modified alkylbenzene sulfonate surfactant mixture consists essentially of said mixture of (a) and (b), wherein said 2-methyl-2-phenyl index of said modified alkylbenzene sulfonate surfactant mixture is less than about 0.1, and said average aliphatic carbon content is from about 11.5 to about 12.5 carbon atoms; said $R^1$ is methyl; said $R^2$ is selected from H and methyl provided that in at least about 0.7 mole fraction of said branched alkylbenzene sulfonates $R^2$ is H; and wherein said sum of carbon atoms in $R^1$, L and $R^2$ is from 10 to 14; and further wherein in said mixture of nonbranched alkylbenzene sulfonates, said Y has a sum of carbon atoms of from 10 to 14 carbon atoms, said average aliphatic carbon content of said nonbranched alkylbenzene sulfonates is from about 11.5 to about 12.5 carbon atoms, and said M is a monovalent cation or cation mixture selected from H, Na and mixtures thereof.

Definitions

Methyl Termini

The terms "methyl termini" and/or "terminal methyl" mean the carbon atoms which are the terminal carbon atoms in alkyl moieties, that is L, and/or Y of formula (I) and formula (II) respectively are always bonded to three hydrogen atoms. That is, they will form a $CH_3$— group. To better explain this, the structure below shows the two terminal methyl groups in an alkylbenzene sulfonate.

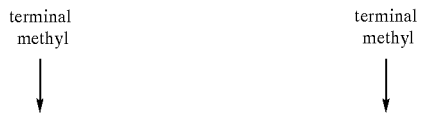

-continued

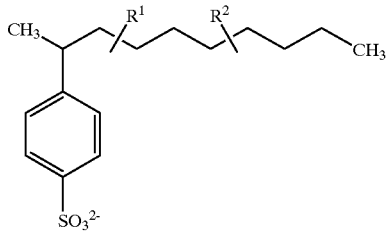

The term "AB" herein when used without further qualification is an abbreviation for "alkylbenzene" of the so-called "hard" or nonbiodegradable type which on sulfonation forms "ABS". The term "LAB" herein is an abbreviation for "linear alkylbenzene" of the current commercial, more biodegradable type, which on sulfonation forms linear alkylbenzene sulfonate, or "LAS". The term "MLAS" herein is an abbreviation for the modified alkylbenzene sulfonate mixtures of the invention.

Impurities

The surfactant mixtures herein are preferably substantially free from impurities selected from tribranched impurities, dialkyl tetralin impurities and mixtures thereof. By "substantially free" it is meant that the amounts of such impurities are insufficient to contribute positively or negatively to the cleaning effectiveness of the composition. Typically there is less than about 5%, preferably less than about 1%, more preferably about 0.1% or less of the impurity, that is typically no one of the impurities is practically detectable.

Illustrative Structures

The better to illustrate the possible complexity of modified alkylbenzene sulfonate surfactant mixtures of the invention and the resulting detergent compositions, structures (a) to (v) below are illustrative of some of the many preferred compounds of formula (I). These are only a few of hundreds of possible preferred structures that make up the bulk of the composition, and should not be taken as limiting of the invention.

(a)

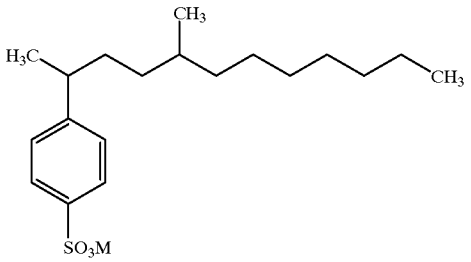

(b)

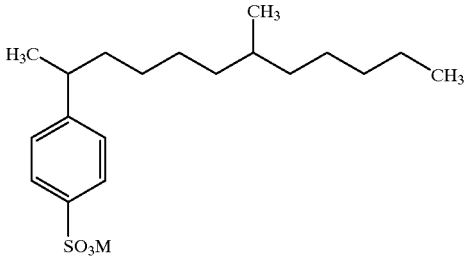

-continued (c)

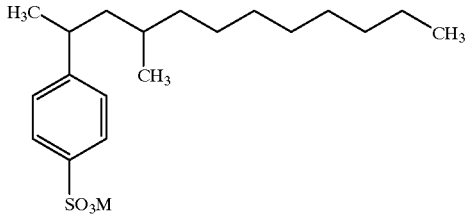

(d)

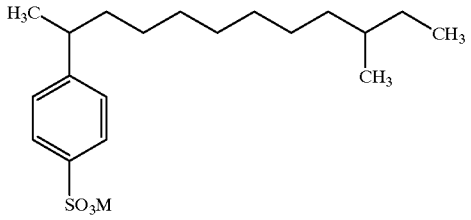

(e)

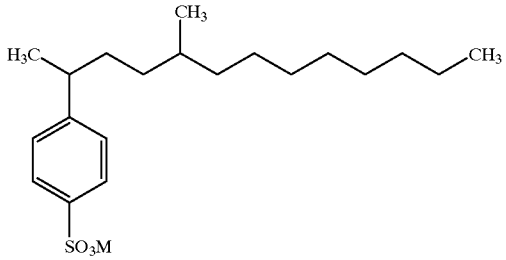

(f)

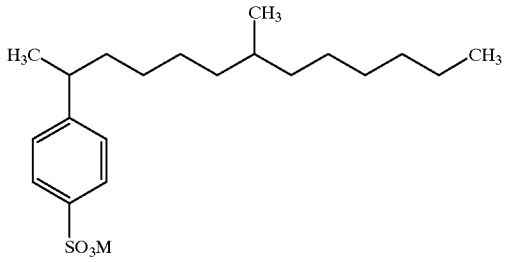

(g)

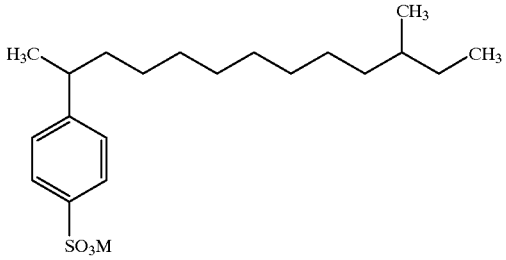

(h)

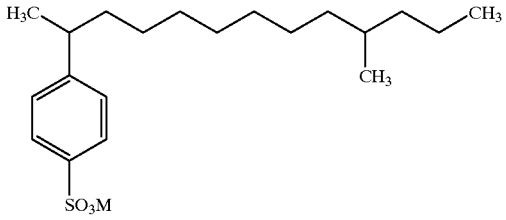

-continued
(i)
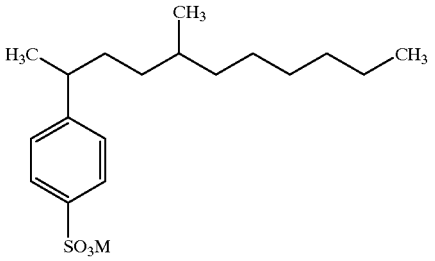
(j)
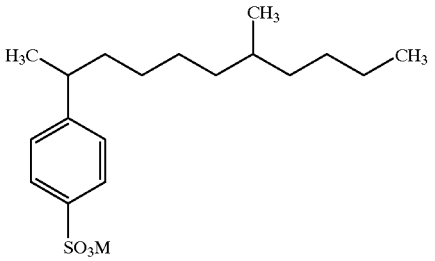
(k)
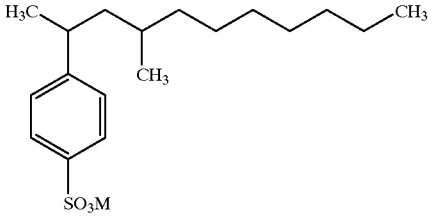
(l)
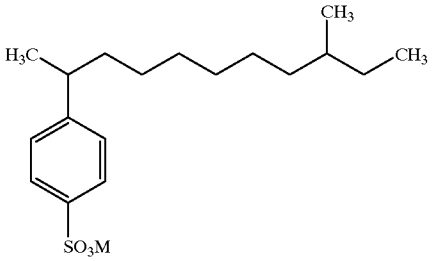
(m)
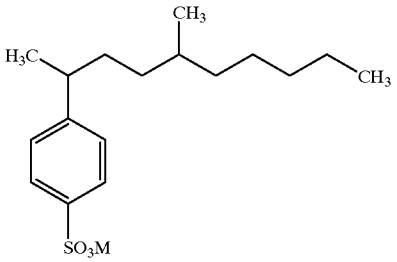
-continued
(n)
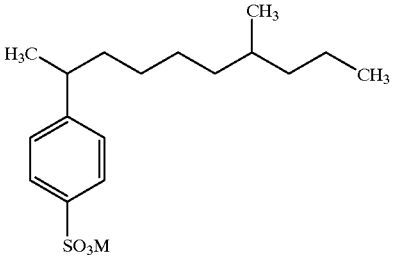
(o)
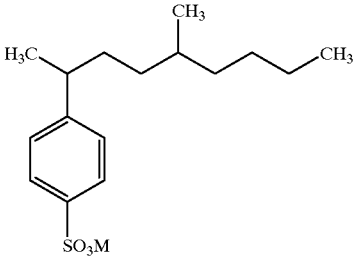
(p)
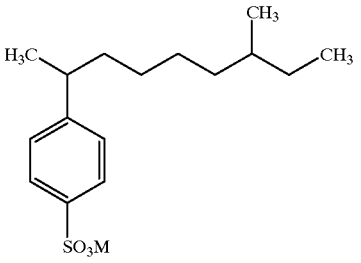
(q)
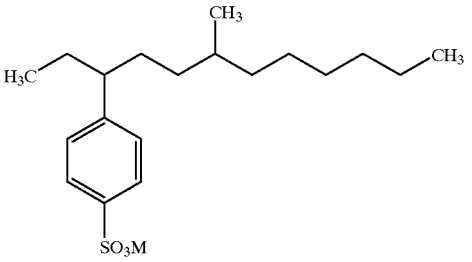
(r)
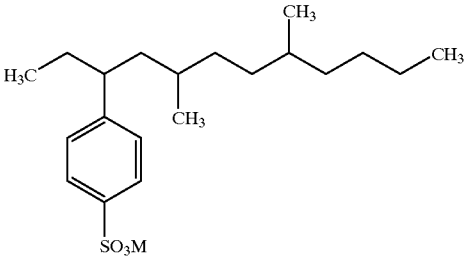
(s)
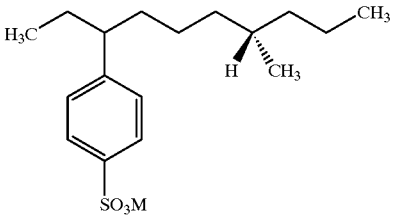

-continued (t)

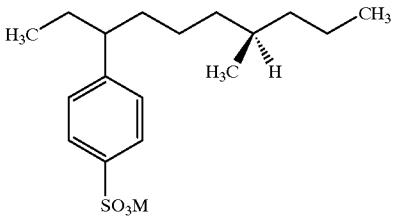

(u)

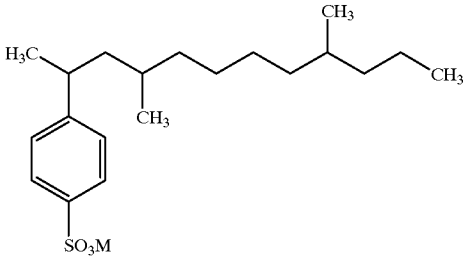

(v)

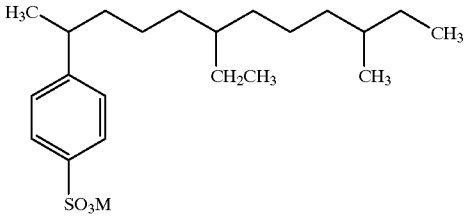

Structures (w) and (x) nonlimitingly illustrate less preferred compounds of Formula (I) which can be present, at lower levels than the above-illustrated preferred types of stuctures, in the modified alkylbenzene sulfonate surfactant mixtures of the invention and the resulting detergent compositions.

(w)

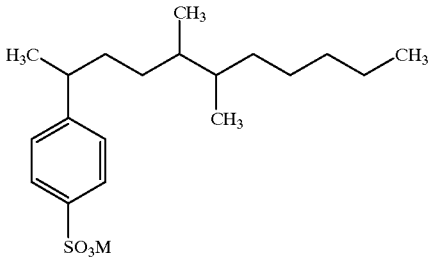

(x)

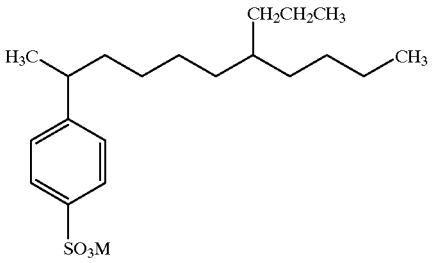

Structures (y), (z), and (aa) nonlimitingly illustrate compounds broadly within Formula (I) that are not preferred but which can be present in the modified alkylbenzene sulfonate surfactant mixtures of the invention and the resulting detergent compositions.

(y)

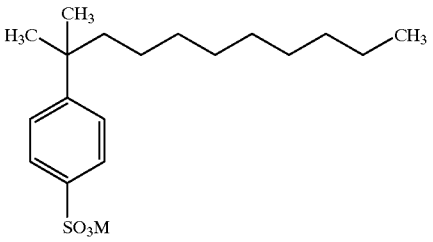

(z)

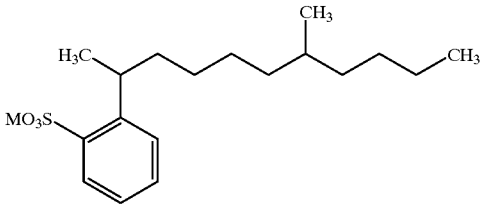

(aa)

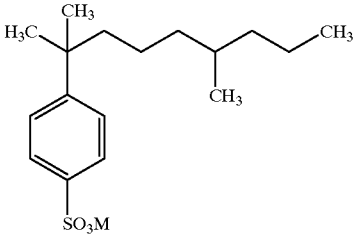

(bb)

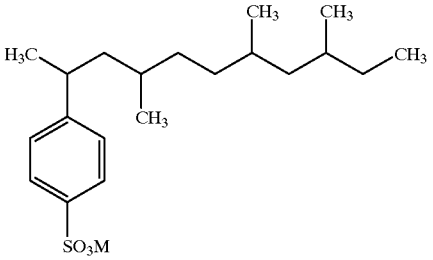

Structure (bb) is illustrative of a tri-branched structure not within Formula (I), but that can be present as an impurity.

Preferably the modified alkylbenzene sulfonate surfactant mixtures herein are the product of sulfonating a modified alkylbenzene, (other than well known tetrapropylene or AB types) wherein the modified alkylbenzene is produced by alkylating benzene with a branched olefin, other than tetrapropylene, and more particularly the lightly branched types described in more detail hereinafter, over an acidic mordenite-type catalyst or other suitable catalyst as defined elsewhere herein.

In certain cases, compositions herein can also be prepared by blending. Thus, the invention includes a detergent composition using a modified alkylbenzene sulfonate surfactant mixture according to the first embodiment wherein said modified alkylbenzene sulfonate surfactant mixture is prepared by a process comprising a step selected from: (i) blending a mixture of branched and linear alkylbenzene sulfonate surfactants having a 2/3-phenyl index of 500 to 700 with an alkylbenzene sulfonate surfactant mixture having a 2/3-phenyl index of 75 to 160 and (ii) blending a mixture of branched and linear alkylbenzenes having a 2/3-phenyl index of 500 to 700 with an alkylbenzene mixture having a 2/3-phenyl index of 75 to 160 and sulfonating said blend. However when a modified alkylbenzene sulfonate surfactant mixture is prepared in this fashion, the resulting surfactant mixture will have a 2/3-phenyl index of from about 275 to about 10,000.

In outline, modified alkylbenzene sulfonate surfactant mixtures herein can be made by the steps of:

(I) alkylating benzene with an alkylating mixture;

(II) sulfonating the product of (I); and (optionally but very preferably)

(III) neutralizing the product of (II).

Provided that suitable alkylation catalysts and process conditions as taught herein are used, the product of step (I) is a modified alkylbenzene mixture in accordance with the invention. Provided that sulfonation is conducted under conditions generally known and reapplicable from LAS manufacture, see for example the literature references cited herein, the product of step (II) is a modified alkylbenzene sulfonic acid mixture in accordance with the invention. Provided that neutralization step (III) is conducted as generally taught herein, the product of step (III) is a modified alkylbenzene sulfonate surfactant mixture in accordance with the invention. Since neutralization can be incomplete, mixtures of the acid and neutralized forms of the present modified alkylbenzene sulfonate systems in all proportions, e.g., from about 1000:1 to 1:1000 by weight, are also part of the present invention. Overall, the greatest criticalities are in step (I).

Preferred modified alkylbenzene sulfonate surfactant mixtures herein comprise the product of a process comprising the steps of: (I) alkylating benzene with an alkylating mixture; (II) sulfonating the product of (I); and (optionally but very preferably) (III) neutralizing the product of (II); wherein said alkylating mixture comprises: (a) from about 1% to about 99.9%, by weight of branched $C_9$–$C_{20}$ (preferably $C_9$–$C_{15}$, more preferably $C_{10}$–$C_{14}$) monoolefins, said branched monoolefins having structures identical with those of the branched monoolefins formed by dehydrogenating branched paraffins of formula $R^1LR^2$ wherein L is an acyclic aliphatic moiety consisting of carbon and hydrogen and containing two terminal methyls; $R^1$ is $C_1$ to $C_3$ alkyl; and $R^2$ is selected from H and $C_1$ to $C_3$ alkyl; and (b) from about 0.1% to about 85%, by weight of $C_9$–$C_{20}$ (preferably $C_9$–$C_{15}$, more preferably $C_{10}$–$C_{14}$) linear aliphatic olefins; wherein said alkylating mixture contains said branched $C_9$–$C_{20}$ monoolefins having at least two different carbon numbers in said $C_9$–$C_{20}$ range, and has a mean carbon content of from about 9.0 to about 15.0 carbon atoms (preferably from about 10.0 to about 14.0, more preferably from about 11.0 to about 13.0, more preferably still from about 11.5 to about 12.5); and wherein said components (a) and (b) are at a weight ratio of at least about 15:85 (preferably having branched component (a) in excess of linear component (b), for example 51% or more by weight of (a) and 49% or less of (b), more preferably 60% to 95% by weight of (a) and 5% to 40% of (b), more preferably still 65% to 90% by weight of (a) and 10% to 35% of (b), more preferably still 70% to 85% by weight of (a) and 15% to 30% of (b) wherein these percentages by weight exclude any other materials, for example diluent hydrocarbons, that may be present in the process).

Also encompassed herein are modified alkylbenzene sulfonate surfactant mixtures consisting essentially of the product of a process comprising the steps, in sequence, of: (I) alkylating benzene with an alkylating mixture; (II) sulfonating the product of (I); and (III) neutralizing the product of (II); wherein said alkylating mixture comprises: (a) from about 1% to about 99.9%, by weight of a branched alkylating agent selected from: (A) $C_9$–$C_{20}$ (preferably $C_9$–$C_{15}$, more preferably $C_{10}$–$C_{14}$) internal monoolefins $R^1LR^2$ wherein L is an acyclic olefinic moiety consisting of carbon and hydrogen and containing two terminal methyls; (B) $C_9$–$C_{20}$ (preferably $C_9$–$C_{15}$, more preferably $C_{10}$–$C_{14}$) alpha monoolefins $R^1AR^2$ wherein A is an acyclic alpha-olefinic moiety consisting of carbon and hydrogen and containing one terminal methyl and one terminal olefinic methylene; (C) $C_9$–$C_{20}$ (preferably $C_9$–$C_{15}$, more preferably $C_{10}$–$C_{14}$) vinylidene monoolefins $R^1BR^2$ wherein B is an acyclic vinylidene olefin moiety consisting of carbon and hydrogen and containing two terminal methyls and one internal olefinic methylene; (D) $C_9$–$C_{20}$ (preferably $C_9$–$C_{15}$, more preferably $C_{10}$–$C_{14}$) primary alcohols $R^1QR^2$ wherein Q is an acyclic aliphatic primary terminal alcohol moiety consisting of carbon, hydrogen and oxygen and containing one terminal methyl; (E) $C_9$–$C_{20}$ (preferably $C_9$–$C_{15}$, more preferably $C_{10}$–$C_{14}$) primary alcohols $R^1ZR^2$ wherein Z is an acyclic aliphatic primary nonterminal alcohol moiety consisting of carbon, hydrogen and oxygen and containing two terminal methyls; and (F) mixtures thereof; wherein in any of (A)–(F), said $R^1$ is $C_1$ to $C_3$ alkyl and said $R^2$ is selected from H and $C_1$ to $C_3$ alkyl; and (b) from about 0.1% to about 85%, by weight of $C_9$–$C_{20}$ (preferably $C_9$–$C_{15}$, more preferably $C_{10}$–$C_{14}$) linear alkylating agent selected from $C_9$–$C_{20}$ (preferably $C_9$–$C_{15}$, more preferably $C_{10}$–$C_{14}$) linear aliphatic olefins, $C_9$–$C_{20}$ (preferably $C_9$–$C_{15}$, more preferably $C_{10}$–$C_{14}$) linear aliphatic alcohols and mixtures thereof; wherein said alkylating mixture contains said branched alkylating agents having at least two different carbon numbers in said $C_9$–$C_{20}$ (preferably $C_9$–$C_{15}$, more preferably $C_{10}$–$C_{14}$) range, and has a mean carbon content of from about 9.0 to about 15.0 carbon atoms (preferably from about 10.0 to about 14.0, more preferably from about 11.0 to about 13.0, more preferably still from about 11.5 to about 12.5); and wherein said components (a) and (b) are at a weight ratio of at least about 15:85 (preferably having branched component (a) in excess of linear component (b), for example 51% or more by weight of (a) and 49% or less of (b), more preferably 60% to 95% by weight of (a) and 5% to 40% of (b), more preferably still 65% to 90% by weight of (a) and 10% to 35% of (b), more preferably still 70% to 85% by weight of (a) and 15% to 30% of (b) wherein these percentages by weight exclude any other materials, for example diluent hydrocarbons, that may be present in the process).

In more highly preferred embodiments, the invention encompasses a modified alkylbenzene sulfonate surfactant mixture prepared in accordance with the above-outlined steps wherein said alkylating mixture consists essentially of: (a) from about 0.5% to about 47.5%, by weight of said branched alkylating agent selected from: (G) $C_9$–$C_{14}$ internal monoolefins $R^1LR^2$ wherein L is an acyclic olefinic moiety consisting of carbon and hydrogen and containing two terminal methyls; (H) $C_9$–$C_{14}$ alpha monoolefins $R^1AR^2$ wherein A is an acyclic alpha-olefinic moiety consisting of carbon and hydrogen and containing one terminal methyl and one terminal olefinic methylene; and (J) mixtures thereof; wherein in any of (G)–(H), said $R^1$ is methyl, and said $R^2$ is H or methyl provided that in at least about 0.7 mole fraction of the total of said monoolefins, $R^2$ is H; and (b) from about 0.1% to about 25%, by weight of $C_9$–$C_{14}$ linear aliphatic olefins; and (c) from about 50% to about 98.9%, by weight of carrier materials selected from paraffins and inert nonparaffinic solvents; wherein said alkylating mixture contains said branched alkylating agents having at least two different carbon numbers in said $C_9$–$C_{14}$ range, and has a mean carbon content of from about 11.5 to about 12.5 carbon atoms; and wherein said components (a) and (b) are at a weight ratio of from about 51:49 to about 90:10.

Other modified alkylbenzene sulfonate surfactant mixtures herein are made by the above-outlined processes wherein in step (I), said alkylation is performed in the presence of an alkylation catalyst, said alkylation catalyst is an intermediate acidity solid porous alkylation catalyst, and step (II) comprises removal of components other than monoalkylbenzene prior to contacting the product of step (I) with sulfonating agent.

Also encompassed is the modified alkylbenzene sulfonate surfactant mixture according to the above-defined processes wherein said alkylation catalyst is other than a member selected from the group consisting of HF, $AlCl_3$, sulfuric acid and mixtures thereof. Such is the case when the alkylation catalyst is selected from the group consisting of non-fluoridated acidic mordenite-type catalyst, fluoridated acidic mordenite-type catalyst and mixtures thereof. Catalysts are described in more detail hereinafter.

The processes are tolerant of variation, for example conventional steps can be added before, in parallel with, or after the outlined steps (I), (II) and (III). This is especially the case for accomodating the use of hydrotropes or their precursors. Thus the invention encompasses a modified alkylbenzene sulfonate surfactant mixture according to the above-outlined processes wherein a hydrotrope, hydrotrope precursor, or mixtures thereof is added after step (I); or the hydrotrope, hydrotrope precursor or mixtures thereof is added during or after step (II) and prior to step (III); or a hydrotrope can be added during or after step (III).

Sulfonation and Workup or Neutralization (Steps II/III)

In general, sulfonation of the modified alkylbenzenes in the instant process can be accomplished using any of the well-known sulfonation systems, including those described in "Detergent Manufacture Including Zeolite Builders and other New Materials", Ed. Sittig., Noyes Data Corp., 1979, as well as in Vol. 56 in "Surfactant Science" series, Marcel Dekker, New York, 1996, including in particular Chapter 2 entitled "Alkylarylsulfonates: History, Manufacture, Analysis and Environmental Properties", pages 39–108 which includes 297 literature references. This work provides access to a great deal of literature describing various processes and process steps, not only sulfonation but also dehydrogenation, alkylation, alkylbenzene distillation and the like. Common sulfonation systems useful herein include sulfuric acid, chlorosulfonic acid, oleum, sulfur trioxide and the like. Sulfur trioxide/air is especially preferred. Details of sulfonation using a suitable air/sulfur trioxide mixture are provided in U.S. Pat. No. 3,427,342, Chemithon. Sulfonation processes are further extensively described in "Sulfonation Technology in the Detergent Industry", W. H. de Groot, Kluwer Academic Publishers, Boston, 1991.

Any convenient workup steps may be used in the present process. Common practice is to neutralize after sulfonation with any suitable alkali. Thus the neutralization step can be conducted using alkali selected from sodium, potassium, ammonium, magnesium and substituted ammonium alkalis and mixtures thereof. Potassium can assist solubility, magnesium can promote soft water performance and substituted ammonium can be helpful for formulating specialty variations of the instant surfactants. The invention encompasses any of these derivative forms of the modified alkylbenzenesulfonate surfactants as produced by the present process and their use in consumer product compositions.

Alternately the acid form of the present surfactants can be added directly to acidic cleaning products, or can be mixed with cleaning ingredients and then neutralized.

The hydrotropes or hydrotrope precursors useful herein can in general be selected from any suitable hydrotrope or hydrotrope precursor, including lower alkyl ($C_1$–$C_8$) aromatics and their sulfonic acids and sulfonate salts, but are more typically based on a sulfonic acid or sodium sulfonate salt of toluene, cumene, xylene, napthalene or mixtures thereof. The hydrotrope precursors are selected from any suitable hydrotrope precursor, typically toluene, cumene, xylene, napthalene or mixtures thereof. A hydrotrope precursor is a compound that during step (III), namely the sulfonation step, is converted into a hydrotrope.

In terms of process conditions for alkylation, the invention encompasses a modified alkylbenzene sulfonate surfactant mixture wherein in step (I) said alkylation is performed at a temperature of from about 125° C. to about 230° C. (preferably from about 175° C. to about 215° C.) and at a pressure of from about 50 psig to about 1000 psig (preferably from about 100 psig to about 250 psig). Preferably in step (I) said alkylation is performed at a temperature of from about 175° C. to about 215° C., at a pressure of from about 100 psig to about 250 psig. and a time of from about 0.01 hour to about 18 hours (preferably, as rapidly as possible, more typically from about 0.1 hour to about 5 hours). If desired such alkylation may be conducted in one or more stages. Different stages of the process can be conducted in different manufacturing facilities. Typically in practice, LAB manufacturers will conduct step (I), with detergent manufacturers conducting step (III). Step (II) is typically conducted by either, or can even be conducted by third party manufacturers.

In general it is found preferable in step (I) to couple together the use of relatively low temperatures (e.g., 175° C. to about 215° C.) with reaction times of medium duration (1 hour to about 8 hours) in the above-indicated ranges.

It is possible even to "target" for desirably low 2-methyl-2-phenyl index in the present inventive compositions by selecting a relatively low reaction temperature, e.g., about 190° C., and to monitor the progress of the reaction by any convenient means (e.g., sampling and NMR analysis) to assure adequate completion while minimizing 2-methyl-2-phenyl index.

Moreover, it is contemplated that the alkylation "step" (I) herein can be "staged" so that two or more reactors operating under different conditions in the defined ranges may be useful. By operating a plurality of such reactors, it is possible to allow for material with less preferred 2-methyl-2-phenyl index to be initially formed and, surprisingly, to convert such material into material with a more preferred 2-methyl-2-phenyl index.

In terms of sulfonating agent selection, the invention encompasses a modified alkylbenzene sulfonate surfactant mixture wherein step (II) is performed using a sulfonating agent selected from the group consisting of sulfur trioxide, sulfur trioxide/air mixtures, and sulfuric acid (including oleum). Chlorosulfonic acid or other known sulfonating agents, while less commercially relevant, are also useful and are included for use in the invention.

Although in general, neutralization step (III) can be carried out with any suitable alkali, the invention includes a modified alkylbenzene sulfonate surfactant mixture wherein said step (III) is performed using a basic salt, said basic salt having a cation selected from the group consisting of alkali metal, alkaline earth metal, ammonium, substituted ammonium, and mixtures thereof and an anion selected from hydroxide, oxide, carbonate, silicate, phosphate, and mixtures thereof. Preferred basic salt is selected from the group consisting of sodium hydroxide, sodium silicate, potassium hydroxide, potassium silicate, magnesium hydroxide, ammonium hydroxide, and mixtures thereof.

Alkylation Catalyst

To secure the modified alkylbenzene sulfonate surfactant mixtures of the invention, the present invention uses a particularly defined alkylation catalyst. Said alkylation catalyst is an intermediate acidity solid porous alkylation catalyst defined in detail hereinafter. Particularly preferred alkylation catalysts comprise at least partially dealuminized acidic fluoridated mordenites, at least partially dealuminized acidic nonfluoridated mordenites, and mixtures thereof.

Numerous alkylation catalysts are unsuitable for making the present modified alkylbenzene mixtures and modified alkylbenzene sulfonate surfactant mixtures. Unsuitable alkylation catalysts include any of: sulfuric acid, aluminum chloride, and HF. Also unsuitable are non-acidic calcium mordenite, and many others. Other catalysts, such as the DETAL® process catalysts of UOP are also unsuitable, at least in their current commercial executions. Indeed no alkylation catalyst currently used for alkylation in the commercial production of detergent C10–C14 linear alkylbenzene sulfonates for use in laundry products are suitable.

In contrast, suitable alkylation catalysts herein are selected from shape-selective moderately acidic alkylation catalysts, preferably zeolitic. The zeolite catalyst used for the alkylation step (I) is preferably selected from the group consisting of mordenite, HZSM-12, and offretite, any of these being in at least partially acidic form. Mixtures can be used and the catalysts can be combined with binders etc. as described hereinafter. More preferably, the zeolite is substantially in acid form and is contained in a catalyst pellet comprising a conventional binder and further wherein said catalyst pellet comprises at least about 1%, more preferably at least 5%, more typically from 50% to about 90%, of said zeolite.

More generally, a suitable alkylation catalyst is typically at least partially crystalline, more preferably substantially crystalline not including binders or other materials used to form catalyst pellets, aggregates or composites. Moreover the catalyst is typically at least partially acidic. Fully exchanged Ca-form mordenite, for example, is unsuitable whereas H-form mordenite is suitable.

The pores characterizing the zeolites useful in the present alkylation process may be substantially circular, uniform pores of about 6.2 Angstrom, or preferably may be somewhat elliptical, such as in mordenite. It should be understood that, in any case, the zeolites used as catalysts in the alkylation step of the present process have a major pore dimension intermediate between that of the large pore zeolites, such as the X and Y zeolites, and the relatively small pore size zeolites ZSM-5 and ZSM-11, and preferably between about 6 Angstrom and about 7 Angstrom. Indeed ZSM-5 has been tried and found inoperable in the present invention. The pore size dimensions and crystal structures of certain zeolites are specified in ATLAS OF ZEOLITE STRUCTURE TYPES by W. M. Meier and D. H. Olson, published by the Structure Commission of the International Zeolite Association (1978 and more recent editions) and distributed by Polycrystal Book Service, Pittsburgh, Pa.

The zeolites useful in the alkylation step of the instant process generally have at least 10 percent of the cationic sites thereof occupied by ions other than alkali or alkaline-earth metals. Typical but non-limiting replacing ions include ammonium, hydrogen, rare earth, zinc, copper and aluminum. Of this group, particular preference is accorded ammonium, hydrogen, rare earth or combinations thereof. In a preferred embodiment, the zeolites are converted to the predominantly hydrogen form, generally by replacement of the alkali metal or other ion originally present with hydrogen ion precursors, e.g., ammonium ions, which upon calcination yield the hydrogen form. This exchange is conveniently carried out by contact of the zeolite with an ammonium salt solution, e.g., ammonium chloride, utilizing well known ion exchange techniques. In certain preferred embodiments, the extent of replacement is such as to produce a zeolite material in which at least 50 percent of the cationic sites are occupied by hydrogen ions.

The zeolites may be subjected to various chemical treatments, including alumina extraction (dealumination) and combination with one or more metal components, particularly the metals of Groups IIB, III, IV, VI, VII and VIII. It is also contemplated that the zeolites may, in some instances, desirably be subjected to thermal treatment, including steaming or calcination in air, hydrogen or an inert gas, e.g. nitrogen or helium.

A suitable modifying treatment entails steaming of the zeolite by contact with an atmosphere containing from about 5 to about 100% steam at a temperature of from about 250° C. to 1000° C. Steaming may last for a period of between about 0.25 and about 100 hours and may be conducted at pressures ranging from sub-atmospheric to several hundred atmospheres.

In practicing the desired alkylation step of the instant process, it may be useful to incorporate the above-described intermediate pore size crystalline zeolites in another material, e.g., a binder or matrix resistant to the temperature and other conditions employed in the process. Such matrix materials include synthetic or naturally occurring substances as well as inorganic materials such as clay, silica, and/or metal oxides. Matrix materials can be in the form of gels including mixtures of silica and metal oxides. The latter may be either naturally occurring or in the form of gels or gelatinous precipitates. Naturally occurring clays which can be composited with the zeolite include those of the montmorillonite and kaolin families, which families include the sub-bentonites and the kaolins commonly known as Dixie, McNamee-Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the intermediate pore size zeolites employed herein may be compounded with a porous matrix material, such as alumina, silica-alumina, silica-magnesia, silica-zirconia, silica-thoria, silica-beryllia, and silica-titania, as well as ternary combinations, such as silica-alumina-thoria, silica-alumina-zirconia, silica-alumina-magnesia and silica-magnesia-zirconia. The matrix may be in the form of a cogel. The relative proportions of finely divided zeolite and inorganic oxide gel matrix may vary widely, with the zeolite content ranging from between about 1 to about 99% by weight and more usually in the range of about 5 to about 80% by weight of the composite.

A group of zeolites which includes some useful for the alkylation step herein have a silica:alumina ratio of at least 2:1, preferably at least 10:1 more preferably at least 20:1. The silica:alumina ratios referred to in this specification are the structural or framework ratios, that is, the ratio for the $SiO_4$ to the $AlO_4$ tetrahedra. In practice, silica:alumina ratios as determined by various physical and chemical methods are acceptable for use herein. It should be understood that such methods may acceptably give some variation. For example, a gross chemical analysis may include aluminum which is present in the form of cations associated with the acidic sites on the zeolite, thereby giving a somewhat low experimentally determined silica:alumina ratio. Similarly, if the ratio is determined by thermogravimetric analysis (TGA) of ammonia desorption, a somewhat low ammonia titration may be obtained if cationic aluminum prevents exchange of the ammonium ions onto the acidic sites. These disparities are well known in the art. They can be troublesome when certain treatments, such as the dealuminization methods described below which result in the presence of ionic aluminum free of the zeolite structure, are employed. Due care should therefore be taken to ensure that the framework silica:alumina ratio is correctly determined to the extent acceptable to a practitioner of the art.

When the zeolites have been prepared in the presence of organic cations they are typically catalytically inactive, commonly because the intracrystalline free space is occupied by organic cations from the forming solution. They may be activated by heating in an inert atmosphere at 540° C. for one hour, for example, followed by base exchange with ammonium salts followed by calcination at 540° C. in air. The presence of organic cations in the forming solution may not be absolutely essential to the formation of the zeolite; but it does appear to favor the formation of this special type of zeolite. Some natural zeolites may sometimes be converted to zeolites of the desired type by various activation procedures and other treatments such as base exchange, steaming, alumina extraction and calcination. The zeolites preferably have a crystal framework density, in the dry hydrogen form, not substantially below about 1.6 g/cm$^3$. The dry density for known structures may be calculated from the number of silicon plus aluminum atoms per 1000 cubic Angstroms, as given, e.g., on page 19 of the article on Zeolite Structure by W. M. Meier included in "Proceedings of the Conference on Molecular Sieves, London, April 1967", published by the Society of Chemical Industry, London, 1968. Reference is made to this paper for a discussion of the crystal framework density. A further discussion of crystal framework density, together with values for some typical zeolites, is given in U.S. Pat. No. 4,016,218, to which reference is made. When synthesized in the alkali metal form, the zeolite is conveniently converted to the hydrogen (acidic) form, generally via intermediate formation of the ammonium form by ammonium ion exchange and calcination of the ammonium form to yield the hydrogen form. It has been found that although the hydrogen form of the zeolite catalyzes the reaction successfully, the zeolite may also be partly in the alkali metal form and/or the form of other metal salts.

EP 466,558 describes an acidic mordenite type alkylation catalyst also of possible use herein having overall Si/Al atomic ratio of 15-85 (15-60), Na weight content is less than 1000 ppm (preferably less than 250 ppm), and there is a low or zero content of extra-network Al species; the elementary mesh volume as defined in EP 466,558 is below 2,760 nm$^3$.

U.S. Pat. No. 5,057,472 is likewise useful for preparing alkylation catalysts herein and relates to concurrent dealumination and ion-exchange of an acid-stable Na ion-containing zeolite, preferably mordenite, effected by contact of the zeolite with a 0.5–3 (preferably 1–2.5) M $NHO_3$ solution containing sufficient $NH_4NO_3$ to fully exchange the $Na^+$ ions for $NH_4^+$ and $H^+$ ions. The resulting zeolites can have a $SiO_2$:$Al_2O_3$ ratio of 15:1 to 26:1, preferably 17:1 to 23:1, and are preferably calcined to at least partially convert the $NH_4^+/H^+$ form to the $H^+$ form. Optionally, though not necessarily particularly desirable in the present invention, the catalyst can contain a Group VIII metal (and optionally also an inorganic oxide) together with the calcined zeolite of '472.

Another acidic mordenite catalyst useful for the alkylation step herein is disclosed in U.S. Pat. No. 4,861,935 which relates to a hydrogen form of mordenite incorporated with alumina, the composition having a surface area of at least 580 m$^2$/g. Other acidic mordenite catalysts useful for the alkylation step herein include those described in U.S. Pat. Nos. 5,243,116 and 5,198,595. Yet another alkylation catalyst useful herein is described in U.S. Pat. No. 5,175,135 which is an acid mordenite zeolite having a silica/alumina molar ratio of at least 50:1, a Symmetry Index of at least 1.0 as determined by X-ray diffraction analysis, and a porosity such that the total pore volume is in the range from about 0.18 cc/g to about 0.45 cc/g and the ratio of the combined meso- and macropore-volume to the total pore volume is from about 0.25 to about 0.75.

Particularly preferred alkylation catalysts herein include the acidic mordenite catalysts Zeocat™ FM-8/25H available from Zeochem; CBV 90 A available from Zeolyst International, and LZM-8 available from UOP Chemical Catalysts as well as fluoridated versions of the above commercial catalysts. Fluoridated mordenites can be prepared by a number of ways. A method of providing a particularly useful fluoridated mordenite is described in U.S. Pat. No. 5,777,187. The invention encompasses preferred embodiments in which the mordenites are fluoridated, but also has other preferred embodiments in which the mordenites are non-fluoridated.

Most generally, any alkylation catalyst may be used herein provided that the alkylation catalyst can (a) accommodate branched olefins as described elsewhere herein into the smallest pore diameter of said catalyst and (b) selectively alkylate benzene with said branched olefins and optionally mixtures thereof with nonbranched olefins. Acceptable selectivity is in accordance with a 2/3-Phenyl index of about 275 to about 10,000 as defined herein.

In other terms, the catalyst selections herein are made in part with the intention of minimizing internal alkylbenzene formation (e.g., 4-phenyl, 5-phenyl . . . ) The formulators contributing to the present invention have unexpectedly discovered that control of internal alkylbenzene sulfonate isomers in the present inventive surfactant mixtures in conjunction with introduction of limited methyl branching is very helpful for improving their performance. The present invention connects this discovery to discoveries of the synthesis chemists in the present invention, who have determined how to control internal isomer content while providing limited methyl branching in the modified alkylbenzene sulfonate surfactant mixtures in accordance with the formulators' prescriptions.

The extent to which internal isomer content needs to be controlled can vary depending on the consumer product application and on whether outright best performance or a balance of performance and cost is required. In absolute terms, the amount of internal isomer such as internal alkylbenzene isomer is preferably always kept below 25% by weight, but for best results, from 0 to 10%, preferably less than about 5% by weight. "Internal alkylbenzene" isomers as defined herein include alkylbenzenes having phenyl attachment to an aliphatic chain in the 4,5,6 or 7 position.

Without intending to be limited by theory, there are two reasons for which it is believed that the prefered alkylation catalysts are the above-described shape selective zeolitic type catalysts, especially mordenites. The first reason is to provide the selectivity of formation of preferred compounds such as branched and nonbranched 2-phenyl and 3-phenylalkylbenzenes. This selectivity is measured by the 2/3-phenyl index. The second reason is to control the amount of quaternary alkylbenzenes and thus quaternary alkylbenzenesulfonates.

Results with alkylation catalysts such as HF can give quite high levels of quaternary alkylbenzenes as shown in the literature (see J. Org. Chem. Vol 37, No. 25, 1972). This contrasts with the surprising discovery as part of the present invention that one can attain low levels of quaternary alkylbenzenes in catalyzed reactions of benzene with branched olefins, as characterized by 2-methyl-2-phenyl index. Even when the olefins used are substantially dibranched, as illustrated herein, a low 2-methyl-2-phenyl index of less than 0.1 can surprisingly be obtained.

Numerous variations of the present detergent compositions are useful. Such variations include:

the detergent composition which is substantially free from alkylbenzene sulfonate surfactants other than said modified alkylbenzene sulfonate surfactant mixture;

the detergent composition which comprises, at least about 0.1%, preferably no more than about 10%, more preferably no more than about 5%, more preferably still, no more than about 1% by weight of composition, of a commercial $C_{10}$–$C_{14}$ linear alkylbenzene sulfonate surfactant;

the detergent composition which comprises, at least about 0.1%, preferably no more than about 10%, more preferably no more than about 5%, more preferably still, no more than about 1% by weight of composition, of a commercial highly branched alkylbenzene sulfonate surfactant. (e.g., TPBS or tetrapropylbenzene sulfonate);

the detergent composition which comprises, a nonionic surfactant at a level of from about 0.5% to about 25% by weight of composition, and wherein said nonionic surfactant is a polyalkoxylated alcohol in capped or non-capped form having:—a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof and—a hydrophilic group selected from 1–15 ethoxylates, 1–15 propoxylates 1–15 butoxylates and mixtures thereof, in capped or uncapped form. (when uncapped, there is also present a terminal primary —OH moiety and when capped, there is also present a terminal moiety of the form —OR wherein R is a $C_1$–$C_6$ hydrocarbyl moiety, optionally comprising a primary or, preferably when present, a secondary alcohol.);

the detergent composition which comprises, an alkyl sulfate surfactant at a level of from about 0.5% to about 25% by weight of composition, wherein said alkyl sulfate surfactant has a hydrophobic group selected from linear $C_{10}$–$C_{18}$ alkyl, mid-chain $C_1$–$C_3$ branched $C_{10}$–$C_{18}$ alkyl, guerbet branched $C_{10}$–$C_{18}$ alkyl, and mixtures thereof and a cation selected from Na, K and mixtures thereof;

the detergent composition which comprises, an alkyl (polyalkoxy)sulfate surfactant at a level of from about 0.5% to about 25% by weight composition, wherein said alkyl(polyalkoxy)sulfate surfactant has—a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof and—a (polyalkoxy)sulfate hydrophilic group selected from 1–15 polyethoxysulfate, 1–15 polypropoxysulfate, 1–15 polybutoxysulfate, 1–15 mixed poly(ethoxy/propoxy/butoxy)sulfates, and mixtures thereof, in capped or uncapped form; and—a cation selected from Na, K and mixtures thereof.

Further the present invention includes a detergent composition comprising (preferably consisting essentially of): (i) from about 0.01% to about 95%, by weight of composition, (preferably from about 0.5% to about 50%, more preferably from about 1%, preferably at least 2%, more preferably at least 4%, more preferably at least 6%, more preferably still at least 8% to about 35%) of modified alkylbenzene sulfonate surfactant mixture according to the invention; (ii) from about 0.00001% to about 99.9% by weight of composition (preferably from about 5% to about 98%, more preferably from about 50% to about 95%) of a conventional surface cleansing additive; and (iii) from about 0.00001% to about 99.9% by weight of composition (preferably from about 0.1% to about 50%, more preferably from about 0.2% to about 40%, even more preferably form about 0.5% to about 30%), of a surfactant selected from the group consisting of anionic surfactants other than said modified alkylbenzene sulfonate surfactant mixture, nonionic, cationic, amphoteric, zwitterionic and mixtures thereof; provided that when said detergent composition comprises any other alkylbenzene sulfonate than the alkylbenzene sulfonate of said modified alkylbenzene sulfonate surfactant mixture, said modified alkylbenzene sulfonate surfactant mixture and said other alkylbenzene sulfonate, as a mixture, have an overall 2/3-phenyl index of from about 275 to about 10,000 (preferably from about 350 to about 1200, more preferably from about 500 to about 700).

Also more generally, the inventive detergent compositions can take the form of a liquid, powder, agglomerate, paste, tablet, bar, gel, liqui-gel, microemulsion, liquid crystal, or granule.

Thus the invention includes a 2/3-phenyl surfactant mixture consisting essentially of: from 1% (preferably at least about 5%, more preferably at least about 10%) to about 60% (in one mode preferably less than about 50%, more preferably less than about 40%), by weight of surfactant system of a first alkylbenzene sulfonate surfactant, wherein said first alkylbenzene sulfonate surfactant is a modified alkylbenzene sulfonate surfactant mixture according to the first embodiment; and from 40% (in one mode preferably at least about 50%, more preferably at least about 60%) to about 99% (preferably less than about 95%, more preferably less than about 90%), by weight of surfactant system of a second alkylbenzene sulfonate surfactant, wherein said second alkylbenzene sulfonate surfactant is an alkylbenzene sulfonate surfactant mixture other than said modified alkylbenzene sulfonate surfactant mixture according to the first embodiment, and wherein said second alkylbenzene sulfonate surfactant has a 2/3-phenyl index of from about 75 to about 160 (typically said second alkylbenzene sulfonate surfactant is a commercial $C_{10}$–$C_{14}$ linear alkylbenzene sulfonate surfactant, e.g., DETAL® process LAS or HF process LAS though in general any commercial linear (LAS) or branched (ABS, TPBS) type can be used); provided that said medium 2/3-phenyl surfactant mixture has a 2/3-phenyl index of from about 160 to about 275 (preferably from about 170 to about 265, more preferably from about 180 to about 255). (of course it is equally possible within the spirit and scope of the invention to prepare any blend of the modified alkylbenzene sulfonate surfactant mixture of the invention with any known commercial linear or branched alkylbenzene sulfonate surfactant.

Processes for preparing a medium 2/3-phenyl surfactant mixture include those comprising a step selected from: (i) blending said first alkylbenzene sulfonate surfactant and said second alkylbenzene sulfonate surfactant; and (ii) blending the nonsulfonated precursor of said first alkylbenzene sulfonate surfactant and the nonsulfonated precursor of said second alkylbenzene sulfonate surfactant and sulfonating said blend.

PREPARATIVE EXAMPLES

Example 1

Mixture of 4-methyl-4-nonanol, 5-methyl-5-decanol, 6-methyl-6-undecanol and 6-methyl-6-dodecanol

A Starting-material for Branched Olefins

A mixture of 4.65 g of 2-pentanone, 20.7 g of 2-hexanone, 51.0 g of 2-heptanone, 36.7 g of 2-octanone and 72.6 g of diethyl ether is added to an addition funnel. The ketone mixture is then added dropwise over a period of 2.25 hours to a nitrogen blanketed stirred three neck 2 L round bottom flask, fitted with a reflux condenser and containing 600 mL of 2.0 M n-pentylmagnesium bromide in diethyl ether and an additional 400 mL of diethyl ether. After the addition is complete the reaction mixture is stirred an additional 2.5 hours at 20° C. The reaction mixture is then added to 1 kg of cracked ice with stirring. To this mixture is added 393.3 g of 30% sulphuric acid solution. The aqueous acid layer is drained and the remaining ether layer is washed twice with 750 mL of water. The ether layer is then evaporated under vacuum to yield 176.1 g of a mixture of 4-methyl-4-nonanol, 5-methyl-5-decanol, 6-methyl-6-undecanol and 6-methyl-6-dodecanol.

Example 2

Substantially Mono Methyl Branched Olefin Mixture With Randomized Branching

A Branched Olefin Mixture which is an Alkylating Agent for Preparing Modified Alkylbenzenes in Accordance with the Invention a) A 174.9 g sample of the mono methyl branched alcohol mixture of Example 1 is added to a nitrogen blanketed stirred three neck round bottom 500 mL flask, fitted with a Dean Stark trap and a reflux condenser along with 35.8 g of a shape selective zeolite catalyst (acidic mordenite catalyst Zeocat™ FM-8/25H). With mixing, the mixture is then heated to about 110–155° C. and water and some olefin is collected over a period of 4–5 hours in the Dean Stark trap. The conversion of the alcohol mixture of example 1 to a substantially non-randomized methyl branched olefin mixture is now complete. The substantially non-randomized methyl branched olefin mixture remaining in the flask along with the substantially non-randomized methyl branched olefin mixture collected in the dean stark trap is recombined and filtered to remove catalyst. The solid filter cake is washed twice with 100 mL portions of hexane. The hexane filtrate is evaporated under vacuum and the resulting product is combined with the first filtrate to give 148.2 g of a substantially non-randomized methyl branched olefin mixture.

b) The olefin mixture of Example 2a is combined with 36 g of a shape selective zeolite catalyst (acidic mordenite catalyst Zeocat™ FM-8/25H) and reacted according to example 2a with the following changes. The reaction temperature is raised to 190–200° C. for a period of about 1–2 hours to randomize the specific branch positions in the olefin mixture. The substantially mono methyl branched olefin mixture with randomized branching remaining in the flask along with the substantially mono methyl branched olefin mixture with randomized branching collected in the dean stark trap are recombined and filtered to remove catalyst. The solid filter cake is washed twice with 100 mL portions of hexane. The hexane filtrate is evaporated under vacuum and the resulting product is combined with the first filtrate to give 147.5 g of a substantially mono methyl branched olefin mixture with randomized branching.

Example 3

Substantially Mono Methyl Branched Alkylbenzene Mixture With a 2/3-Phenyl Index of about 550 and a 2-Methyl-2-Phenyl Index of about 0.02

A Modified Alkylbenzene Mixture in Accordance with the Invention 147 g of the substantially mono methyl branched olefin mixture of example 2 and 36 g of a shape selective zeolite catalyst (acidic mordenite catalyst Zeocat™ FM-8/25H) are added to a 2 gallon stainless steel, stirred autoclave. Residual olefin and catalyst in the container are washed into the autoclave with 300 mL of n-hexane and the autoclave is sealed. From outside the autoclave cell, 2000 g of benzene (contained in a isolated vessel and added by way of an isolated pumping system inside the isolated autoclave cell) is added to the autoclave. The autoclave is purged twice with 250 psig $N_2$, and then charged to 60 psig $N_2$. The mixture is stirred and heated to about 200° C. for about 4–5 hours. The autoclave is cooled to about 20° C. overnight. The valve is opened leading from the autoclave to the benzene condenser and collection tank. The autoclave is heated to about 120° C. with continuous collection of benzene. No more benzene is collected by the time the reactor reaches 120° C. The reactor is then cooled to 40° C. and 750 g of n-hexane is pumped into the autoclave with mixing. The autoclave is then drained to remove the reaction mixture. The reaction mixture is filtered to remove catalyst and the n-hexane is removed under vacuum. The product is distilled under vacuum (1–5 mm of Hg). The substantially mono methyl branched alkylbenzene mixture with a 2/3-Phenyl index of about 550 and a 2-methyl-2-phenyl index of about 0.02 is collected from 76° C.–130° C. (167 g).

Example 4

Substantially Mono Methyl Branched Alkylbenzenesulfonic Acid Mixture with a 2/3-Phenyl Index of About 550 and a 2-Methyl-2-Phenyl Index of About 0.02

A Modified Alkylbenzene Sulfonic Acid Mixture in Accordance with the Invention The product of example 3 is sulfonated with a molar equivalent of chlorosulfonic acid using methylene chloride as solvent. The methylene chloride is removed to give 210 g of a substantially mono methyl branched alkylbenzene-sulfonic acid mixture with a 2/3-Phenyl index of about 550 and a 2-methyl-2-phenyl index of about 0.02

Example 5

Substantially Mono Methyl Branched Alkylbenzene sulfonate, Sodium Salt Mixture with a 2/3-Phenyl Index of About 550

A Modified Alkylbenzene Sulfonate Surfactant Mixture in Accordance with the Invention The product of example 4 is neutralized with a molar equivalent of sodium methoxide in methanol and the methanol is evaporated to give 225 g of a substantially mono methyl branched alkylbenzene sulfonate, sodium salt mixture with a 2/3-Phenyl index of about 550 and a 2-methyl-2-phenyl index of about 0.02.

Example 6

Substantially Linear Alkylbenzene Mixture With a 2/3-Phenyl Index of About 550 and a 2-Methyl-2-Phenyl Index of About 0.02

An Alkylbenzene Mixture to be Used as a Component of Modified Alkylbenzenes

A mixture of chain lengths of substantially linear alkylbenzenes with a 2/3-Phenyl index of about 550 and a 2-methyl-2-phenyl index of about 0.02 is prepared using a shape zeolite catalyst (acidic mordenite catalyst Zeocat™ FM-8/25H). A mixture of 15.1 g of Neodene (R)10, 136.6 g of Neodene(R) 1112, 89.5 g of Neodene(R)12 and 109.1 g of 1-tridecene is added to a 2 gallon stainless steel, stirred autoclave along with 70 g of a shape selective catalyst (acidic mordenite catalyst Zeocat™ FM-8/25H). Neodene is a trade name for olefins from Shell Chemical Company. Residual olefin and catalyst in the container are washed into the autoclave with 200 mL of n-hexane and the autoclave is sealed. From outside the autoclave cell, 2500 benzene (contained in a isolated vessel and added by way of an isolated pumping system inside the isolated autoclave cell) is added to the autoclave. The autoclave is purged twice with 250 psig $N_2$, and then charged to 60 psig $N_2$. The mixture is stirred and heated to about 200–205° C. for about 4–5 hours then cooled to 70–80° C. The valve is opened leading from the autoclave to the benzene condenser and collection tank. The autoclave is heated to about 120° C. with continuous collection of benzene in collection tank. No more benzene is collected by the time the reactor reaches 120° C. The reactor is then cooled to 40° C. and 1 kg of n-hexane is pumped into the autoclave with mixing. The autoclave is then drained to remove the reaction mixture. The reaction mixture is filtered to remove catalyst and the n-hexane is evaporated under low vacuum. The product is then distilled under high vacuum (1–5 mm of Hg). The substantially linear alkylbenzene mixture with a 2/3-Phenyl index of about 550 and a 2-methyl-2-phenyl index of about 0.02 is collected from 85° C.–150° C. (426.2 g).

Example 7

Substantially Linear Alkylbenzenesulfonic Acid Mixture With a 2/3-Phenyl Index of About 550 and a 2-Methyl-2-Phenyl Index of About 0.02

An Alkylbenzene Sulfonic Acid Mixture to be used as a Component of Modified Alkylbenzene Sulfonic Acid mixtures in Accordance with the Invention 422.45 g of the product of example 6 is sulfonated with a molar equivalent of chlorosulfonic acid using methylene chloride as solvent. The methylene chloride is removed to give 574 g of a substantially linear alkylbenzenesulfonic acid mixture with a 2/3-Phenyl index of about 550 and a 2-methyl-2-phenyl index of about 0.02.

Example 8

Substantially Linear Alkylbenzene Sulfonate, Sodium Salt Mixture With a 2/3-Phenyl Index of About 550 and a 2-Methyl-2-Phenyl Index of About 0.02.

An Alkylbenzene Sulfonate Surfactant Mixture to be used as a Component of Modified Alkylbenzene Sulfonate Surfactant Mixtures in Accordance with the Invention The substantially linear alkylbenzenesulfonic acid mixture of example 7 is neutralized with a molar equivalent of sodium methoxide in methanol and the methanol is evaporated to give 613 g of the substantially linear alkylbenzene sulfonate, sodium salt mixture with a 2/3-Phenyl index of about 550 and a 2-methyl-2-phenyl index of about 0.02.

Example 9

6,10-Dimethyl-2-undecanol

A Starting-material for Branched Olefins

To a glass autoclave liner is added 299 g of geranylacetone, 3.8 g of 5% rutheniumon carbon and 150 ml of methanol. The glass liner is sealed inside a 3 L, stainless steel, rocking autoclave and the autoclave purged once with 250 psig $N_2$, once with 250 psig $H_2$ and then charged with 1000 psig $H_2$. With mixing, the reaction mixture is heated. At about 75° C., the reaction initiates and begins consuming $H_2$ and exotherms to 170–180° C. In 10–15 minutes, the temperature has dropped to 100–110° C. and the pressure dropped to 500 psig. The autoclave is boosted to 1000 psig with $H_2$ and mixed at 100–11 0° C. for an additional 1 hour and 40 minutes with the reaction consuming an additional 160 psig $H_2$ but at which time no more $H_2$ consumption is observed. Upon cooling the autoclave to 40° C., the reaction mixture removed, filtered to remove catalyst and concentrated by evaporation of methanol under vacuum to yield 297.75 g of 6,10-dimethyl-2-undecanol.

Example 10

5,7-Dimethyl-2-decanol

A Starting-material for Branched Olefins

To a glass autoclave liner is added 249 g of 5,7-dimethyl-3,5,9-decatrien-2-one, 2.2 g of 5% rutheniumon carbon and 200 ml of methanol. The glass liner is sealed inside a 3 L, stainless steel, rocking autoclave and the autoclave purged once with 250 psig $N_2$, once with 250 psig $H_2$ and then charged with 500 psig H2. With mixing, the reaction mixture is heated. At about 75° C., the reaction initiates and begins consuming $H_2$ and exotherms to 170° C. In 10 minutes, the temperature has dropped to 115–120° C. and the pressure dropped to 270 psig. The autoclave is boosted to 1000 psig with $H_2$, mixed at 110–115° C. for an additional 7 hours and 15 minutes then cooled to 30° C. The reaction mixture is removed from autoclave, filtered to remove catalyst and concentrated by evaporation of methanol under vacuum to yield 225.8 g of 5,7-dimethyl-2-decanol.

Example 11

4,8-Dimethyl-2-nonanol

A Starting-material for Branched Olefins

A mixture of 671.2 g of citral and 185.6 g of diethyl ether is added to an addition funnel. The citral mixture is then added dropwise over a five hour period to a nitrogen blanketed, stirred, 5 L, 3-neck, round bottom flask equipped with a reflux condenser containing 1.6 L of 3.0 M methylmagnesium bromide solution and an additional 740 ml of diethyl ether. The reaction flask is situated in an ice water bath to control exotherm and subsequent ether reflux. After addition is complete, the ice water bath is removed and the reaction allowed to mix for an additional 2 hours at 20–25° C. at which point the reaction mixture is added to 3.5 Kg of cracked ice with good mixing. To this mixture is added 1570 g of 30% sulfuric acid solution. The aqueous acid layer is drained and the remaining ether layer washed twice with 2 L of water. The ether layer is concentrated by evaporation of the ether under vacuum to yield 720.6 g of 4,8-dimethyl-3,7-nonadien-2-ol. To a glass autoclave liner is added 249.8 g of the 4,8-dimethyl-3,7-nonadien-2-ol, 5.8 g of 5% palladium on activated carbon and 200 ml of n-hexane. The glass liner is sealed inside a 3 L, stainless steel, rocking autoclave and the autoclave purged twice with 250 psig $N_2$, once with 250 psig $H_2$ and then charged with 100 psig $H_2$. Upon mixing, the reaction initiates and begins consuming $H_2$ and exotherms to 75° C. The autoclave is heated to 80° C., boosted to 500 psig with $H_2$, mixed for 3 hours and then cooled to 30° C. The reaction mixture is removed from autoclave, filtered to remove catalyst and concentrated by evaporation of n-hexane under vacuum to yield 242 g of 4,8-dimethyl-2-nonanol.

Example 12

Substantially Dimethyl Branched Olefin Mixture With Randomized Branching

A Branched Olefin Mixture which is an Alkylating Agent for Preparing Modified Alkylbenzenes in Accordance with the Invention To a nitrogen blanketed, 2 L, 3-neck round bottom flask equipped with thermometer, mechanical stirrer and a Dean-Stark trap with reflux condenser is added 225 g of 4,8-dimethyl-2-nonanol (example 11), 450 g of 5,7-dimethyl-2-decanol (example 10), 225 g of 6,10-dimethyl-2-undecanol (example 9) and 180 g of a shape selective zeolite catalyst (acidic mordenite catalyst Zeocat™ FM-8/25H). With mixing, the mixture is heated (135–160° C.) to the point water and some olefin is driven off and collected in Dean-Stark trap at a moderate rate. After a few hours, the rate of water collection slows and the temperature rises to 180–195° C. where the reaction is allowed to mix for an additional 2–4 hours.

The dimethyl branched olefin mixture remaining in the flask along with the dimethyl branched olefin mixture that distilled over are recombined and filtered to remove the catalyst. The catalyst filter cake is slurried with 500 ml of hexane and vacuum filtered. The catalyst filter cake is washed twice with 100 ml of hexane and the filtrate concentrated by evaporation of the hexane under vacuum. The resulting product is combined with the first filtrate to give 820 g of dimethyl branched olefin mixture with randomized branching.

Example 13

Substantially Dimethyl Branched Alkylbenzene Mixture with Randomized Branching and 2/3-Phenyl Index of About 600 and 2-Methyl-2-Phenyl Index of About 0.04

A Modified Alkylbenzene Mixture in Accordance with the Invention 820 g of the dimethyl branched olefin mixture of example 12 and 160 g of a shape selective zeolite catalyst (acidic mordenite catalyst Zeocat™ FM-8/25H) is added to a 2 gallon stainless steel, stirred autoclave and the autoclave is sealed. The autoclave is purged twice with 80 psig $N_2$ and then charged to 60 psig $N_2$. From outside the autoclave cell, 3000 g of benzene (contained in a isolated vessel and added by way of an isolated pumping system inside the isolated autoclave cell) is added to the autoclave. The mixture is stirred and heated to 205° C. to about 210° C. The reaction is continued for about 10 minutes at which time the product mixture is sampled. The 10 minute sample is filtered to remove catalyst and vacuum pulled on the mixture to remove any residual traces of benzene. The sample is distilled under vacuum (1–5 mm of Hg). The dimethyl branched alkylbenzene mixture with randomized branching and 2/3-Phenyl index of about 600 and a 2-methyl-2-phenyl index of about 0.26 is collected from 90° C.–140° C. The reaction is continued at 205° C. to about 210° C. for about 8 hours. The autoclave is cooled to about 30° C. overnight. The valve is opened leading from the autoclave to the benzene condenser and collection tank. The autoclave is heated to about 120° C. with continuous collection of benzene. No more benzene is collected by the time the reactor reaches 120° C. and the reactor is then cooled to 40° C. The autoclave is then drained to remove the reaction mixture. The reaction mixture is filtered to remove catalyst and vacuum pulled on the mixture to remove any residual traces of benzene. The product is distilled under vacuum (1–5 mm of Hg). The dimethyl branched alkylbenzene mixture with randomized branching and 2/3-Phenyl index of about 600 and a 2-methyl-2-phenyl index of about 0.04 is collected from 90° C.–140° C.

Example 14

Substantially Dimethyl Branched Alkylbenzenesulfonic Acid Mixture With Randomized Branching and a 2/3-Phenyl Index of about 600 and a 2-Methyl-2-Phenyl Index of About 0.04

A Modified Alkylbenzene Sulfonic Acid Mixture in Accordance with the Invention

The dimethyl branched alkylbenzene product of example 13 is sulfonated with a molar equivalent of chlorosulfonic acid using methylene chloride as solvent with HCl evolved as a side product. The resulting sulfonic acid product is concentrated by evaporation of methylene chloride under vacuum. The substantially dimethyl branched alkylbenzenesulfonic acid mixture has a 2/3 Phenyl Index of about 2/3-Phenyl index of about 600 and a 2-methyl-2-phenyl index of about 0.04.

Example 15

Substantially Dimethyl Branched Alkylbenzenesulfonic Acid, Sodium Salt Mixture with Randomized Branching and 2/3-Phenyl Index of about 600 and a 2-Methyl-2-Phenyl Index of About 0.04

A Modified Alkylbenzene Sulfonate Surfactant Mixture in Accordance with the Invention The dimethyl branched alkylbenzenesulfonic acid mixture of example 14 is neutralized with a molar equivalent of sodium methoxide in methanol and the methanol is evaporated to give solid dimethyl branched alkylbenzene sulfonate, sodium salt mixture with randomized branching and a 2/3-Phenyl index of about 600 and a 2-methyl-2-phenyl index of about 0.04.

Example 16

Modified Alkylbenzene Sulfonate Surfactant Mixtures According to the Invention

Medium 2/3-phenyl Type

Blends are prepared of:

I) Modified alkylbenzene sulfonate surfactant mixture in accordance with the invention having a 2/3-Phenyl index of about 550 (according to Example 5)

II) Commercial $C_{11.7}$ (average) linear alkylbenzene sulfonate surfactant (HF type) sodium salt having a 2/3-Phenyl index of about 100

In the table below, percentages are by weight:

| | A | B | C |
|---|---|---|---|
| I | 25% | 15% | 38% |
| II | 75% | 85% | 62% |

Each of the above blends has a 2/3-phenyl index in the range from about 160 to about 275.

Example 17

Modified Alkylbenzene Sulfonate Surfactant Mixtures According to the Invention

Medium 2/3-phenyl Type

Blends are prepared of:

I) Modified alkylbenzene sulfonate surfactant mixture in accordance with the invention having a 2/3-Phenyl index of about 550 (according to Example 5)

II) Commercial $C_{11.7}$ (average) linear alkylbenzene sulfonate surfactant (DETAL® type) sodium salt having a 2/3-Phenyl index of about 150

In the table below, percentages are by weight:

| | A | B | C |
|---|---|---|---|
| I | 25% | 15% | 10% |
| II | 75% | 85% | 90% |

Each of the above blends has a 2/3-phenyl index in the range from about 160 to about 275.

Example 18

Modified Alkylbenzene Sulfonic Acid Mixtures According to the Invention

Medium 2/3-phenyl Type

Blends are prepared of:

I) Modified alkylbenzene sulfonic acid surfactant mixture in accordance with the invention having a 2/3-Phenyl index of about 550 (according to Example 4)

II) Commercial $C_{11.7}$ (average) linear alkylbenzene sulfonic acid (HF type) having a 2/3-Phenyl index of about 100.

In the table below, percentages are by weight:

| | A | B | C |
|---|---|---|---|
| I | 25% | 15% | 38% |
| II | 75% | 85% | 62% |

Each of the above blends has a 2/3-phenyl index in the range from about 160 to about 275.

Example 19

Modified Alkylbenzene Sulfonic Acid Mixtures According to the Invention

Medium 2/3-phenyl Type

Blends are prepared of:

I) Modified alkylbenzene sulfonic acid mixture in accordance with the invention having a 2/3-Phenyl index of about 550 (according to Example 4)

II) Commercial $C_{11.7}$ (average) linear alkylbenzene sulfonic acid (DETAL® type) having a 2/3-Phenyl index of about 150.

In the table below, percentages are by weight:

| | A | B | C |
|---|---|---|---|
| I | 25% | 15% | 10% |
| II | 75% | 85% | 90% |

Each of the above blends has a 2/3-phenyl index in the range from about 160 to about 275.

Example 20

Modified Alkylbenzene Mixtures According to the Invention

Medium 2/3-phenyl Type

Blends are prepared of:

I) Modified alkylbenzene mixture in accordance with the invention having a 2/3-Phenyl index of about 550 (according to Example 3)

II) Commercial $C_{11.7}$ (average) linear alkylbenzene (HF type) having a 2/3-Phenyl index of about 100.

In the table below, percentages are by weight:

| | A | B | C |
|---|---|---|---|
| I | 25% | 15% | 38% |
| II | 75% | 85% | 62% |

Each of the above blends has a 2/3-phenyl index in the range from about 160 to about 275.

Example 21

Modified Alkylbenzene Mixtures According to the Invention

Medium 2/3-phenyl Type

Blends are prepared of:

I) Modified alkylbenzene mixture in accordance with the invention having a 2/3-Phenyl index of about 550 (according to Example 3)

II) Commercial $C_{11.7}$ (average) linear alkylbenzene (DETAL® type) having a 2/3-Phenyl index of about 150.

In the table below, percentages are by weight:

| | A | B | C |
|---|---|---|---|
| I | 25% | 15% | 10% |
| II | 75% | 85% | 90% |

Each of the above blends has a 2/3-phenyl index in the range from about 160 to about 275.

Example 22

Modified Alkylbenzene Mixture According to the Invention with a 2/3-Phenyl Index of About 550 and a 2-Methyl-2-Phenyl Index of About 0.02

110.25 g of the substantially mono methyl branched olefin mixture of example 2, 36.75 g a nonbranched olefin mixture (decene:undecene:dodecene:tridecene ratio of 2:9:20:18) and 36 g of a shape selective zeolite catalyst (acidic mordenite catalyst Zeocat™ FM-8/25H) are added to a 2 gallon stainless steel, stirred autoclave. Residual olefin and catalyst in the container are washed into the autoclave with 300 mL of n-hexane and the autoclave is sealed. From outside the autoclave cell, 2000 g of benzene (contained in a isolated vessel and added by way of an isolated pumping system inside the isolated autoclave cell) is added to the autoclave. The autoclave is purged twice with 250 psig $N_2$, and then charged to 60 psig $N_2$. The mixture is stirred and heated to about 200° C. for about 4–5 hours. The autoclave is cooled to about 20° C. overnight. The valve is opened leading from the autoclave to the benzene condenser and collection tank. The autoclave is heated to about 120° C. with continuous collection of benzene. No more benzene is collected by the time the reactor reaches 120° C. The reactor is then cooled to 40° C. and 750 g of n-hexane is pumped into the autoclave with mixing. The autoclave is then drained to remove the reaction mixture. The reaction mixture is filtered to remove catalyst and the n-hexane is removed under vacuum. The product is distilled under vacuum (1–5 mm of Hg). A modified alkylbenzene mixture with a 2/3-Phenyl index of about 550 and a 2-methyl-2-phenyl index of about 0.02 is collected from 76° C.–130° C. (167 g).

Example 23

Modified Alkylbenzenesulfonic Acid Mixture According to the Invention

Branched and Nonbranched Alkylbenzenesulfonic Acid Mixture

With a 2/3-Phenyl Index of About 550 and a 2-Methyl-2-Phenyl Index of About 0.02

The modified alkylbenzene mixture of example 22 is sulfonated with a molar equivalent of chlorosulfonic acid using methylene chloride as solvent. The methylene chloride is removed to give 210 g of a modified alkylbenzenesulfonic acid mixture with a 2/3-Phenyl index of about 550 and a 2-methyl-2-phenyl index of about 0.02.

Example 24

Modified Alkylbenzenesulfonate, Sodium Salt Mixture According to the Invention

Branched and Nonbranched Alkylbenzenesulfonate, Sodium Salt Mixture

With a 2/3-Phenyl Index of About 550 and a 2-Methyl-2-Phenyl Index of About 0.02

The modified alkylbenzenesulfonic acid of example 23 is neutralized with a molar equivalent of sodium methoxide in methanol and the methanol is evaporated to give 225 g of a modified alkylbenzenesulfonate, sodium salt mixture with a 2/3-Phenyl index of about 550 and a 2-methyl-2-phenyl index of about 0.02.

Methods for Determining Compositional Parameters (2/3-phenyl Index 2-methyl-2-phenyl Index) of Mixed Alkylbenzene/Alkylbenzenesulfonate/Alkylbenzenesulfonic Acid Systems It is well known in the art to determine compositional parameters of conventional linear alkylbenzenes and/or highly branched alkylbenzenesulfonates (TPBS, ABS). See, for example Surfactant Science Series, Volume 40, Chapter 7 and Surfactant Science Series, Volume 73, Chapter 7. Typically this is done by GC and/or GC-mass spectroscopy for the alkylbenzenes and HPLC for the alkylbenzenesulfonates or sulfonic acids; $^{13}C$ nmr is also commonly used. Another common practice is desulfonation. This permits GC and/or GC-mass spectroscopy to be used, since desulfonation converts the sulfonates or sulfonic acids to the alkylbenzenes which are tractable by such methods.

In general, the present invention provides unique and relatively complex mixtures of alkylbenzenes, and similarly complex surfactant mixtures of alkylbenzenesulfonates and/or alkylbenzenesulfonic acids. Compositional parameters of such compositions can be determined using variations and combinations of the art-known methods.

The sequence of methods to be used depends on the composition to be characterized as follows:

| Composition to be characterized | Sequence of Methods (Methods separated by commas are run in sequence, others can be run in parallel) |
|---|---|
| Alkylbenzene mixtures | GC, NMR1 NMR 2 |
| Alkylbenzene mixtures with impurities* | GC, DIS, GC, NMR1 NMR 2 |
| Alkylbenzene-sulfonic acid mixtures | Option 1: HPLC, NMR3 NMR 4<br>Option 2: HPLC, DE, NMR1 NMR 2 |
| Alkylbenzene-sulfonate salt mixtures | Option 1: HPLC, AC, NMR3 NMR 4<br>Option 2: HPLC, DE, NMR1 NMR 2 |
| Alkylbenzene-sulfonic acid mixtures with impurities* | Option 1: HPLC, HPLC-P, HPLC, NMR3 NMR 4<br>Option 2: HPLC, DE, DIS, GC, NMR1 NMR 2 |
| Alkylbenzene-sulfonate salt mixtures with impurities* | Option 1: HPLC, HPLC-P, HPLC, AC, NMR3 NMR 4<br>Option 2: HPLC, DE, DIS, GC, NMR1 NMR 2 |

*Typically preferred when the material contains more than about 10% impurities such as dialkylbenzenes, olefins, paraffins, hydrotropes, dialkylbenzenesulfonates, etc.

GC

Equipment

Hewlett Packard Gas Chromatograph HP5890 Series II equipped with a split/splitless injector and FID J&W Scientific capillary column DB-1HT, 30 meter, 0.25 mm id, 0.1 um film thickness cat# 1221131

Restek Red lite Septa 11 mm cat# 22306

Restek 4 mm Gooseneck inlet sleeve with a carbofrit cat# 20799-209.5

O-ring for inlet liner Hewlett Packard cat# 5180-4182

J. T. Baker HPLC grade Methylene Chloride cat# 9315-33, or equivalent 2 ml GC autosampler vials with crimp tops, or equivalent Sample Preparation Weigh 4–5 mg of sample into a 2 ml GC autosampler vial Add 1 ml J. T. Baker HPLC grade Methylene Chloride, cat# 9315-33 to the GC vial, seal with 11 mm crimp vial teflon lined closures (caps), part # HP5181-1210 using crimper tool, part # HP8710-0979 and mix well The sample is now ready for injection into the GC GC Parameters Carrier Gas: Hydrogen Column Head Pressure: 9 psi Flows:

Column Flow @ 1 ml/min.

Split Vent @ ~3ml/min.

Septum Purge @ 1 ml/min.

Injection: HP 7673 Autosampler, 10 ul syringe, 1 ul injection

Injector Temperature: 350° C.

Detector Temperature: 400° C.

Oven Temperature Program:

initial 70° C. hold 1 min.

rate 1° C./min.

final 180° C. hold 10 min.

Standards required for this method are 2-phenyloctane and 2-phenylpentadecane, each freshly distilled to a purity of greater than 98%. Run both standards using the conditions specified above to define the retention time for each standard. This defines a rentention time range which is the retention time range to be used for characterizing any alkylbenzenes or alkylbenzene mixtures in the context of this invention (e.g., test samples). Now run the test samples for which compositional parameters are to be determined. Test samples pass the GC test provided that greater than 90% of the total GC area percent is within the retention time range defined by the two standards Test samples that pass the GC test can be used directly in the NMR1 and NMR2 test methods. Test samples that do not pass the GC test must be further purified by distillation until the test sample passes the GC test.

Desulfonation (DE)

The desulfonation method is a standard method described in "The Analysis of Detergents and Detergent Products" by G. F. Longman on pages 197–199. Two other useful descriptions of this standard method are given on page 230–231 of volume 40 of the Surfactant Sience Series edited by T. M. Schmitt: "Analysis of Surfactants" and on page 272 of volume 73 of the Surfactant Science Series: "Anionic Surfactants" edited by John Cross. This is an alternative method to the HPLC method, described herein, for evaluation of the branched and nonbranched alkylbenzenesulfonic acid and/or salt mixtures (Modified Alkylbenzensulfonic acid and or salt Mixtures). The method provides a means of converting the sulfonic acid and/or salt mixture into branched and nonbranched alkylbenzene mixtures which can then be analyzed by means of the GC and NMR methods NMR1 and NMR2 described herein.

HPLC See L. R. Snyder and J. J. Kirkland, "Introduction to Modem Liquid Chromatography", 2nd. Ed., Wiley, N.Y., 1979.

Apparatus

| | |
|---|---|
| Suitable HPLC System | Waters Division of Millipore or equivalent. |
| HPLC pump with He sparge and temperature Control | Waters, model 600 or equivalent |
| Autosampler/injector | Waters 717, or equivalent |
| Autosampler 48 position tray | Waters or equivalent |
| UV detector | Waters PDA 996 or equivalent |
| Fluorescence detector | Waters 740 or equivalent |
| Data System/Integrator | Waters 860 or equivalent |

-continued

| | |
|---|---|
| Autosampler vials and caps | 4 mL capacity, Millipore #78514 and #78515. |
| HPLC Column, X2 | Supelcosil LC18, 5 μm, 4.6 mm × 25 cm, Supelcosil #58298 |
| Column Inlet Filter | Rheodyne 0.5 μm × 3 mm Rheodyne #7335 |
| LC eluent membrane filters | Millipore SJHV M47 10, disposable filter funnel with 0.45 μm membrane. |
| Balance | Sartorius or equivalent; precision ± 0.0001 g. |
| Vacuum | Sample Clarification Kit with pumps and filters, Waters #WAT085113. |
| Reagents | |
| C8 LAS standard material | Sodium-p-2-octylbenzene sulfonate. |
| C15 LAS standard material | Sodium-p-2-pentadecylbenzene sulfonate. |

Procedure

A. Preparation of HPLC Mobile Phase

1. Mobile phase A
   a) Weigh 11.690 g sodium chloride and transfer to a 2000 mL volumetric flask. Dissolve in 200 mL HPLC grade water.
   b) Add 800 mL of acetonitrile and mix. Dilute to volume after solution comes to room temperature. This prepares a solution of 100 mM NaCl/40% ACN.
   c) Filter through an LC eluent membrane filter and degas prior to use.
2. Mobile phase B—Prepare 2000 mL of 60% acetonitrile in HPLC grade water. Filter through an LC eluent membrane filter and degas prior to use.

B. C8 and C15 Internal Standard Solution

1. Weigh 0.050 g of a 2-phenyloctylbenzenesulfonate and 0.050 g of 2-Phenylpentadecanesulfonate standards and quantitatively transfer to a 100 mL volumetric flask.
2. Dissolve with 30 mL ACN and dilute to volume with HPLC grade water. This prepares ca. 1500 ppm solution of the mixed standard.

C. Sample Solutions

1. Wash Solutions—Transfer 250 μL of the standard solution to a 1 mL autosampler vial and add 750 μL of the wash solution. Cap and place in the autosampler tray.
2. Alkylbenzenesulfonic acid or Alkylbenzenesulfonate—Weigh 0.10 g of the alkylbenzenesulfonic acid or salt and quantitatively transfer to a 100 mL volumetric flask. Dissolve with 30 mL ACN and dilute to volume with HPLC grade water. Transfer 250 μL of the standard solution to a 1 mL autosampler vial and add 750 μL of the sample solution. Cap and place in the autosampler tray. If solution is excessively turbid, filter through 0.45 μm membrane before transferring to autosampler vial. Cap and place in the auto-sampler tray.

D. HPLC System

1. Prime HPLC pump with mobile phase. Install column and column inlet filter and equilibrate with eluent (0.3 mL/min for at least 1 hr.).
2. Run samples using the following HPLC conditions:

| | | |
|---|---|---|
| Mobile phase A | 100 mM NaCl/40% ACN | |
| Mobile phase B | 40% $H_2O$/60% ACN | |
| time 0 min. | 100% Mobile phase A | 0% Mobile Phase B |
| time 75 min. | 5% Mobile phase A | 95% Mobile Phase B |

-continued

| | | |
|---|---|---|
| time 98 min. | 5% Mobile phase A | 95% Mobile Phase B |
| time 110 min. | 100% Mobile phase A | 0% Mobile Phase B |
| time 120 min. | 100% Mobile phase A | 0% Mobile Phase B |

Note: A gradient delay time of 5–10 minutes may be needed depending on dead volume of HPLC system.

| | |
|---|---|
| Flow rate | 1.2 mL/min. |
| Temperature | 25° C. |
| He sparge rate | 50 mL/hr. |
| UV detector | 225 nm |
| Fluorescence detector | λ = 225 mn, λ = 295 nm with sensitivity at 10 x. |
| Run time | 120 min. |
| Injection volume | 10 μL |
| Replicate injections | 2 |
| Data rate | 0.45 MB/Hr. |
| Resolution | 4.8 nm |

3. The column should be washed with 100% water followed by 100% acetonitrile and stored in 80/20 ACN/water.

The HPLC elution time of the 2-phenyloctylbenzenesulfonate defines the lower limit and the elution time of the 2-phenylpentadecanesulfonate standard defines the upper limit of the HPLC analysis relating to the alkylbenzenesulfonic acid/salt mixture of the invention. If 90% of the alkylbenzenesulfonic acid/salt mixture components have retention times within the range of the above standards then the sample can be further defined by methods NMR 3 and NMR 4.

If the alkylbenzenesulfonic acid/salt mixture contains 10% or more of components outside the retention limits defined by the standards then the mixture should be further purified by method HPLC-P or by DE, DIS methods.

HPLC Preparative (HPLC-P)

Alkylbenzenesulfonic acids and/or the salts which contain substantial impurities (10% or greater) are purified by preparative HPLC. See L. R. Snyder and J. J. Kirkland, "Introduction to Modern Liquid Chromatography", 2nd. Ed., Wiley, NY, 1979. This is routine to one skilled in the art. A sufficient quantity should be purified to meet the requirements of the NMR 3 and NMR 4.

Preparative LC Method Using Mesa Bond Elut Sep Pak® (HPLC-P)

Alkylbenzenesulfonic acids and/or the salts which contain substantial impurities (10% or greater) can also be purified by an LC method (also defined herein as HPLC-P).

This procedure is actually preferred over HPLC column prep purification. As much as 500 mg of unpurified MLAS salts can be loaded onto a 10 g(60 ml) Mega Bond Elut Sep Pak® and with optimized chromatography the purified MLAS salt can be isolated and ready for freeze drying within 2 hours. A 100 mg sample of Modified alkylbenzenesulfonate salt can be loaded onto a 5 g(20 ml) Bond Elut Sep Pak and ready within the same amount of time.

A. Instrumentation

HPLC: Waters Model 600E gradient pump, Model 717 Autosampler, Water's Millennium PDA, Millenium Data Manager (v. 2.15)

Mega Bond Elut: C18 bonded phase, Varian 5 g or 10 g, PN: 1225-6023, 1225-6031 with adaptors HPLC Columns: Supelcosil LC-18 (X2), 250×4.6 mm, 5 mm; #58298 Analytical Balance: Mettler Model AE240, capable of weighing samples to ±0.01 mg B. Accessories Volumetrics: glass, 10 mL Graduated Cylinder: 1 L HPLC Autosampler Vials: 4 mL glass vials with Teflon caps and glass low volume inserts and pipette capable of accurately delivering 1, 2, and 5 mL volumes C. Reagents and Chemicals Water (DI-$H_2O$): Distilled, deionized water from a Millipore, Milli-Q system or equivalent Acetonitrile ($CH_3CN$): HPLC grade from Baker or equivalent Sodium Chloride Crystal Baker Analyzed or equivalent D. HPLC Conditions Aqueous Phase Preparation:

A: To 600 mL of DI-$H_2O$ contained in a 1 L graduated cylinder, add 5.845 of sodium chloride. Mix well and add 400 ml ACN. Mix well.

B: To 400 ml of DI-$H_2O$ contained in a 1 L graduated cylinder, add 600 ml ACN and mix well.

Reservoir A: 60/40, $H_2O$/CAN with salt and Reservoir B: 40/60, $H_2O$/ACN

Run Conditions: Gradient: 100% A for 75 min. 5%A/95% B for 98 min. 5%A/95% B for 110 min. 100% A for 125 min.

| | |
|---|---|
| Column Temperature | Not Thermostatted (i.e., room temp.) |
| HPLC Flow Rate | 1.2 mL/min |
| Injection Volume | 10 mL |
| Run Time | 125 minutes |
| UV Detection | 225 nm |
| Conc. | >4 mg/ml |

Sep Pak Equilibration (Bond Elut, 5 G)

1. Pass 10 ml of a solution containing 25/75 $H_2O$/ACN onto the sep pak by applying positive pressure with a 10 cc syringe at a rate of ~40 drops/min. Do not allow the sep pak to go dry.
2. Immediately pass 10 ml (×3) of a solution containing 70/30 $H_2O$/ACN in the same manner as #1. Do not allow the sep pak to go dry. Maintain a level of solution (~1 mm) at the head of the sep pak.
3. The sep pak is now ready for sample loading.

MLAS Sample Loading/ Separation and Isolation

4. Weigh <200 mg of sample into a 1 dram vial and add 2 ml of 70/30 $H_2O$/ACN. Sonicate and mix well.
5. Load sample onto Bond Elut and with positive pressure from a 10 cc syringe begin separation. Rinse vial with 1 ml (×2) portions of the 70/30 solution and load onto sep pak. Maintain ~1 mm of solution at the head of the sep pak.
6. Pass 10 ml of 70/30 onto the Bond Elut with positive pressure from a 10 cc syringe at a rate of ~40 drops/min.
7. 4. Repeat this with 3 ml and 4 ml and collect effluent if interested in impurities.

MLAS Isolation and Collection

1. Pass 10 ml of solution containing 25/75 $H_2O$/ACN with positive pressure from a 10 cc syringe and collect effluent. Repeat this with another 10 ml and again with 5 ml. The isolated MLAS is now ready for freeze drying and subsequent characterization.
2. Rotovap until ACN is removed and freeze dry the remaining $H_2O$. Sample is now ready for chromatography.

Note: When incorporating the Mega Bond Elut Sep Pak (10 g version) up to 500 mg of sample can be loaded onto the sep pak and with solution volume adjustments, the effluent can be ready for freeze drying within 2 hours.

Sep Pak Equilibration (Bond Elut, 10 G)

1. Pass 20 ml of a solution containing 25/75 $H_2O$/ACN onto the sep pak using laboratory air or regulated cylinder air at a rate which will allow ~40 drops/min. You can not use positive pressure from a syringe because it is not sufficient to move the solution thru the sep pak. Do not allow the sep pak to go dry.
2. Immediately pass 20 ml (×2) and an additional 10 ml of a solution containing 70/30 $H_2O$/ACN in the same manner as #1. Do not allow the sep pak to go dry. Maintain a level of solution (~1 mm) at the head of the sep pak.
3. The sep pak is now ready for sample loading.

MLAS Sample Loading/Separation and Isolation

1. Weigh <500 mg of sample into a 2 dram vial and add 5 ml of 70/30 $H_2O$/ACN. Sonicate and mix well.
2. Load sample onto Bond Elut and with positive pressure from an air source begin separation. Rinse vial with 2 ml (×2) portions of the 70/30 solution and put onto the sep pak. Maintain ~1 mm of solution at the head of the sep pak.
3. Pass 20 ml of 70/30 onto the Bond Elut with positive pressure from an air source at a rate of ~40 drops/min. Repeat this with 6 ml and 8 ml and collect effluent if interested in impurities.

MLAS Isolation and Collection

1. Pass 20 ml of solution containing 25/75 $H_2O$/ACN with positive pressure from an air source and collect effluent.
2. Repeat this with another 20 ml and again with 10 ml. This isolated fraction contains the pure MLAS.
3. The isolated MLAS is now ready for freeze drying and subsequent characterization.
4. Rotovap until ACN is removed and freeze dry the remaining $H_2O$. Sample is now ready for chromatography.

Note: Adjustments in organic modifier concentration may be necessary for optimum separation and isolation.

Distillation (DIS)

A 5 liter, 3-necked round bottom flask with 24/40 joints is equipped with a magnetic stir bar. A few boiling chips (Hengar Granules, catalog #136-C) are added to the flask. A 91/2 inch long vigreux condenser with a 24/40 joint is placed in the center neck of the flask. A water cooled condenser is attached to the top of the vigreux condenser which is fitted with a calibrated thermometer. A vacuum receiving flask is attached to the end of the condenser. A glass stopper is placed in one side arm of the 5 liter flask and a calibrated thermometer in the other. The flask and the vigreux condenser are wrapped with aluminum foil. To the 5 liter flask, is added 2270 g of an alkylbenzene mixture which contains 10% or more impurities as defined by the GC method. A vacuum line leading from a vacuum pump is attached to the receiving flask. The alkylbenzene mixture in the 5 liter flask is stirred and vacuum is applied to the system. Once the maximum vacuum is reached (at least 1 inch of Hg pressure by gauge or less), the alkylbenzene mixture is heated by means of an electric heating mantle. The distillate is collected in two fractions. Fraction A is collected from about 25° C. to about 90° C. as measured by the calibrated thermometer at the top of the vigreux column. Fraction B is collected from about 90° C. to about 155° C. as measured by the calibrated thermometer at the top of the vigreux column. Fraction A and pot residues (high boiling) are discarded. Fraction B (1881 g) contains the alkylbenzene mixture of interest. The method can be scaled according to the practitioner's needs provided that sufficient quantity of the alkylbenzene mixture remains after distillation for evaluation by NMR methods NMR1 and NMR2.

Acidification (AC)

Salts of alkylbenzenesulfonic acids are acidified by common means such as reaction in a solvent with HCl or sulfuric acid or by use of an acidic resin such as Amberlyst 15. Acificication is routine to one skilled in the art. After acidifying remove all solvents, especially any moisture, so that the samples are anhydrous and solvent-free.

Note: For all of the below NMR test methods, the chemical shifts of the NMR spectrum are externally referenced to $CDCl_3$, i.e. chloroform.

NMR 1

$^{13}$C-NMR 2/3-Phenyl Index for Alkylbenzene Mixtures

A 400 mg sample of an alkylbenzene mixture is dissolved in 1 ml of anhydrous deuterated chloroform containing 1% v/v TMS as reference and placed in a standard NMR tube. The $^{13}$C NMR is run on the sample on a 300 MHz NMR spectrometer using a 20 second recycle time, a 40° $^{13}$C pulse width and gated heteronuclear decoupling. At least 2000 scans are recorded. The region of the $^{13}$C NMR spectrum between about 145.00 ppm to about 150.00 ppm is integrated. The 2/3-Phenyl index of an alkylbenzene mixture is defined by the following equation:

2/3-Phenyl Index=(Integral from about 147.65 ppm to about 148.05 ppm)/(Integral from about 145.70 ppm to about 146.15 ppm)×100

NMR 2

$^{13}$C-NMR 2-Methyl-2-Phenyl Index

A 400 mg sample of an anhydrous alkylbenzene mixture is dissolved in 1 ml of anhydrous deuterated chloroform containing 1% v/v TMS as reference and placed in a standard NMR tube. The $^{13}$C NMR is run on the sample on a 300 MHz NMR spectrometer using a 20 second recycle time, a 40° $^{13}$C pulse width and gated heteronuclear decoupling. At least 2000 scans are recorded. The $^{13}$C NMR spectrum region between about 145.00 ppm to about 150.00 ppm is integrated. The 2-methyl-2-phenyl index of an alkylbenzene mixture is defined by the following equation:

2-methyl-2-phenyl index=(Integral from about 149.35 ppm to about 149.80 ppm)/(Integral from about 145.00 ppm to about 150.00 ppm).

NMR 3

$^{13}$C-NMR 2/3-Phenyl Index for Alkylbenzenesulfonic Acid Mixtures

A 400 mg sample of an anhydrous alkylbenzenesulfonic acid mixture is dissolved in 1 ml of anhydrous deuterated chloroform containing 1% v/v TMS as reference and placed in a standard NMR tube. The $^{13}$C NMR is run on the sample on a 300 MHz NMR spectrometer using a 20 second recycle time, a 40° $^{13}$C pulse width and gated heteronuclear decoupling. At least 2000 scans are recorded. The $^{13}$C NMR spectrum region between about 152.50 ppm to about 156.90 ppm is integrated. The 2/3-Phenyl Index of an alkylbenzenesulfonic acid mixtureis defined by the following equation:

2/3-Phenyl Index=(Integral from about 154.40 to about 154.80 ppm)/(Integral from about 152.70 ppm to about 153.15 ppm)×100

NMR 4

$^{13}$C-NMR 2-Methyl-2-Phenyl Index for Alkylbenzenesulfonic Acid Mixtures

A 400 mg sample of an anhydrous alkylbenzenesulfonic acid mixture is dissolved in 1 ml of anhydrous deuterated chloroform containing 1% v/v TMS as reference and placed in a standard NMR tube. The $^{13}$C NMR is run on the sample on a 300 MHz NMR spectrometer using a 20 second recycle time, a 40° $^{13}$C pulse width and gated heteronuclear decoupling. At least 2000 scans are recorded. The $^{13}$C NMR spectrum region between about 152.50 ppm to about 156.90 ppm is integrated. The 2-methyl-2-phenyl Index for an alkylbenzenesulfonic acid mixture is defined by the following equation:

2-methyl-2-phenyl index=(Integral from about 156.40 ppm to about 156.65 ppm)/(Integral from about 152.50 ppm to about 156.90 ppm).

Conventional Surface Cleansing Additive

The hard surface cleaner composition of the present invention additionally contain a conventional surface cleansing additive. The conventional surface cleansing additive are present from about 0.001% to about 99.9% by weight. Preferably, conventional surface cleansing additive will be present from at least about 0.5%, more preferably, at least about 1%, even more preferably at least about 2%, by weight. Additionally, the conventional surface cleansing additives can also be present at least about 5%, at least about 8% and at least about 10%, by weight but it is more preferable that the conventional surface cleansing additive be present in at least about 2% by weight. Furthermore, the conventional surface cleansing additive will be preferably present in the hard surface composition at preferably at less than about 45%, more preferably less than about 40%, even more preferably less than about 35%, even more preferably less than about 30%, even more preferably less than about 20%, by weight. This conventional surface cleansing additive is selected from the group comprising;

a) liquid carrier;

b) co-surfactant;

c) builder;

d) co-solvent;

e) polymeric additive;

f) pH adjusting material;

g) hydrotropes; and h) mixtures thereof.

The co-surfactant, (b), useful in the present invention can be further selected from the group comprising i) anionic;

ii) nonionic;

iii) cationic;

iv) ampohteric;

v) zwitterionic; and vi) mixtures thereof;

The polymeric additives, (e), useful in the present invention can be further selected from the group comprising 1) polyalkoxylene glycol;

2) PVP homopolymers or copolymers thereof;

3) polycarboxylate;

4) sulfonated polystyrene polymer; and 5) mixtures thereof.

In one preferred embodiment, the hard surface cleaner is a delicate surface cleaning composition comprising a modified alkylbenzene sulfonate surfactant mixture, hereinbefore defined; from about 0.1% to about 10% by weight of a builder; from about 10% to about 99.89%, by weight of an aqueous liquid carrier; sufficient positive divalent ions so as to saturate said builder; and wherein the composition is formulated at a mildly acidic to mildly basic pH.

In one preferred embodiment, the present invention also includes a hard surface cleaning composition comprising a modified alkylbenzene sulfonate surfactant mixture, hereinbefore defined; from about 0.005% to about 20% by weight of a nonionic co-surfactant selected from the group consisting of hydrophilic nonionic surfactants, and mixtures thereof; and from about 50% to about 99.89%, by weight of a C8 to C18 alcohol; and wherein the ratio of nonionic co-surfactant to alcohol is about 1:1 to about 10:1.

In one preferred embodiment, the present invention also includes a hard surface cleaning composition comprising a modified alkylbenzene sulfonate surfactant mixture, hereinbefore defined, from about 0.1% to about 8% by weight of a surfactant selected from zwitterionic co-surfactants, nonionic co-surfactant, suds controlling nonionic and mixtures thereof; from about 2% to about 14% of a polycarboxylate builder; wherein said acidic hard surface cleaning composition has a pH of from about 1 to about 5.5.

In one preferred embodiment, the present invention also includes a hard surface cleaning composition comprising a modified alkylbenzene sulfonate surfactant mixture, hereinbefore defined; from about 0.001% to about 20% by weight of an antiresoiling agent selected from the group comprising a polyalkoxylene glycol according to the formula:

$$H—O—(CH_2—CHR_2O)_n—H;$$

a monocapped polyalkoxylene glycol of the formula:

$$R_1—O—(CH_2—CHR_2O)_n—H;$$

a dicapped polyalkoxylene glycol of the formula:

$$R_1—O—(CH_2—CHR_2O)_n—R_3;$$

and a mixture thereof, wherein the substituents $R_1$ and $R_3$ each independently are substituted or unsubstituted, saturated or unsaturated, linear or branched hydrocarbon chains having from 1 to 30 carbon atoms, or amino bearing linear or branched, substituted or unsubstituted hydrocarbon chains having from 1 to 30 carbon atoms, $R_2$ is hydrogen or a linear or branched hydrocarbon chain having from 1 to 30 carbon atoms, and wherein n is an integer greater than 0; and from about 0.001% to about 20.0% of a vinylpyrrolidone homopolymer or copolymer.

In one preferred embodiment, the present invention also includes a hard surface cleaning composition comprising a modified alkylbenzene sulfonate surfactant mixture, hereinbefore defined; and from about 0.1% to about 10% by weight of a sulfosuccinamate selected from the group having the formulas:

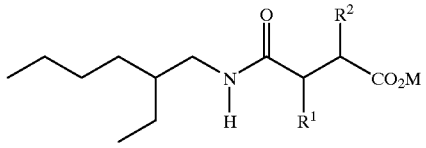

or

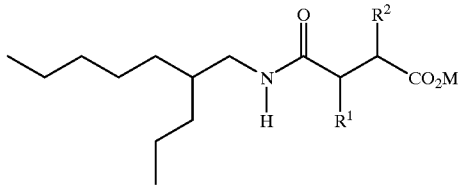

wherein $R^1$ and $R^2$ are hydrogen or $—SO_3M^2$ provided $R^1$ does not equal $R^2$; and M and $M^2$ are independently hydrogen or a salt forming cation.

In one preferred embodiment, the present invention also includes a hard surface cleaning composition comprising a modified alkylbenzene sulfonate surfactant mixture, hereinbefore defined; from about 0.001% to about 15% amphocarboxylate co-surfactant having the generic formula:

$$RN(R^1)(CH_2)_nN(R^2)(CH2)_pC(O)OM$$

wherein R is a $C_6$–$C_{10}$ hydrophobic moiety, including fatty acyl moiety containing from about 6 to about 10 carbon atoms which in combination with the nitrogen atom forms an amido group, $R^1$ is hydrogen or a $C_{1-2}$ alkyl group, $R^2$ is a $C_{1-2}$ alkyl, carboxymethoxy ethyl, or hydroxy ethyl, each n is an integer from 1 to 3, each p is an integer from 1 to 2 and M is a water soluble cation selected from alkali metal, ammonium, alkanolammonium, and mixtures thereof cations;

(2) from about 0.02% to about 10% zwitterionic co-surfactant having the generic formula:

$$R^3—[C(O)—N(R^4)—(CR^5{}_2)_n1\text{-}]_mN(R^6)_2{}^{(+)}—(CR^5{}_2)_p1\text{-}Y^{(-)}$$

wherein each $R^3$ is an alkyl, or alkylene, group containing from about 10 to about 18 carbon atoms, each ($R^4$) and ($R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, with no more than about one hydroxy group in any $(CR^5{}_2)_p{}^1$ moiety; m is 0 or 1; each $n^1$ and $p^1$ is a number from 1 to about 4; and Y is a carboxylate or sulfonate group; and (3) from about 0.01% to about 2.0% anionic surfactant having the generic formula:

$$R^9—(R^{10})_{0\text{-}1}—SO_3{}^{(-)}M^{(+)}$$

wherein $R^9$ is a $C_6$–$C_{20}$ alkyl chain; $R^{10}$ is a $C_6$–$C_{20}$ alkylene chain, a $C_6H_4$ phenylene group, or O; and M is the same as before; and (4) mixtures thereof, and (iii) from about 0.5% to about 30%, by weight of hydrophobic solvent, having a hydrogen bonding parameter of from about 2 to about 7.7;

(iv) alkaline material to provide a pH, measured on the product, of from about 9 to about 12;

(v) from about 0.01% to about 10% by weight of a substantive polymer that makes glass more hydrophilic, in an effective amount to provide an improvement in spotting/filming after at least three rewettings of the glass, said polymer being selected from the group consisting of polycarboxylate polymer having a molecular weight of from about 10,000 to about 3,000,000 and sulfonated polystyrene polymers having a molecular weight of from about 10,000 to about 1,000,000; and (vi) from about 0.1 to about 99.99% by weight of an aqueous liquid carrier.

The invention also comprises a detergent composition containing the modified alkylbenzene sulfonate surfactant mixture, as disclosed herein, in a container in association with instructions to use it with an absorbent structure comprising an effective amount of a superabsorbent material, and, optionally, in a container in a kit comprising the implement, or, at least, a disposable cleaning pad comprising a superabsorbent material.

The invention also relates to the use of the composition, containing the modified alkylbenzene sulfonate surfactant mixture, and a cleaning pad comprising a suberabsorbent material to effect cleaning of soiled surfaces, i.e., the process of cleaning a surface comprising applying an effective amount of a detergent composition containing no more than about 1% detergent surfactant; a level of hydrophobic materials, including solvent, that is less than about 0.5%; and a pH of more than about 7 and absorbing the composition in an absorbent structure comprising a superabsorbent material.

a) Liquid Carrier

The balance of the formula can be water and non-aqueous polar solvents with only minimal cleaning action like methanol, ethanol, isopropanol, ethylene glycol, glycol ethers having a hydrogen bonding parameter of greater than 7.7, propylene glycol, and mixtures thereof, preferably isopropanol. The level of non-aqueous polar solvent is usually greater when more concentrated formulas are prepared. Typically, the level of non-aqueous polar solvent is from about 0.5% to about 40%, preferably from about 1% to about 10%, more preferably from about 2% to about 8% (especially for "dilute" compositions) and the level of aqueous liquid carrier is from about 50% to about 99%, preferably from about 75% to about 95%.

b) Co-surfactant

The hard surface cleaning compositions according to the present invention may optionally contain co-surfactants, preferably selected from: anionic co-surfactants, cationic co-surfactants; nonionic co-surfactants; amphoteric co-surfactants; and zwiterionic co-surfactants.

A wide range of these co-surfactants can be used in the hard surface cleaning compositions of the present invention. A typical listing of anionic, nonionic, ampholytic and zwitterionic classes, and species of these co-surfactants, is given in U.S. Pat. No. 3,664,961 issued to Norris on May 23, 1972. Amphoteric co-surfactants are also described in detail in "Amphoteric Surfactants, Second Edition", E. G. Lomax, Editor (published 1996, by Marcel Dekker, Inc.)

The hard surface cleaning compositions of the present invention will preferably comprise from about 0.001% to about 20%, preferably from about 0.1% to about 10%, by weight of co-surfactants. Selected co-surfactants are further identified as follows.

i) Anionic Co-surfactant

The optional anionic co-cosurfactant component can comprise as little as 0.001% of the compositions herein when it is present, but typically the compositions will contain from about 0.001% to about 20%, more preferably from about 0.1% to about 10%, even more preferably from about 0.1% to about 5% of anionic cosurfactant, when it is present. Suitable anionic co-surfactants for use herein include alkali metal (e.g., sodium or potassium) fatty acids, or soaps thereof, containing from about 8 to about 24, preferably from about 10 to about 20 carbon atoms. The fatty acids including those used in making the soaps can be obtained from natural sources such as, for instance, plant or animal-derived glycerides (e.g., palm oil, coconut oil, babassu oil, soybean oil, castor oil, tallow, whale oil, fish oil, tallow, grease, lard and mixtures thereof). The fatty acids can also be synthetically prepared (e.g., by oxidation of petroleum stocks or by the Fischer-Tropsch process).

Alkali metal soaps can be made by direct saponification of fats and oils or by the neutralization of the free fatty acids which are prepared in a separate manufacturing process. Particularly useful are the sodium and potassium salts of the mixtures of fatty acids derived from coconut oil and tallow, i.e., sodium and potassium tallow and coconut soaps.

The term "tallow" is used herein in connection with fatty acid mixtures which typically have an approximate carbon chain length distribution of 2.5% C14, 29% C16, 23% C18, 2% palmitoleic, 41.5% oleic and 3% linoleic (the first three fatty acids listed are saturated). Other mixtures with similar distribution, such as the fatty acids derived from various animal tallows and lard, are also included within the term tallow. The tallow can also be hardened (i.e., hydrogenated) to convert part or all of the unsaturated fatty acid moieties to saturated fatty acid moieties.

When the term "coconut" is used herein it refers to fatty acid mixtures which typically have an approximate carbon chain length distribution of about 8% C8, 7% C10, 48% C12, 17% C14, 9% C16, 2% C18, 7% oleic, and 2% linoleic (the first six fatty acids listed being saturated). Other sources having similar carbon chain length distribution such as palm kernel oil and babassu oil are included with the term coconut oil.

Other suitable anionic co-surfactants for use herein include water-soluble salts, particularly the alkali metal salts, of organic sulfuric reaction products having in the molecular structure an alkyl radical containing from about 8 to about 22 carbon atoms and a radical selected from the group consisting of sulfonic acid and sulfuric acid ester radicals. Important examples of these synthetic detergents are the sodium, ammonium or potassium alkyl sulfates, especially those obtained by sulfating the higher alcohols produced by reducing the glycerides of tallow or coconut oil; sodium or potassium alkyl benzene sulfonates, in which the alkyl group contains from about 9 to about 15 carbon atoms, especially those of the types described in U.S. Pat. Nos. 2,220,099 and 2,477,383, incorporated herein by reference; sodium alkyl glyceryl ether sulfonates, especially those ethers of the higher alcohols derived from tallow and coconut oil; sodium coconut oil fatty acid monoglyceride sulfates and sulfonates; alkyl benzene sulfates and sulfonates, alkyl ether sulfates, paraffin sulfonates, sulfonates of fatty acids and of fatty acid esters, sulpho succinates, sarcosinates, sodium or potassium salts of sulfuric acid esters of the reaction product of one mole of a higher fatty alcohol (e.g., tallow or coconut oil alcohols) and about three moles of ethylene oxide; sodium or potassium salts of alkyl phenol ethylene oxide ether sulfates with about four units of ethylene oxide per molecule and in which the alkyl radicals contain about 9 carbon atoms; the reaction product of fatty acids esterified with isothionic acid and neutralized with sodium hydroxide where, for example, the fatty acids are derived from coconut oil; sodium or potassium salts of fatty acid amide of a methyl taurine in which the fatty acids, for example, are derived from coconut oil; and others known in the art, a number being specifically set forth in U.S. Pat. Nos. 2,486,921, 2,486,922 and 2,396,278, incorporated herein by reference.

The anionic co-surfactants can also be used in the form of their salts, including sodium, potassium, magnesium, ammonium and alkanol/alkyl ammonium salts.

The hard surface cleaning compositions of the present invention may additionally contain one of two sulfosuccinamate co-surfactant. The two possible sulfosuccinamates are:

i) N-2-ethylhexyl sulfosuccinamate:

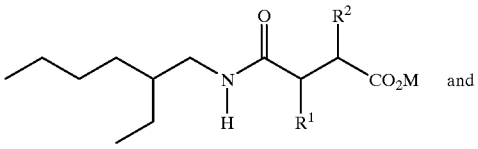

and ii) N-2-propylheptyl sulfosuccinamate

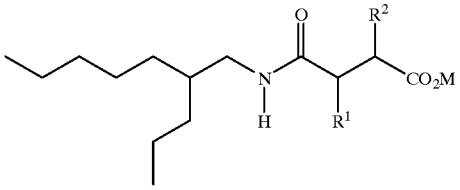

wherein $R^1$ and $R^2$ are selected from hydrogen or the moiety $—SO_3M^2$, provided however that $R^1$ and $R^2$ are not the same, that is when $R^1$ is hydrogen, $R^2$ must be $—SO_3M^2$ and vice versa. M and $M^2$ are independently selected from hydrogen or a salt forming cation. Three carbon atoms in the above molecule are chiral centers, that is they individually have the capacity to form optical isomers or enantiomers. In addition, when two or more of these chiral carbons are taken together they may form diasteriomeric pairs or combinations. For the purposes of the present invention the sulfosuccinamates are drawn such that each chiral center is shown in its racemic form. For the purposes of the present invention all isomeric forms of the sulfosuccinamate are suitable for use in the compositions of the present invention.

M and $M^2$ may be hydrogen or a salt forming cation depending upon the method of synthesis chosen and the pH of the final hard surface cleaner. Examples of salt forming cations are lithium, sodium, potassium, calcium, magnesium, quaternary alkyl amines having the formula

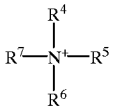

wherein $R^4$, $R^5$, $R^6$ and $R^7$ are independently hydrogen, $C_1$–$C_{22}$ alkylene, $C_4$–$C_{22}$ branched alkylene, $C_1$–$C_6$ alkanol, $C_1$–$C_{22}$ alkenylene, $C_4$–$C_{22}$ branched alkenylene, and mixtures thereof. A different salt forming cation may be chosen for the carboxylate moiety ($—CO_2^-$) than is chosen for the sulfonate moiety ($—SO_3^-$). Preferred cations are ammonium ($R^4$, $R^5$, $R^6$ and $R^7$ equal hydrogen), sodium, potassium, mono-, di-, and trialkanol ammonium, and mixtures thereof. The monoalkanol ammonium compounds of the present invention have $R^4$ equal to $C_1$–$C_6$ alkanol, $R^5$, $R^6$ and $R^7$ equal to hydrogen; dialkanol ammonium compounds of the present invention have $R^4$ and $R^5$ equal to $C_1$–$C_6$ alkanol, $R^6$ and $R^7$ equal to hydrogen; trialkanol ammonium compounds of the present invention have $R^4$, $R^5$ and $R^6$ equal to $C_1$–$C_6$ alkanol, $R^7$ equal to hydrogen. Preferred alkanol ammonium salts of the present invention are the mono-, di- and tri-quaternary ammonium compounds having the formulas:

$$H_3N^+CH_2CH_2OH,\ H_2N^+(CH_2CH_2OH)_2,\ HN^+(CH_2CH_2OH)_3.$$

Preferred M and $M^2$ are hydrogen, sodium, potassium and the $C_2$ alkanol ammnonium salts listed above; most preferred are hydrogen and sodium.

Another group of anionic co-surfactants which can be used in the hard surface cleansing compositions of the present invention have the generic formula:

$$R^9—(R^{10})_{0-1}—SO_3(-)M(+)$$

wherein $R^9$ is a $C_6$–$C_{20}$ alkyl chain, preferably a $C_8$–$C_{16}$ alkyl chain; $R^{10}$, when present, is a $C_6$–$C_{20}$ alkylene chain, preferably a $C_8$–$C_{16}$ alkylene chain, a $C_6H_4$ phenylene group, or O; and M is the same as before.

Typical of these are the alkyl- and alkylethoxylate-(polyethoxylate) sulfates, paraffin sulfonates, olefin sulfonates, alkoxylated (especially ethoxylated) alcohols and alkyl phenols, alkyl phenol sulfonates, alpha-sulfonates of fatty acids and of fatty acid esters, and the like, which are well-known from the detergency art. When the pH is above about 9.5, co-surfactants that are amphoteric at a lower pH are desirable anionic co-cosurfactants. For example, co-surfactants which are $C_{12}$–$C_{18}$ acylamido alkylene amino alkylene sulfonates, e.g., compounds having the formula $R—C(O)—NH—(C_2H_4)—N(C_2H_4OH)—CH_2CH(OH)CH_2SO_3M$ wherein R is an alkyl group containing from about 9 to about 18 carbon atoms and M is a compatible cation are desirable cosurfactants. These co-surfactants are available as Miranol(® CS, OS, JS, etc. The CTFA adopted name for such co-surfactants is cocoamphohydroxypropyl sulfonate.

In general, anionic co-surfactants useful herein contain a hydrophobic group, typically containing an alkyl group in the $C_9$–$C_{18}$ range, and, optionally, one or more linking groups such as ether or amido, preferably amido groups. The anionic detergent surfactants can be used in the form of their sodium, potassium or alkanolammonium, e.g., triethanolammonium salts. $C_{12}$–$C_{18}$ paraffin-sulfonates and alkyl sulfates are useful anionic co-surfactants in the compositions of the present type.

Some other suitable anionic co-surfactants for use herein in small amounts are one or more of the following: sodium linear $C_8$–$C_{18}$ alkyl benzene sulfonate (LAS), particularly $C_{11}$–$C_{12}$ LAS; the sodium salt of a coconut alkyl ether sulfate containing 3 moles of ethylene oxide; the adduct of a random secondary alcohol having a range of alkyl chain lengths of from 11 to 15 carbon atoms and an average of 2 to 10 ethylene oxide moieties, several commercially available examples of which are Tergitol® 15-S-3, Tergitol 15-S-5, Tergitol 15-S-7, and Tergitol 15-S-9, all available from Union Carbide Corporation; the sodium and potassium salts of coconut fatty acids (coconut soaps); the condensation product of a straight-chain primary alcohol containing from about 8 carbons to about 16 carbon atoms and having an average carbon chain length of from about 10 to about 12 carbon atoms with from about 4 to about 8 moles of ethylene oxide per mole of alcohol; an amide having one of the preferred formulas:

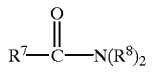

wherein $R^7$ is a straight-chain alkyl group containing from about 7 to about 15 carbon atoms and having an average carbon chain length of from about 9 to about 13 carbon atoms and wherein each $R^8$ is a hydroxy alkyl group containing from 1 to about 3 carbon atoms. Another suitable class of surfactants are the fluorocarbon surfactants, examples of which are FC-129®, a potassium fluorinated alkylcarboxylate and FC-170-C®, a mixture of fluorinated alkyl polyoxyethylene ethanols, both available from 3M Corporation, as well as the Zonyl® fluorosurfactants, available from DuPont Corporation. It is understood that mixtures of various anionic co-surfactants can be used.

Other typical optional anionic co-surfactants are the alkyl- and alkyl(polyethoxylate) sulfates, paraffin sulfonates, olefin sulfonates, alpha-sulfonates of fatty acids and of fatty acid esters, and the like, which are well known from the detergency art. In general, such detergent surfactants contain an alkyl group in the $C_{9-22}$ preferably $C_{10-18}$, more preferably $C_{12-16}$, range. The anionic co-surfactants can be used in the form of their sodium, potassium or alkanolammonium, e.g., triethanolammonium salts.

A detailed listing of suitable anionic co-surfactants, of the above types, for the hard surface cleaning compositions herein can be found in U.S. Pat. Nos. 4,557,853, and 3,929,678 incorporated by reference hereinbefore. Commercial sources of such surfactants can be found in McCutcheon's EMULSIFIERS AND DETERGENTS, North American Edition, 1997, McCutcheon Division, MC Publishing Company, also incorporated hereinbefore by reference.

Anionic co-surfactants suitable for use in the hard surface cleaning compositions include alkyl and alkyl ether sulfates. These materials have the respective formulae $ROSO_3M$ and $RO(C_2H_4O)_xSO_3M$, wherein R is alkyl or alkenyl of from about 8 to about 30 carbon atoms, x is 0.01 to 10, and M is a cation such as ammonium, alkanolamines, such as triethanolamine, monovalent metals, such as sodium and potassium, and polyvalent metal cations, such as magnesium, and calcium. The cation M, of the anionic co-surfactant should be chosen such that the anionic co-surfactant component is water soluble. Solubility will depend upon the particular anionic co-surfactants and cations chosen.

Preferably, R has from about 12 to about 18 carbon atoms in both the alkyl and alkyl ether sulfates. The alkyl ether sulfates are typically made as condensation products of ethylene oxide and monohydric alcohols having from about 8 to about 24 carbon atoms. The alcohols can be derived from fats, e.g., coconut oil or tallow, or can be synthetic. Lauryl alcohol and straight chain alcohols derived from coconut oil are preferred herein. Such alcohols are reacted with between about 0 and about 10, and especially about 3, molar proportions of ethylene oxide and the resulting mixture of molecular species having, for example, an average of 3 moles of ethylene oxide per mole of alcohol, is sulfated and neutralized.

Specific examples of alkyl ether sulfates which may be used in the hard surface cleaning compositions of the present invention are sodium and ammonium salts of coconut alkyl triethylene glycol ether sulfate; tallow alkyl triethylene glycol ether sulfate, and tallow alkyl hexaoxyethylene sulfate. Highly preferred alkyl ether sulfates are those comprising a mixture of individual compounds, said mixture having an average alkyl chain length of from about 10 to about 16 carbon atoms and an average degree of ethoxylation of from about 1 to about 4 moles of ethylene oxide.

Other suitable anionic co-surfactants are the water-soluble salts of organic, sulfuric acid reaction products of the general formula $[R_1—SO_3—M]$ where $R_1$ is selected from the group consisting of a straight or branched chain, saturated aliphatic hydrocarbon radical having from about 8 to about 24, preferably about 10 to about 18, carbon atoms; and M is a cation, as previously described, subject to the same limitations regarding polyvalent metal cations as previously discussed. Examples of such co-surfactants are the salts of an organic sulfuric acid reaction product of a hydrocarbon of the methane series, including iso-, neo-, and n-paraffins, having about 8 to about 24 carbon atoms, preferably about 12 to about 18 carbon atoms and a sulfonating agent, e.g., $SO_3$, $H_2SO_4$, obtained according to known sulfonation methods, including bleaching and hydrolysis. Preferred are alkali metal and ammonium sulfonated $C_{10-18}$ n-paraffins.

Still other suitable anionic co-surfactants are the reaction products of fatty acids esterified with isethionic acid and neutralized with sodium hydroxide where, for example, the fatty acids are derived from coconut oil; sodium or potassium salts of fatty acid amides of methyl tauride in which the fatty acids, for example, are derived from coconut oil. Other similar anionic surfactants are described in U.S. Pat. Nos. 2,486,921; 2,486,922; and 2,396,278.

Other anionic co-surfactants suitable for use in the hard surface cleaning compositions are the succinnates, examples of which include disodium N-octadecylsulfosuccinnate; disodium lauryl sulfosuccinate; diammonium lauryl sulfosuccinate; tetrasodium N-(1,2-dicarboxyethyl)-N-octadecylsulfosuccinnate; diamyl ester of sodium sulfosuccinic acid; dihexyl ester of sodium sulfosuccinic acid; dioctyl esters of sodium sulfosuccinic acid.

Other suitable anionic co-surfactants include olefin sulfonates having about 10 to about 24 carbon atoms. The term "olefin sulfonates" is used herein to mean compounds which can be produced by the sulfonation of alpha-olefins by means of uncomplexed sulfur trioxide, followed by neutralization of the acid reaction mixture in conditions such that any sulfones which have been formed in the reaction are hydrolyzed to give the corresponding hydroxy-alkanesulfonates. The sulfur trioxide can be liquid or gaseous, and is usually, but not necessarily, diluted by inert diluents, for example by liquid $SO_2$, chlorinated hydrocarbons, etc., when used in the liquid form, or by air, nitrogen, gaseous $SO_2$, etc., when used in the gaseous form.

The alpha-olefins from which the olefin sulfonates are derived are mono-olefins having about 12 to about 24 carbon atoms, preferably about 14 to about 16 carbon atoms. Preferably, they are straight chain olefins.

In addition to the true alkene sulfonates and a proportion of hydroxy-alkanesulfonates, the olefin sulfonates can contain minor amounts of other materials, such as alkene disulfonates depending upon the reaction conditions, proportion of reactants, the nature of the starting olefins and impurities in the olefin stock and side reactions during the sulfonation process.

A specific alpha-olefin sulfonate mixture of the above type is described more fully in the U.S. Pat. No. 3,332,880, which description is incorporated herein by reference.

Another class of anionic co-surfactants suitable for use in the hard surface cleaning compositions are the beta-alkyloxy alkane sulfonates. These compounds have the following formula:

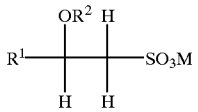

where $R^1$ is a straight chain alkyl group having from about 6 to about 20 carbon atoms, $R^2$ is a lower alkyl group having from about 1 (preferred) to about 3 carbon atoms, and M is a water-soluble cation as hereinbefore described.

Some other preferred anionic co-surfactants for use in the hard surface cleaning compositions include ammonium lauryl sulfate, ammonium laureth sulfate, triethylamine lauryl sulfate, triethylamine laureth sulfate, triethanolamine lauryl sulfate, triethanolamine laureth sulfate, monoethanolamine lauryl sulfate, monoethanolamine laureth sulfate, diethanolamine lauryl sulfate, diethanolamine laureth sulfate, lauric monoglyceride sodium sulfate, sodium lauryl sulfate, sodium laureth sulfate, potassium lauryl sulfate, potassium laureth sulfate, sodium lauryl sarcosinate, sodium lauroyl sarcosinate, lauryl sarcosine, cocoyl sarcosine, ammonium cocoyl sulfate, ammonium lauroyl sulfate, sodium cocoyl sulfate, sodium lauroyl sulfate, potassium cocoyl sulfate, potassium lauryl sulfate, triethanolamine lauryl sulfate, triethanolamine lauryl sulfate, monoethanolamine cocoyl sulfate, monoethanolamine lauryl sulfate, sodium tridecyl benzene sulfonate, and sodium dodecyl benzene sulfonate.

ii) nonionic

The nonionic co-surfactant component can comprise as little as 0.01% of the compositions herein, especially when used with another co-surfactant, but typically the compositions will contain from about 0.5% to about 10%, more preferably from about 1% to about 5%, of nonionic co-surfactant.

It is preferred that, when present, the ratio of nonionic co-surfactant to zwitterionic or amphoteric (non-zwitterionic) co-surfactant, when these co-surfactant are present, is typically from about 1:4 to about 3:1, preferably from about 1:3 to about 2:1, more preferably from about 1:2 to about 1:1.

As an optional component, component (b)(ii), the compositions herein may additionally comprise a hydrophilic nonionic co-surfactant, or mixtures thereof. Suitable hydrophilic nonionic co-surfactants for use herein include alkoxylated alcohols, preferably ethoxylated alcohols. Such co-surfactants can be represented by the formula CxEOyH, where C symbolizes the hydrocarbon chain of the alcohol starting material, x represents the length of its hydrocarbon chain. EO represents ethoxy groups and y represents the average degree of ethoxylation, i.e. the average number of moles of ethoxy groups per mole of alcohol. Suitable hydrophilic nonionic co-surfactants for use herein include those where x is of from 9 to 18, preferably 9 to 14, and average y is of from 8 to 30, preferably 10 to 20 Also suitable hydrophilic nonionic co-surfactants are ethoxylated and propoxylated alcohols which can be represented by the formula CxPOyEOy', where x is as above, and (y+y') is as y above.

As an optional component, the compositions herein may additionally contain a hydrophobic nonionic co-surfactant (b)(ii), or mixtures thereof. Suitable hydrophobic nonionic co-surfactants for use herein include alkoxylated alcohols, preferably ethoxylated alcohols. Such co-surfactants can be represented by the formula CxEOyH, where C symbolizes the hydrocarbon chain of the alcohol starting material, x represents the length of its hydrocarbon chain. EO represents ethoxy groups and y represents the average degree of ethoxylation, i.e. the average number of moles of ethoxy groups per mole of alcohol. Suitable hydrophobic nonionic co-surfactants for use herein include those where x is of from 9 to 18, preferably 9 to 16, and y is of from 2 to 7, preferably 4 to 7. Suitable hydrophobic nonionic co-surfactants also include ethoxylated and propoxylated alcohols which can be represented by the formula CxPOyEOy', where x is as above x and where (y+y') is as y above. The compositions herein can comprise mixtures of such hydrophobic nonionics, and when present, the compositions may comprise from 1% to 20%, preferably from 3% to 15% by weight of the total composition of such hydrophobic nonionic co-surfactants, or mixtures thereof.

Another type of suitable nonionic co-surfactants for use herein include a class of compounds which may be broadly defined as compounds produced by the condensation of alkylene oxide groups (hydrophilic in nature) with an organic hydrophobic compound, which may be branched or linear aliphatic (e.g. Guerbet or secondary alcohols) or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

For example, a well-known class of nonionic synthetic is made available on the market under the trade name "Pluronic". These compounds are formed by condensing ethylene oxide with an hydrophobic base formed by the condensation of propylene oxide with propylene glycol. The hydrophobic portion of the molecule which, of course, exhibits water-insolubility has a molecular weight of from about 1500 to 1800. The addition of polyoxyethylene radicals to this hydrophobic portion tends to increase the water-solubility of the molecule as a whole and the liquid character of the products is retained up to the point where polyoxyethylene content is about 50% of the total weight of the condensation product.

Other suitable nonionic synthetic co-surfactants include:

(i) The polyethylene oxide condensates of alkyl phenols, e.g., the condensation products of alkyl phenols having an alkyl group containing from about 6 to 12 carbon atoms in either a straight chain or branched chain configuration, with ethylene oxide, the said ethylene oxide being present in amounts equal to 10 to 25 moles of ethylene oxide per mole of alkyl phenol. The alkyl substituent in such compounds may be derived from polymerized propylene, diisobutylene, octane, and nonane;

(ii) Those derived from the condensation of ethylene oxide with the product resulting from the reaction of propylene oxide and ethylene diamine products which may be varied in composition depending upon the balance between the hydrophobic and hydrophilic elements which is desired. Examples are compounds containing from about 40% to about 80% polyoxyethylene by weight and having a molecular weight of from about 5000 to about 11000 resulting from the reaction of ethylene oxide groups with a hydrophobic base constituted of the reaction product of ethylene diamine and excess propylene oxide, said base having a molecular weight of the order of 2500 to 3000;

(iii) The condensation product of aliphatic alcohols having from 8 to 18 carbon atoms, in either straight chain or branched chain configuration, with ethylene oxide, e.g., a coconut alcohol ethylene oxide condensate having from 10 to 30 moles of ethylene oxide per mole of coconut alcohol, the coconut alcohol fraction having from 10 to 14 carbon atoms;

(iv) Trialkyl amine oxides and trialkyl phosphine oxides wherein one alkyl group ranges from 10 to 18 carbon atoms and two alkyl groups range from 1 to 3 carbon atoms; the alkyl groups can contain hydroxy substituents; specific examples are dodecyl di(2-hydroxyethyl)amine oxide and tetradecyl dimethyl phosphine oxide.

Also useful as a nonionic co-surfactant are the alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose, and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions of the preceding saccharide units.

Optionally there can be a polyalkkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group can contain up to about 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula:

$$R^2O(C_nH_{2n}O)_t(\text{glucosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; m is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

The condensation products of ethylene oxide with a hydrophobic base formed by the condensation of propylene oxide with propylene glycol are also suitable for use herein. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic™ co-surfactants, marketed by BASF.

Also suitable for use as nonionic co-surfactants herein are the condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5000 to about 11000. Examples of this type of nonionic co-surfactant include certain of the commercially available Tetronic™ compounds, marketed by BASF.

Other suitable nonionic co-surfactants for use herein include polyhydroxy fatty acid amides of the structural formula:

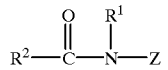

wherein: $R^1$ is H, $C_1$–$C_4$ hydrocarbyl, 2-hydroxy ethyl, 2-hydroxypropyl, or a mixture thereof, preferably $C_1$–C4 alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

Additionally $R^1$ can be, for example, N-methyl, N-ethyl, N-propyl, N-isopropyl, N-butyl, N-2-hydroxy ethyl, or N-2-hydroxy propyl. $R^2—CO—N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxyhydrogalactityl, 1-deoxymaniyl, 1-deoxymaltotriotityl, etc.

Suitable nonionic co-surfactants which can be used are polyethylene oxide condensates of alkyl phenols, condensation products of primary and secondary aliphatic alcohols with from about 1 to about 25 moles of ethylene oxide, alkylpolysaccharides, and mixtures thereof. Most preferred are $C_8$–$C_{14}$ alkyl phenol ethoxylates having from 3 to 15 etholxy groups and $C_8$–$C_{18}$ alcohol ethoxylates (preferably $C_{10}$ avg.) having from 2 to 10 ethoxy groups, and mixtures thereof.

Hard surface cleaning compositions according to the invention can also contain a highly ethoxylated nonionic co-surfactant. The highly ethoxylated nonionic co-surfactants which can be used in the compositions belong to the group according to the formula $RO—(CH_2CH_2O)_nH$, wherein R is a $C_8$ to $C_{22}$ alkyl chain or a $C_8$ to $C_{28}$ alkyl benzene chain, and n is an integer of from 10 to 65, or mixtures thereof. Accordingly, one of the preferred nonionic co-surfactants for use in the compositions according to the present invention are those according to the above formula where n is from 11 to 35, more preferably 18 to 35, most preferably 21 to 30. The preferred R chains for use herein are the $C_8$ to $C_{22}$ alkyl chains. Suitable chemical processes for preparing the highly ethoxylated nonionic co-surfactants for use herein have been extensively described in the art. Suitable highly ethoxylated nonionic co-surfactants for use herein are also commercially available, for instance in the series commercialized under the trade name LUTENSOL® from BASF or DOBANOL® from SHELL. A preferred highly ethoxylated alcohol for use herein is LUTENSOL® AO30 (R is a mixture of $C_{13}$ and $C_{15}$ alkyl chains, and n is 30). It is also possible to use mixtures of such highly ethoxylated nonionic co-surfactants, with different R groups and different ethoxylation degrees.

Furthermore, the compositions according to the invention can also contain a nonionic co-surfactant system comprising at least a nonionic co-surfactant with an HLB of at least 12, hereinafter referred to as highly hydrophilic co-surfactant and at least a nonionic co-surfactant with an HLB below 10 and at least 4 less than that of said highly hydrophilic co-surfactant, hereinafter referred to as highly hydrophobic co-surfactant.

Suitable nonionic co-surfactants for the implementation of said co-surfactant system are alkoxylated alcohols or alkoxylated phenylalcohols which are commercially available with a variety of alcohol chain lengths and a variety of alkoxylation degrees. By simply varying the length of the chain of the alcohol and/or the degree of alkoxylation, alkoxylated alcohols or alkoxylated phenylalcohols can be obtained with different HLB values. It is to be understood to those ordinarily skilled in the art that the HLB value of any specific compound is available from the literature.

Suitable chemical processes for preparing the highly hydrophilic and highly hydrophobic nonionic co-surfactants for use herein include condensation of corresponding alcohols with alkylene oxide, in the desired proportions. Such processes are well known to the man skilled in the art and have been extensively described in the art. As an alternative, a great variety of alkoxylated alcohols suitable for use herein is commercially available from various suppliers.

The highly hydrophilic nonionic co-surfactants which can be used in the present invention have an HLB of at least 12, preferably above 14 and most preferably above 15. Those highly hydrophilic nonionic co-surfactants have been found to be particularly efficient for a rapid wetting of typical hard surfaces covered with greasy soils and to provide effective soil suspension.

The highly hydrophobic nonionic co-surfactants which can be used in the present invention have an HLB below 10, preferably below 9 and most preferably below 8.5. Those highly hydrophobic nonionic co-surfactants have been found to provide excellent grease cutting and emulsification properties.

When present, the preferred highly hydrophilic nonionic co-surfactants which can be used in the compositions according to the present invention are co-surfactants having an HLB from 12 to 20 and being according to the formula $RO—(C_2H_4O)_n(C_3H_6O)_mH$, wherein R is a $C_8$ to $C_{22}$ alkyl chain or a $C_8$ to $C_{28}$alkyl benzene chain, and wherein n+m is from 6 to 100 and n is from 0 to 100 and m is from 0 to 100, preferably n+m is from 21 to 50 and, n and m are from 0 to 50, and more preferably n+m is from 21 to 35 and, n and m are from 0 to 35. Throughout this description n and m refer to the average degree of the ethoxylation/propoxylation. The preferred R chains for use herein are the $C_8$ to $C_{22}$ alkyl chains. Examples of highly hydrophilic nonionic co-surfactants suitable for use herein are LUTENSOL® AO30 (HLB=17; R is a mixture of $C_{13}$ and $C_{15}$ alkyl chains, n is 30 and m is 0) commercially available from BASF, CETALOX® 50 (HLB=18; R is a mixture of $C_{16}$ and $C_{18}$ alkyl chains, n is 50 and m is 0) commercially available from WITCO Alfonic® and 810-60 (HLB=12; R is a mixture of $C_8$ and $C_{10}$ alkyl chains, n is 6 and m is 0); and MARLIPAL® 013/400 (HLB=18; R is a mixture of $C_{12}$ and $C_{14}$, n is 40 and m is 0) commercially available from HULS.

When present, the preferred highly hydrophobic nonionic co-surfactants which can be used in the compositions according to the present invention are co-surfactants having an HLB of from 2 to 10 and being according to the formula $RO—(C_2H_4O)_n(C_3H_6O)_mH$, wherein R is a $C_8$ to $C_{22}$ alkyl chain or a $C_8$ to $C_{28}$ alkyl benzene chain, and wherein n+m is from 0.5 to 5 and n is from 0 to 5 and m is from 0 to 5, preferably n+m is from 0.5 to 4 and, n and m are from 0 to 4, more preferably n+m is from 1 to 4 and, n and m are from 0 to 4. The preferred R chains for use herein are the $C_8$ to $C_{22}$ alkyl chains. Examples of highly hydrophobic nonionic co-surfactants suitable for use herein are DOBANOL® 91-2.5 (HLB=8.1; R is a mixture of C9 and $C_{11}$ alkyl chains, n is 2.5 and m is 0) commercially available from SHELL, LUTENSOL® AO3 (HLB=8; R is a mixture of $C_{13}$ and $C_{15}$ alkyl chains, n is 3 and m is 0) commercially available from BASF; Neodol 23-3 (HLB=7.9; R is a mixture of $C_{12}$ and $C_{13}$ alkyl chains, n is 3 and m is 0) and TERGITOL® 25L3 (HLB=7.7; R is in the range of $C_{12}$ to $C_{15}$ alkyl chain length, n is 3 and m is 0) commercially available from UNION CARBIDE.

It is possible to use for each category of nonionic co-surfactants (highly hydrophilic or highly hydrophobic) either one of the nonionic co-surfactant belonging to said category or mixtures thereof.

The compositions according to the present invention may contain said highly hydrophilic nonionic co-surfactant in an amount of preferably at least 0.1%, more preferably of at least 0.5%, even more preferably of at least 2%, and said highly hydrophobic nonionic co-surfactant in an amount of preferably at least 0.1%, more preferably of at least 0.5%, even more preferably of at least 2%.

Optionally in the compositions according to the present invention, said highly hydrophilic and highly hydrophobic nonionic co-surfactants, when they are present, may be used in a weight ratio from one to another of from 0.1:1 to 1:0.1, preferably of from 1:0.2.

The hard surface cleaning compositions of the present invention may optionally comprise a nonionic co-surfactant having the formula $$CH_3(CH_2)_xCH_2O(CH_2CH_2O)_y\ H$$

wherein x is from about 6 to about 12, preferably from about 8 to about 10; y is from about 3.5 to about 10, preferably from about 4 to about 7. For the purposes of the present invention the index y refers to the average degree of ethoxylation obtained when contacting a suitable alcohol with a source of ethyleneoxy moieties, and therefore represents all fractional parts within the range 3.5 to 10.

Nonionic co-surfactants useful herein include any of the well-known nonionic co-surfactants that have an of from about 6 to about 18, preferably from about 8 to about 16, more preferably from about 8 to about 10. High HLB nonionic co-surfactants, when present, have an HLB preferably above about 12, more preferably above about 14, and even more preferably above about 15, and low HLB nonionic co-surfactants, when present, have an HLB of preferably below about 10, more preferably below about 9, and even more preferably below about 8.5. The difference between the high and low HLB values can preferably be at least about 4.

The nonionic co-surfactant can also be a peaked nonionic co-surfactants. A "peaked" nonionic cosurfactant is one in which at least about 70%, more preferably at least about 80%, more preferably about 90%, of the molecules, by weight, contain within two ethoxy groups (moieties) of the average number of ethoxy groups. Peaked nonionic co-surfactants have superior odor as compared to nonionic co-surfactants having a "normal" distribution in which only about 60% of the molecules contain within two ethoxy groups of the average number of ethoxy groups.

The HLB of the peaked short chain nonionic co-surfactants is typically from about 6 to about 18, preferably from about 8 to about 16, more preferably from about 8 to about 10, and, as before, mixed low and high HLB short chain peaked nonionic co-surfactants can, preferably should, differ in HLB by at least about 4. In the typical "peaked" distribution at least about 70%, preferably at least about 80%, and more preferably at least about 90%, but less than about 95%, of the nonionic co-surfactant contains a number of ethoxy moieties within two of the average number of ethoxy moieties.

Another possible nonionic co-surfactant is either an octyl polyethoxylate, or mixtures of octyl and decyl polyethoxylates with from about 0.1% to about 10%, preferably from about 1% to about 5%, of said octyl polyethoxylate. Another polyethoxylate is a mixture of $C_6$, $C_8$, and $C_{10}$ polyethoxylates containing from about 40% to about 80%, preferably from about 50% to about 70%, by weight ethoxy moieties in a peaked distribution. This latter polyethoxylate is especially desirable when the composition is to be used both at full strength and with dilution.

Typical of the more conventional nonionic co-surfactants useful herein are alkoxylated (especially ethoxylated) alcohols and alkyl phenols, and the like, which are well known from the detergency art. In general, such nonionic co-surfactants contain an alkyl group in the $C_{6-22}$, preferably $C_{6-10}$, more preferably all $C_8$ or mixtures of $C_{8-10}$, as discussed hereinbefore, and generally contain from about 2.5 to about 12, preferably from about 4 to about 10, more preferably from about 5 to about 8, ethylene oxide groups, to give an HLB of from about 8 to about 16, preferably from about 10 to about 14. Ethoxylated alcohols are especially preferred in the compositions of the present type.

Specific examples of nonionic co-surfactants useful herein include: octyl polyethoxylates (2.5) and (5); decyl polyethoxylates (2.5) and (5); decyl polyethoxylate (6); mixtures of said octyl and decyl polyethoxylates with at least about 10%, preferably at least about 30%, more preferably at least about 50%, of said octyl polyethoxylate; and coconut alkyl polyethoxylate (6.5). Peaked cut nionic co-surfactants include a $C_{8-10}E_5$ in which the approximate distribution of ethoxy groups, by weight, is 0=1.2; 1=0.9; 2=2.4; 3=6.3; 4=14.9; 5=20.9; 6=2.15; 7=16.4; 8=9.4; 9=4.1; 10=1.5; 11=0.5; and 12=0.1 and a $C_{8-10}E_7$ in which the approximate distribution of ethoxy groups, by weight, is 0=0.2; 1=0.2; 2=0.5; 3=1.5; 4=6.0; 5=10.2; 6=17.2; 7=20.9; 8=18.9; 9=13.0; 10=7.0; 11=3.0; 12=1.0; 13=0.3; and 14=0.1

A detailed listing of suitable nonionic co-surfactants, of the above types, for the detergent compositions herein can be found in U.S. Pat. No. 4,557,853, Collins, issued Dec. 10, 1985, incorporated by reference herein. Commercial sources of such co-surfactants can be found in McCutcheon's EMULSIFIERS AND DETERGENTS, North American Edition, 1997, McCutcheon Division, MC Publishing Company, also incorporated herein by reference.

Other suitable nonionic co-surfactants include those compounds produced by condensation of alkylene oxide groups (hydrophilic in nature) with an organic hydrophobic compound, which may be aliphatic or alkyl aromatic in nature.

Some nonionic co-surfactants useful in the hard surface cleaning compositions include the following:

(1) polyethylene oxide condensates of alkyl phenols, e.g., the condensation products of alkyl phenols having an alkyl group containing from about 6 to about 20 carbon atoms in either a straight chain or branched chain configuration, with ethylene oxide, the said ethylene oxide being present in amounts equal to from about 10 to about 60 moles of ethylene oxide per mole of alkyl phenol;

(2) those derived from the condensation of ethylene oxide with the product resulting from the reaction of propylene oxide and ethylene diamine products;

(3) condensation products of aliphatic alcohols having from about 8 to about 18 carbon atoms, in either straight chain or branched chain configuration, with ethylene oxide, e.g., a coconut alcohol ethylene oxide condensate having from about 10 to about 30 moles of ethylene oxide per mole of coconut alcohol, the coconut alcohol fraction having from about 10 to about 14 carbon atoms;

(4) long chain tertiary amine oxides of the formula $[R^1R^2R^3N\rightarrow O]$ where $R^1$ contains an alkyl, alkenyl or monohydroxy alkyl radical of from about 8 to about 18 carbon atoms, from 0 to about 10 ethylene oxide moieties, and from 0 to about 1 glyceryl moiety, and $R^2$ and $R^3$ contain from about 1 to about 3 carbon atoms and from 0 to about 1 hydroxy group, e.g., methyl, ethyl, propyl, hydroxyethyl, or hydroxypropyl radicals;

(5) long chain tertiary phosphine oxides of the formula [RR'R"P→O] where R contains an alkyl, alkenyl or monohydroxyalkyl radical ranging from about 8 to about 18 carbon atoms in chain length, from 0 to about 10 ethylene oxide moieties and from 0 to about 1 glyceryl moiety and R' and R" are each alkyl or monohydroxyalkyl groups containing from about 1 to about 3 carbon atoms;

(6) long chain dialkyl sulfoxides containing one short chain alkyl or hydroxy alkyl radical of from about 1 to about 3 carbon atoms (usually methyl) and one long hydrophobic chain which include alkyl, alkenyl, hydroxy alkyl, or keto alkyl radicals containing from about 8 to about 20 carbon atoms, from 0 to about 10 ethylene oxide moieties and from 0 to about 1 glyceryl moiety;

(7) alkyl polysaccharide (APS) co-surfactants (e.g. alkyl polyglycosides), examples of which are described in U.S. Pat. No. 4,585,647, which description is incorporated herein by reference, and which discloses APS co-surfactants having a hydrophobic group with about 6 to about 30 carbon atoms and polysaccharide (e.g., polyglycoside) as the hydrophilic group; optionally, there can be a polyalkylene-oxide group joining the hydrophobic and hydrophilic moieties; and the alkyl group (i.e., the hydrophobic moiety) can be saturated or unsaturated, branched or unbranched, and unsubstituted or substituted (e.g., with hydroxy or cyclic rings); and (8) polyethylene glycol (PEG) glyceryl fatty esters, such as those of the formula $R(O)OCH_2CH(OH)CH_2(OCH_2CH_2)_nOH$ wherein n is from about 5 to about 200, preferably from about 20 to about 100, and R is an aliphatic hydrocarbyl having from about 8 to about 20 carbon atoms.

Other suitable nonionic co-surfactants include other types of amine oxides corresponding to the formula:

$$RR'R''N\rightarrow O$$

wherein R is a primary alkyl group containing 6–24 carbons, preferably 10–18 carbons, and wherein R' and R" are, each, independently, an alkyl group containing 1 to 6 carbon atoms. The arrow in the formula is a conventional representation of a semi-polar bond. The preferred amine oxides are those in which the primary alkyl group has a straight chain in at least most of the molecules, generally at least 70%, preferably at least 90% of the molecules, and the amine oxides which are especially preferred are those in which R contains 10–18 carbons and R' and R" are both methyl. Exemplary of the preferred amine oxides are the N-hexyldimethylamine oxide, N-octyldimethylamine oxide, N-decyldimethylamine oxide, N-dodecyl dimethylamine oxide, N-tetradecyldimethylamine oxide, N-hexadecyl dimethylamine oxide, N-octadecyldimethylamine oxide, N-eicosyldimethylamine oxide, N-docosyldimethylamine oxide, N-tetracosyl dimethylamine oxide, the corresponding amine oxides in which one or both of the methyl groups are replaced with ethyl or 2-hydroxyethyl groups and mixtures thereof. A most preferred amine oxide for use herein is N-decyldimethylamine oxide.

Other suitable nonionic co-surfactants for the purpose of the invention are other phosphine or sulfoxide co-surfactants of formula:

$$RR'R''A\rightarrow O$$

wherein A is phosphorus or sulfur atom, R is a primary alkyl group containing 6–24 carbons, preferably 10–18 carbons, and wherein R' and R" are, each, independently selected from methyl, ethyl and 2-hydroxyethyl. The arrow in the formula is a conventional representation of a semi-polar bond.

Optionally the nonionic co-surfactant may be a suds controlling nonionic co-surfactant. The formula of these compounds is:

$$C_n(PO)_x(EO)_y(PO)_z,$$

in which $C_n$ represents a hydrophobic group, preferably a hydrocarbon group containing n carbon atoms, n is an integer from about 6 to about 12, preferably from about 6 to about 10; x is an integer from about 1 to about 6, preferably from about 2 to about 4; y is an integer from about 4 to 15, preferably from about 5 to about 12; z is an integer from about 4 to about 25, preferably from about 6 to about 20. These compounds are included in a suds regulating amount to provide good suds control while-maintaining good spotting/filming and rinsing characteristics. The preferable amount of this material, when it is present is from about 0.1% to about 5%, more preferably from about 0.5% to about 2%. These material can be used in addition to other nonionic co-surfactants or in addition to the nonionic form of the mid chain branched surfactant.

Examples of such materials are sold under the trade names Polytergent SLF18 and Polytergent SF18B.

iii) Cationic

The hard surface cleaning compositions of the present invention may also optionally contain a cationic co-surfactant. The amount of cationic co-surfactant, when present in the composition can be from about 0.001% to about 10%, preferably from about 0.1% to about 5%, more preferably 0.1% to about 2% by weight. Cationic co-surfactants suitable for use in hard surface cleaning compositions of the present invention include those having a long-chain hydrocarbyl group. Examples of such cationic co-surfactants include the ammonium co-surfactants such as alkyldimethylammonium halogenides, and those co-surfactants having the formula.

$$[R^2(OR^3)_y][R^4(OR^3)_y]_2R^5N^+X^-$$

wherein $R^2$ is an alkyl or alkyl benzyl group having from 8 to 18 carbon atoms in the alkyl chain, each $R^3$ is selected from the group consisting of $—CH_2CH_2—$, $—C_2CH(CH_3)—$, $—CH_2CH(CH_2OH)—$, $—CH_2CH_2CH_2—$, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, $—CH_2CHOH—CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Examples of suitable cationic co-surfactants are described in following documents, all of which are incorporated by reference herein in their entirety: M.C. Publishing Co., McCutcheon's, Detergents & Emulsifiers, (North American edition 1997); Schwartz, et al., Surface Active Agents, Their Chemistry and Technology, New York: Interscience Publishers, 1949; U.S. Pat. Nos. 3,155,591; 3,929,678; 3,959,461; 4,387,090 and 4,228,044.

Examples of suitable cationic co-surfactants are those corresponding to the general formula:

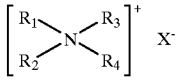

wherein $R_1$, $R_2$, $R_3$, and $R_4$ are independently selected from an aliphatic group of from 1 to about 22 carbon atoms or an aromatic, alkoxy, polyoxyalkylene, alkylamido, hydroxyalkyl, aryl or alkylaryl group having up to about 22 carbon atoms; and X is a salt-forming anion such as those selected from halogen, (e.g. chloride, bromide), acetate, citrate, lactate, glycolate, phosphate nitrate, sulfate, and alkylsulfate radicals. The aliphatic groups can contain, in addition to carbon and hydrogen atoms, ether linkages, and other groups such as amino groups. The longer chain aliphatic groups, e.g., those of about 12 carbons, or higher, can be saturated or unsaturated. Preferred is when $R_1$, $R_2$, $R_3$, and $R_4$ are independently selected from C1 to about C22 alkyl. Especially preferred are cationic materials containing two long alkyl chains and two short alkyl chains or those containing one long alkyl chain and three short alkyl chains. The long alkyl chains in the compounds described in the previous sentence have from about 12 to about 22 carbon atoms, preferably from about 16 to about 22 carbon atoms, and the short alkyl chains in the compounds described in the previous sentence have from 1 to about 3 carbon atoms, preferably from 1 to about 2 carbon atoms.

iv) Ampohteric;(Non-zwitterionic)

The hard surface cleaning compositions of the present invention may also optionally contain a amphoteric co-surfactant. The amount of amphoteric co-surfactant, when present in the composition can be from about 0.001% to about 10%, preferably from about 0.1% to about 5%, more preferably 0.1% to about 2% by weight. These co-surfactants are similar to the zwitterionic co-surfactants, but the surfactant characteristic of the co-surfactant changes with changes with changes in pH. At one pH it is cationic at another it is anionic.

Amphoteric and ampholytic co-surfactants which can be either cationic or anionic depending upon the pH of the system are represented by co-surfactants such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol", and described in U.S. Pat. No. 2,528,378, said patents being incorporated herein by reference.

Additional amphoteric co-surfactants and listings of their commercial sources can be found in McCutcheon's Detergents and Emulsifiers, North American Ed. 1997, incorporated herein by reference.

The hard surface cleaning compositions herein may optionally contain from about 0.001% to about 1%, preferably from about 0.01% to about 0.5%, more preferably from about 0.02% to about 0.2%, and even more preferably from about 0.03 to about 0.08%, of $C_{6-10}$ short chain amphocarboxylate co-surfactant. It has been found that these amphocarboxylate, and, especially glycinate, co-surfactants provide good cleaning with superior filming/streaking for hard surface cleaning compositions that are used to clean both glass and/or relatively hard-to-remove soils. Despite the chain, the detergency is good and the short chains provide improved filming/streaking, even as compared to most of the zwitterionic co-surfactants described hereinafter. Depending upon the level of cleaning desired and/or the amount of hydrophobic material in the composition that needs to be solubilized, one can either use only the amphocarboxylate co-surfactant, or can combine it with other co-surfactant, preferably zwitterionic co-surfactants.

The "champhocarboxylate" co-surfactants herein preferably have the generic formula:

$$RN(R^1)(CH_2)_nN(R^2)(CH_2)_pC(O)OM$$

wherein R is a $C_{6-10}$ hydrophobic moiety, typically a fatty acyl moiety containing from about 6 to about 10 carbon atoms which, in combination with the nitrogen atom forms an amido group, $R^1$ is hydrogen (preferably) or a $C_{1-2}$ alkyl group, $R^2$ is a $C_{1-3}$ alkyl or, substituted $C_{1-3}$ alkyl, e.g., hydroxy substituted or carboxy methoxy substituted, preferably, hydroxy ethyl, each n is an integer from 1 to 3, each p is an integer from 1 to 2, preferably 1, and each M is a water-soluble cation, typically an alkali metal, ammonium, and/or alkanolammonium cation. Such co-surfactants are available, for example: from Witco under the trade name Rewoteric AM-V®, having the formula $$C_7H_{15}C(O)NH(CH_2)_2N(CH_2CH_2OH)CH_2C(O)O^{(-)}Na^{(+)};$$

Mona Industries, under the treda name Monateric 1000®, having the formula $$C_7H_{15}C(O)NH(CH_2)_2N(CH_2CH_2OH)CH_2CH_2C(O)O^{(-)}Na^{(+)};$$

and Lonza under the trade name Amphoterge J-2®, having the formula $$C_{7,9}H_{15,19}C(O)NH(CH_2)_2N(CH_2CH_2OCH_2C(O)O^{(-)}Na^{(+}))CH_2C(O)O^{(-)}Na^{(+)}.$$

One suitable amphoteric co-surfactant is a $C_{8-14}$ amidoalkylene glycinate co-surfactant. These co-surfactants are essentially cationic at the acid pH.

The glycinate co-surfactants herein preferably have the generic formula, as an acid, of:

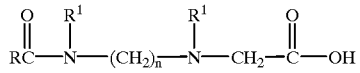

wherein

RC(O) is a $C_{8-14}$, preferably $C_{8-10}$, hydrophobic fatty acyl moiety containing from about 8 to about 14, preferably from about 8 to about 10, carbon atoms which, in combination with the nitrogen atom, forms an amido group, each n is from 1 to 3, and each $R^1$ is hydrogen (preferably) or a $C_{1-2}$ alkyl or hydroxy alkyl group. Such co-surfactants are available, e.g., in the salt form, for example, from Sherex under the trade name Rewoteric AM-V, having the formula:

$$C_7C(O)NH(CH_2)_2N(CH_2CH_2OH)CH_2C(O)O^{(-)}Na^{(+)}.$$

Not all amphoteric co-surfactants are preferred. Longer chain glycinates and similar substituted amino propionates provide a much lower level of cleaning. Such propionates are available as, e.g., salts from Mona Industries, under the trade name Monateric 1000, having the formula:

$C_7C(O)NH(CH_2)_2N(CH_2CH_2OH)CH_2CH_2C(O)O^{(-)}Na^{(+)}$.

Cocoyl amido ethyleneamine-N-(hydroxyethyl)-2-hydroxypropyl-1-sulfonate (Miranol CS); $C_{8-10}$ fatty acyl amidoethyleneamine-N-(methyl)ethyl sulfonate; and analogs and homologs thereof, as their water-soluble salts, or acids, are amphoterics that provide good cleaning. Optionally, these amphoterics may be combined with short chain nonionic co-surfactants to minimize sudsing.

Examples of other suitable amphoteric (non-zwitterionic) co-surfactants include:

cocoylamido ethyleneamine-N-(methyl)-acetates;

cocoylamido ethyleneamine-N-(hydroxyethyl)-acetates;

cocoylamido propyl amine-N-(hydroxyethyl)-acetates; and analogs and homologs thereof, as their water-soluble salts, or acids, are suitable.

Amphoteric co-surfactants suitable for use in the hard surface cleaning compositions include the derivatives of aliphatic secondary and tertiary amines in which the aliphatic radical is straight or branched and one of the aliphatic substituents contains from about 8 to about 18 carbon atoms and one contains an anionic water solubilizing group, e.g., carboxy, sulfonate, sulfate, phosphate, or phosphonate.

v) Zwitterionic

The level of zwitterionic co-surfactant, when present in the composition, is typically from about 0.001% to about 10%, preferably from about 0.01% to about 6%, more preferably from about 1% to about 5%.

Some suitable zwitterionic co-surfactants which can be used herein comprise the betaine and betaine-like co-surfactants wherein the molecule contains both basic and acidic groups which form an inner salt giving the molecule both cationic and anionic hydrophilic groups over a broad range of pH values. Some common examples of these are described in U.S. Pat. Nos. 2,082,275, 2,702,279 and 2,255,082, incorporated herein by reference. One of the preferred zwitterionic compounds have the formula

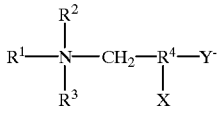

wherein R1 is an alkyl radical containing from 8 to 22 carbon atoms, R2 and R3 contain from 1 to 3 carbon atoms, R4 is an alkylene chain containing from 1 to 3 carbon atoms, X is selected from the group consisting of hydrogen and a hydroxyl radical, Y is selected from the group consisting of carboxyl and sulfonyl radicals and wherein the sum of R1, R2 and R3 radicals is from 14 to 24 carbon atoms.

Zwitterionic co-surfactants, as mentioned hereinbefore, contain both a cationic group and an anionic group and are in substantial electrical neutrality where the number of anionic charges and cationic charges on the co-surfactant molecule are substantially the same. Zwitterionics, which typically contain both a quaternary ammonium group and an anionic group selected from sulfonate and carboxylate groups are desirable since they maintain their amphoteric character over most of the pH range of interest for cleaning hard surfaces. The sulfonate group is the preferred anionic group.

Preferred zwitterionic co-surfactants have the generic formula:

$$R^3—[C(O)—N(R^4)—(CR^5{}_2)_n1]_mN(R^6)_2{}^{(+)}—(CR^5{}_2)_p1—Y^{(-)}$$

wherein each Y is preferably a carboxylate ($COO^-$) or sulfonate ($SO_3^-$) group, more referably sulfonate; wherein each $R^3$ is a hydrocarbon, e.g., an alkyl, or alkylene, group containing from about 8 to about 20, preferably from about 10 to about 18, more preferably from about 12 to about 16 carbon atoms; wherein each ($R^4$) is either hydrogen, or a short chain alkyl, or substituted alkyl, containing from one to about four carbon atoms, preferably groups selected from the group consisting of methyl, ethyl, propyl, hydroxy substituted ethyl or propyl and mixtures thereof, preferably methyl; wherein each ($R^5$) is selected from the group consisting of hydrogen and hydroxy groups with no more than one hydroxy group in any $(CR^5{}_2)p^1$ group; wherein ($R^6$) is like $R^4$ except preferably not hydrogen; wherein m is 0 or 1; and wherein each $n^1$ and $p^1$ are an integer from 1 to about 4, preferably from 2 to about 3, more preferably about 3. The $R^3$ groups can be branched, unsaturated, or both and such structures can provide filming/streaking benefits, even when used as part of a mixture with straight chain alkyl $R^3$ groups. The $R^4$ groups can also be connected to form ring structures such as imidazoline, pyridine, etc. Preferred hydrocarbyl amidoalkylene sulfobetaine (HASB) co-surfactants wherein m=1 and Y is a sulfonate group provide superior grease soil removal and/or filming/streaking and/or "anti-fogging" and/or perfume solubilization properties. Such hydrocarbylamidoalkylene sulfobetaines, and, to a lesser extent hydrocarbylamidoalkylene betaines are excellent for use in hard surface cleaning compositions, especially those formulated for use on both glass and hard-to-remove soils. They are even better when used with monoethanolamine and/or specific beta-amino alkanol as disclosed herein.

A specific co-surfactant is a $C_{10-14}$ fatty acylamidopropylene(hydroxypropylene)sulfobetaine, e.g., the co-surfactant available from the Witco Company as a 40% active product under the trade name "REWOTERIC AM CAS Sulfobetaine®."

When the zwitterionic co-surfactant is a HASB, it is preferably in the from about 0.02% to about 15%, more preferably from about 0.05% to about 10%. The level in the composition is dependent on the eventual level of dilution to make the wash solution. For glass cleaning, the composition, when used full strength, or wash solution containing the composition, should preferably contain from about 0.02% to about 1%, more preferably from about 0.05% to about 0.5%, more preferably from about 0.05% to about 0.25%, of co-surfactant. For removal of difficult to remove soils like grease, the level can, and should be, higher, preferably from about 0.1% to about 10%, more preferably from about 0.25% to about 2%. Concentrated products will preferably contain from about 0.2% to about 10%, more preferably from about 0.3% to about 5%. It is an advantage of the HASB zwitterionic co-surfactants that compositions containing it can be more readily diluted by consumers since it does not interact with hardness cations as readily as conventional anionic co-surfactants. Zwitterionic co-surfactants are also extremely effective at very low levels, e.g., below about 1%.

Other zwitterionic co-surfactants are set forth at Col. 4 of U.S. Pat. No. 4,287,080, Siklosi, incorporated herein by reference. Another detailed listing of suitable zwitterionic co-surfactants for the compositions herein can be found in U.S. Pat. No. 4,557,853, Collins, issued Dec. 10, 1985, incorporated by reference herein. commercial sources of such co-surfactants can be found in McCutcheon's EMULSIFIERS AND DETERGENTS, North American Edition, 1997, McCutcheon Division, MC Publishing Company, also incorporated herein by reference.

Another preferred zwitterionic co-surfactants is:

$$R—N^{(+)}(R^2)(R^3)R^4X^{(-)}$$

wherein R is a hydrophobic group; $R^2$ and $R^3$ are each $C_{1-4}$ alkyl, hydroxy alkyl or other substituted alkyl group which can also be joined to form ring structures with the N; $R^4$ is a moiety joining the cationic nitrogen atom to the hydrophilic group and is typically an alkylene, hydroxy alkylene, or polyalkoxy group containing from about one to about four carbon atoms; and X is the hydrophilic group which is preferably a carboxylate or sulfonate group.

Preferred hydrophobic groups R are alkyl groups containing from about 8 to about 22, preferably less than about 18, more preferably less than about 16, carbon atoms. The hydrophobic group can contain unsaturation and/or substituents and/or linking groups such as aryl groups, amido groups, ester groups, etc. In general, the simple alkyl groups are preferred for cost and stability reasons.

A specific "simple" zwitterionic co-surfactant is 3-(N-dodecyl-N,N-dimethyl)-2-hydroxy-propane-1-sulfonate, available from the Sherex Company under the trade name "Varion HC."

Other specific zwitterionic co-surfactants have the generic formula:

$$R—C(O)—N(R^2)—(CR^3{}_2)_n—N(R^2)_2{}^{(+)}—(CR^3{}_2)_n—SO_2{}^{(-)}$$

wherein each R is a hydrocarbon, e.g., an alkyl group containing from about 8 up to about 20, preferably up to about 18, more preferably up to about 16 carbon atoms, each ($R^2$) is either a hydrogen (when attached to the amido nitrogen), short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3{}_2$) moiety. The R groups can be branched and/or unsaturated, and such structures can provide spotting/filming benefits, even when used as part of a mixture with straight chain alkyl R groups. The $R^2$ groups can also be connected to form ring structures. A co-surfactant of this type is a $C_{10-14}$ fatty acylamidopropylene(hydroxypropylene)sulfobetaine that is available from the Sherex Company under the trade name "Varion CAS Sulfobetaine".

Other zwitterionic co-surfactants useful, and, surprisingly, preferred, herein include hydrocarbyl, e.g., fatty, amidoalkylenebetaines (hereinafter also referred to as "HAB"). These co-surfactants, which are more cationic at the pH of the Composition, have the generic formula:

$$R—C(O)—N(R^2)—(CR^3{}_2)_n—N(R^2)_2{}^{(+)}—(CR^3{}_2)_n—C(O)O^{(-)}$$

wherein each R is a hydrocarbon, e.g., an alkyl group containing from about 8 up to about 20, preferably up to about 18, more preferably up to about 16 carbon atoms, each ($R^2$) is either a hydrogen (when attached to the amido nitrogen), short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3{}_2$) moiety. The R groups can be branched and/or unsaturated, and such structures can provide spotting/filming benefits, even when used as part of a mixture with straight chain alkyl R groups.

An example of such a co-surfactant is a $C_{10-14}$ fatty acylamidopropylenebetaine available from the Miranol Company under the trade name "Mirataine CB."

c) Builders

The level of builder can vary widely depending upon the end use of the composition and its desired physical form. When present, the compositions will preferably comprise from about 0.001% to about 10%, more preferably 0.01% to about 7%, even more preferably 0.1% to about 5% by weight of the composition of a builder.

Detergent builders that are efficient for hard surface cleaners and have reduced filming/streaking characteristics at the critical levels can also be present in the compositions of the invention. Addition of specific detergent builders at critical levels to the present composition further improves cleaning without the problem of filming/streaking that usually occurs when detergent builders are added to hard surface cleaners. There is no need to make a compromise between improved cleaning and acceptable filming/streaking results, which is especially important for hard surface cleaners which are also directed at cleaning glass. These compositions containing these specific additional detergent builders have exceptionally good cleaning properties. They also have exceptionally good shine properties, i.e., when used to clean glossy surfaces, without rinsing, they have much less tendency than, e.g., carbonate built products to leave a dull finish on the surface and filning/streking.

Builders can optionally be included in the compositions herein to assist in controlling mineral hardness. Preferable are builders that have reduced filming/streaking characteristics at the critical levels of the compositions of the present invention.

Suitable builders for use herein include nitrilotriacetates (NTA), polycarboxylates, citrates, water-soluble phosphates such as tri-polyphosphate and sodium ortho-and pyro-phosphates, silicates, ethylene diamine tetraacetate (EDTA), amino-polyphosphonates (DEQUEST), ether carboxylate builders such as in EP-A-286 167, phosphates, iminodiacetic acid derivatives such as described in EP-A-317 542, EP-262 112 and EP-A-399 133, and mixtures thereof. Other suitable optional detergent builders include salts of sodium carboxymethylsuccinic acid, sodium N-(2-hydroxy-propyl)-iminodiacetic acid, and N-diethyleneglycol-N,N-diacetic acid (hereinafter DIDA). The salts are preferably compatible and include ammonium, sodium, potassium and/or alkanolammonium salts. The alkanolammonium salt is preferred as described hereinafter. A one possible builder are the mixtures citric acid/acetate and bicarbonate/carbonate, more preferred bicarbonate/carbonate.

Suitable builders for use herein include polycarboxylates and polyphosphates, and salts thereof.

Suitable and preferred polycarboxylates for use herein are organic polycarboxylates where the highest LogKa, measured at 25° C./0.1M ionic strength is between 3 and 8, wherein the sum of the LogKCa+LogKMg, measured at 25° C./0.1M ionic strength is higher than 4, and wherein LogKCa=LogKMg±2 units, measured at 25° C./0.1M ionic strength.

Such suitable and preferred polycarboxylates include citrate and complexes of the formula

CH(A)(COOX)—CH(COOX)—O—CH(COOX)—CH(COOX)(B)

wherein A is H or OH; B is H or —O—CH(COOX)—$CH_2$(COOX); and X is H or a salt-forming cation. For example, if in the above general formula A and B are both H, then the compound is oxydissuccinic acid and its water-soluble salts. If A is OH and B is H, then the compound is tartrate monosuccinic acid (TMS) and its water-soluble salts. If A is H and B is —O—CH(COOX)—$CH_2$(COOX), then the compound is tartrate disuccinic acid (TDS) and its water-soluble salts. Mixtures of these builders are especially preferred for use herein. Particularly TMS to TDS, these builders are disclosed in U.S. Pat. No. 4,663,071, issued to Bush et al., on May 5, 1987.

Still other ether polycarboxylates suitable for use herein include copolymers of maleic anhydride with ethylene or vinyl methyl ether, 1,3,5-trihydroxy benzene-2,4,6-trisulfonic acid, and carboxymethyloxysuccinic acid.

Other useful polycarboxylate builders include the ether hydroxypolycarboxylates represented by the structure:

H0-[C(R)(COOM)—C(R)(COOM)—O]$_n$—H wherein M is hydrogen or a cation wherein the resultant salt is water-soluble, preferably an alkali metal, ammonium or substituted ammonium cation, n is from about 2 to about 15 (preferably n is from about 2 to about 10, more preferably n averages from about 2 to about 4) and each R is the same or different and selected from hydrogen, $C_{1-4}$ alkyl or $C_{1-4}$ substituted alkyl (preferably R is hydrogen).

Suitable ether polycarboxylates also include cyclic compounds, particularly alicyclic compounds, such as those described in U.S. Pat. Nos. 3,923,679; 3,835,163; 4,120,874 and 4,102,903, all of which are incorporated herein by reference.

Preferred amongst those cyclic compounds are dipicolinic acid and chelidanic acid.

Also suitable polycarboxylates for use herein are mellitic acid, succinic acid, polymaleic acid, benzene 1,3,5-tricarboxylic acid, benzene pentacarboxylic acid, and carboxymethyloxysuccinic acid, and soluble salts thereof.

Still suitable carboxylate builders herein include the carboxylated carbohydrates disclosed in U.S. Pat. No. 3,723,322, Diehl, issued Mar. 28, 1973, incorporated herein by reference.

Other suitable carboxylates for use herein are alkali metal, ammonium and substituted ammonium salts of polyacetic acids. Examples of polyacetic acid builder salts are sodium, potassium, lithium, ammonium and substituted ammonium salts of ethylenediamine, tetraacetic acid and nitrilotriacetic acid.

Other suitable polycarboxylates are those also known as alkyliminoacetic builders such as methyl imino diacetic acid, alanine diacetic acid, methyl glycine diacetic acid, hydroxy propylene imino diacetic acid and other alkyl imino acetic acid builders.

Polycarboxylate detergent builders useful herein, include the builders disclosed in U.S. Pat. No. 4,915,854, Mao et al., issued Apr. 10, 1990, said patent being incorporated herein by reference.

Also suitable for use in the hard surface cleaning compositions of the present invention are the 3,3-dicarboxy-4-oxa-1,6-hexanediotes and the related compounds disclosed in U.S. Pat. No. 4,566,984, Bush, issued Jan. 28, 1986, incorporated herein by reference. Useful succinic acid builders include the C5–C20 alkyl succinic acids and salts thereof. A particularly preferred compound of this type is dodecenylsuccinic acid. Alkyl succinic acids typically are of the general formula R—CH(COOH)$CH_2$(COOH) i.e., derivatives of succinic acid, wherein R is hydrocarbon, e.g., $C_{10}$–$C_{20}$ alkyl or alkenyl, preferably $C_{12}$–$C_{16}$ or wherein R may be substituted with hydroxyl, sulfo, sulfoxy or sulfone substituents, all as described in the above-mentioned patents. The succinate builders are preferably used in the form of their water-soluble salts, including the sodium, potassium, ammonium and alkanolammonium salts. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0 200 263, published Nov. 5, 1986.

Examples of useful builders also include sodium and potassium carboxymethyloxymalonate, carboxymethyloxysuccinate, cis-cyclohexanehexacarboxylate, cis-cyclopentane-tetracarboxylate, water-soluble polyacrylates and the copolymers of maleic anhydride with vinyl methyl ether or ethylene.

Other suitable polycarboxylates are the polyacetal carboxylates disclosed in U.S. Pat. No. 4,144,226, Crutchfield et al., issued Mar. 13, 1979, incorporated herein by reference. These polyacetal carboxylates can be prepared by bringing together, under polymerization conditions, an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Polycarboxylate builders are also disclosed in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Suitable polyphosphonates for use herein are the alkali metal, ammonium and alkanolammonium salts of polyphosphates (exemplified by the tripolyphosphates, pyrophosphates, and glassy polymeric meta-phosphates), phosphonates. The most preferred builder for use herein is citrate.

Some suitable carbonate builders for use herein are according to the formula $X_2CO_3$ or $XHCO_3$ where X is a suitable counterion, typically $K^+$, $Na^+$ $NH_4^+$. Suitable polyphosphates for use herein include compounds of formula $X_aH_bPO4$, where a and b are integers such that a+b=3, and a or b can be 0, or $X_aH_bP_3O_{10}$ where a and b are such that a+b=5, and a or b can be 0, and where X is a suitable counterion, particularly $K^+$, $Na^+$ or $NH4^+$.

One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987.

Other useful builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance due to their availability from renewable resources and their biodegradability. Oxydisuccinates are also especially useful in the compositions and combinations of the present invention.

A preferred polycarboxylate builder is iminodisuccinate. Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Other suitable builders include dicarboxylic acids having from about 2 to about 14, preferably from about 2 to about 4, carbon atoms between the carboxyl groups. Specific dicarboxylic detergent builders include succinic, glutaric, and adipic acids, and mixtures thereof. Such acids have a $pK_1$ of more than about 3 and have relatively high calcium salt solubilities. Substituted acids having similar properties can also be used.

These dicarboxylic detergent builders provide faster removal of the hard water soils, especially when the pH is between about 2 and about 4.

Other suitable builders that can be used include: citric acid, and, especially, builders having the generic formula:

$$R^5—[O—CH(COOH)CH(COOH)]_nR^5$$

wherein each $R^5$ is selected from the group consisting of H and OH and n is a number from about 2 to about 3 on the average. Other preferred detergent builders include those described in the U.S. Pat. No. 5,051,212, Culshaw and Vos, issued Sep. 24, 1991, for "Hard-Surface Cleaning Compositions," said patent being incorporated herein by reference.

In addition to the above detergent builders, other detergent builders that are relatively efficient for hard surface cleaners and/or, preferably, have relatively reduced filming/streaking characteristics include the acid forms of those disclosed in U.S. Pat. No. 4,769,172, Siklosi, issued Sep. 6, 1988, and incorporated herein by reference. Still others include the chelating agents having the formula:

$$R—N(CH_2COOM)_2$$

wherein R is selected from the group consisting of: $—CH_2CH_2CH_2OH$; $—CH_2CH(OH)CH_2$; $—CH_2CH(OH)CH_2OH$; $—CH(CH_2OH)_2$; $—CH_3$; $—CH_2CH_2OCH_3$; $—C(O)—CH_3$; $—CH_2—C(O)—NH_3$; $—CH_2CH_2CH_2OCH_3$; $—C(CH_2OH)_3$; and mixtures thereof; wherein each M is hydrogen.

When it is desired that the hard surface cleaning composition be acidic, i.e. pH<7, and acidic builder can be used to provide the desired pH in use. However, if necessary, the composition can also contain additional buffering materials to give a pH in use of from about 1 to about 5.5, preferably from about 2 to about 4.5, more preferably from about 2 to about 4. pH is usually measured on the product. The buffer is selected from the group consisting of: mineral acids such as HCl, $HNO_3$, etc. and organic acids such as acetic, etc., and mixtures thereof. The buffering material in the system is important for spotting/filming. Preferably, the compositions are substantially, or completely free of materials like oxalic acid that are typically used to provide cleaning, but which are not desirable from a safety standpoint in compositions that are to be used in the home, especially when very young children are present.

Divalent Metal Ions

The hard surface cleaning compositions may additionally contain positive divalent ions in amounts so as to saturate the builder present in the composition. This "saturation" is preferably used in hard surface cleaning compositions when the hard surface to be cleaned is a delicate surface, namely marble or lacquerd wood. See copending application Ser. No. 08/981,315, filed May 16, 1996 all of which is incorporated herein by reference. By "saturate", it is meant herein that there should be enough ions to bind substantially all the builder present in the composition, i.e. at least 75% of the builder, preferably at least 80%, most preferably at least 90% or all of the builder. Thus, for a 100% saturation, the ions should be present most preferably in a molar ratio of builder ions to builder of at least X:2, where X is the maximum potential number of negative charges carried per mole of builder. For instance, if said builder is citrate, then said molar ratio should be at least 3:2, because each mole of citrate can carry 3 negative changes. For the purpose of the present invention and the amount of ions needed therein, the form in which the carboxylate or phosphate groups in the builder are present is not critical. In other words, at certain pH values between 6 to 8 where some of the carboxylate or phosphate groups in the builder are in their protonated form, the preferred X:2 ratio still applies.

The ions can be introduced in the compositions in any form. As far as Mg is concerned, $MgCl_2$ has been found to be commercially attractive. However $MgSO_4$, Mg Phosphates and $MgNO_3$ are also suitable source of Mg ions for the compositions herein. Without wishing to be bound by theory, we speculate that the ions herein somehow prevent the builder from binding with the calcium in the marble, without preventing the builder from performing in the cleaning operation.

Suitable positive divalent ions for use herein include $Mg^{2+}$, $Ba^{2+}$, $Fe^{2+}$, $Ca^{2+}$, $Zn^{2+}$ and $Ni^{2+}$. Most Preferred are $Mg^{2+}$ and $Ca^{2+}$, or mixtures thereof.

d) Co-solvents

Optionally, the compositions of the present invention further comprise one or more co-solvents. The level of co-solvent, when present in the composition, is typically from about 0.001% to about 30%, preferably from about 0.01% to about 10%, more preferably from about 1% to about 5%. Co-solvents are broadly defined as compounds that are liquid at temperatures of 20° C.–25° C. and which are not considered to be surfactants. One of the distinguishing features is that co-solvents tend to exist as discrete entities rather than as broad mixtures of compounds. Some co-solvents which are useful in the hard surface cleaning compositions of the present invention contain from about 1 carbon atom to about 35 carbon atoms, and contain contiguous linear, branched or cyclic hydrocarbon moieties of no more than about 8 carbon atoms. Examples of suitable co-solvents for the present invention include, methanol, ethanol, propanol, isopropanol, 2-methyl pyrrolidinone, benzyl alcohol and morpholine n-oxide. Preferred among these co-solvents are methanol and isopropanol.

The compositions herein may additionally contain an alcohol having a hydrocarbon chain comprising 8 to 18 carbon atoms, preferably 12 to 16. The hydrocarbon chain can be branched or linear, and can be mono, di or polyalcohols.

The co-solvents which can be used herein include all those known to the those skilled in the art of hard-surfaces cleaner compositions. Suitable co-solvents for use herein include ethers and diethers having from 4 to 14 carbon atoms, preferably from 6 to 12 carbon atoms, and more preferably from 8 to 10 carbon atoms, glycols or alkoxylated glycols, alkoxylated aromatic alcohols, aromatic alcohols, aliphatic branched alcohols, alkoxylated aliphatic branched alcohols, alkoxylated linear C1–C5 alcohols, linear C1–C5 alcohols, C8–C14 alkyl and cycloalkyl hydrocarbons and halohydrocarbons, C6–C16 glycol ethers and mixtures thereof.

Suitable glycols which can be used herein are according to the formula HO—CR1R2—OH wherein R1 and R2 are independently H or a C2–C10 saturated or unsaturated aliphatic hydrocarbon chain and/or cyclic. Suitable glycols to be used herein are dodecaneglycol and/or propanediol.

Suitable alkoxylated glycols which can be used herein are according to the formula R—(A)n-R1—OH wherein R is H, OH, a linear saturated or unsaturated alkyl of from 1 to 20 carbon atoms, preferably from 2 to 15 and more preferably from 2 to 10, wherein R1 is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable alkoxylated aromatic alcohols which can be used herein are according to the formula R $(A)_n$—OH wherein R is an alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable alkoxylated aromatic alcohols are benzoxyethanol and/or benzoxypropanol.

Suitable aromatic alcohols which can be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable aliphatic branched alcohols which can be used herein are according to the formula R—OH wherein R is a branched saturated or unsaturated alkyl group of from 1 to 20 carbon atoms, preferably from 2 to 15 and more preferably from 5 to 12. Particularly suitable aliphatic branched alcohols to be used herein include 2-ethylbutanol and/or 2-methylbutanol.

Suitable alkoxylated aliphatic branched alcohols which can be used herein are according to the formula R $(A)_n$—OH wherein R is a branched saturated or unsaturated alkyl group of from 1 to 20 carbon atoms, preferably from 2 to 15 and more preferably from 5 to 12, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol.

Hydrophobic Co-solvent

Hydrophobic co-solvents are preferably used, when present in the composition, at a level of from about 0.5% to about 30%, more preferably from about 1% to about 15%, even more preferably from about 2% to about 5%.

In order to improve cleaning in liquid compositions, one can use a hydrophobic co-solvent that has cleaning activity. The hydrophobic co-solvents which may be employed in the hard surface cleaning compositions herein can be any of the well-known "degreasing" co-solvents commonly used in, for example, the dry cleaning industry, in the hard surface cleaner industry and the metalworking industry.

A useful definition of such co-solvents can be derived from the solubility parameters as set forth in "The Hoy," a publication of Union Carbide, incorporated herein by reference. The most useful parameter appears to be the hydrogen bonding parameter which is calculated by the formula:

$$\gamma H = \gamma T\left[\frac{a-1}{a}\right]^{1/2}$$

wherein γH is the hydrogen bonding parameter, a is the aggregation number, (Log $\alpha$=3.39066 $T_b/T_c$−15848−Log $M_d$), and γT is the solubility parameter which is obtained from the formula:

$$\gamma T = \left[\frac{(\Delta H_{25} - RT)d}{M}\right]^{1/2}$$

where $\Delta H_{25}$ is the heat of vaporization at 25° C., R is the gas constant (1.987 cal/mole/deg), T is the absolute temperature in ° K, $T_b$ is the boiling point in ° K, $T_c$ is the critical temperature in ° K, d is the density in g/ml, and M is the molecular weight.

For the compositions herein, hydrogen bonding parameters are preferably less than about 7.7, more preferably from about 2 to about 7, or 7.7, and even more preferably from about 3 to about 6. Co-solvents with lower numbers become increasingly difficult to solubilize in the compositions and have a greater tendency to cause a haze on glass. Higher numbers require more co-solvent to provide good greasy/oily soil cleaning.

Many of such co-solvents comprise hydrocarbon or halogenated hydrocarbon moieties of the alkyl or cycloalkyl type, and have a boiling point well above room temperature, i.e., above about 20° C.

The formulator of compositions of the present type will be guided in the selection of cosolvent partly by the need to provide good grease-cutting properties, and partly by aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would be more likely to select co-solvents which have a relatively pleasant odor, or odors which can be reasonably modified by perfuming.

The $C_6$–$C_9$ alkyl aromatic co-solvents, especially the $C_6$–$C_9$ alkyl benzenes, preferably octyl benzene, exhibit excellent grease removal properties and have a low, pleasant odor. Likewise, the olefin co-solvents having a boiling point of at least about 100° C., especially alpha-olefins, preferably 1-decene or 1-dodecene, are excellent grease removal co-solvents.

Generically, glycol ethers useful herein have the formula $R^{11}$ O—($R^{12}$O—)$_m$1H wherein each $R^{11}$ is an alkyl group which contains from about 3 to about 8 carbon atoms, each $R^{12}$ is either ethylene, propylene or butylene, and $m^1$ is a number from 1 to about 3. The most preferred glycol ethers are selected from the group consisting of monopropyleneglycolmonopropyl ether, dipropyleneglycolmonobutyl ether, monopropyleneglycolmonobutyl ether, ethyleneglycolmonohexyl ether, ethyleneglycolmonobutyl ether, diethyleneglycolmonohexyl ether, monoethyleneglycolmonohexyl ether, monoethyleneglycolmonobutyl ether, and mixtures thereof. Some other suitable examples include, Ethylene glycol and propylene glycol ethers are commercially available from the Dow Chemical Company under the tradename "Dowanol" and from the Arco Chemical Company under the tradename "Arcosolv". Other suitable co-solvents including mono- and di-ethylene glycol n-hexyl ether are available from the Union Carbide company.

A particularly preferred type of co-solvent for these hard surface cleaner compositions comprises diols having from 6 to about 16 carbon atoms in their molecular structure. Preferred diol co-solvents have a solubility in water of from about 0.1 to about 20 g/100 g of water at 20° C. The diol co-solvents in addition to good grease cutting ability, impart to the compositions an enhanced ability to remove calcium soap soils from surfaces such as bathtub and shower stall walls. These soils are particularly difficult to remove, especially for compositions which do not contain an abrasive. Other co-solvents such as benzyl alcohol, n-hexanol, and phthalic acid esters of $C_{1-4}$ alcohols can also be used.

Co-solvents such as pine oil, orange terpene, benzyl alcohol, n-hexanol, phthalic acid esters of $C_{1-4}$ alcohols, butoxy propanol, Butyl Carbitol® and 1-(2-n-butoxy-1-methylethoxy)propane-2-ol (also called butoxy propoxy propanol or dipropylene glycol monobutyl ether), hexyl diglycol (Hexyl Carbitol®), butyl triglycol, diols such as 2,2,4-trimethyl-1,3-pentanediol, and mixtures thereof, can be used. The butoxy-propanol co-solvent should have no more than about 20%, preferably no more than about 10%, more preferably no more than about 7%, of the secondary isomer in which the butoxy group is attached to the secondary atom of the propanol for improved odor.

e) Polymeric Additives

The hard surface cleaning compositions of the present invention may comprise from about 0.001% to about 20%, preferably from about 0.01% to about 10%, more preferably from about 0.1% to about 5%, and even more preferably from about 0.1% to about 3% of a polymeric additive. Suitable polymeric additives include:

1) polyalkoxylene glycol;

2) PVP homopolymers or copolymers thereof;

3) polycarboxylate;

4) sulfonated polystyrene polymer; and 5) mixtures thereof.

1) Polyalkoxylene Glycol

The hard surface cleaning compositions according to the present invention may contain an antiresoiling agent selected from the group consisting of polyalkoxylene glycol, mono- and dicapped polyalkoxylene glycol and a mixture thereof, as defined herein after. The compositions of the present invention may comprise from 0.001% to 20% by weight of the total composition of said antiresoiling agent or a mixture thereof, preferably from 0.01% to 10%, more preferably from 0.1% to 5% and most preferably from 0.2% to 2% by weight, when such an agent is present in the hard surface cleaning composition.

Suitable polyalkoxylene glycols which can be used herein have the following formula $H—O—(CH_2—CHR_2O)_n—H$.

Suitable monocapped polyalkoxylene glycols which can be used herein have the following formula $R_1—O—(CH_2—CHR_2O)_n—H$.

Suitable dicapped polyalkoxylene glycols which can be used herein are according to the formula $R_1—O—(CH_2—CHR_2O)_n—R_3$.

In these formulas of polyalkoxylene glycols, mono and dicapped polyalkoxylene glycols, the substituents $R_1$ and $R_3$ each independently are substituted or unsubstituted, saturated or unsaturated, linear or branched hydrocarbon chains having from 1 to 30 carbon atoms, or amino bearing linear or branched, substituted or unsubstituted hydrocarbon chains having from 1 to 30 carbon atoms, $R_2$ is hydrogen or a linear or branched hydrocarbon chain having from 1 to 30 carbon atoms, and n is an integer greater than 0.

Preferably $R_1$ and $R_3$ each independently are substituted or unsubstituted, saturated or unsaturated, linear or branched alkyl groups, alkenyl groups or aryl groups having from 1 to 30 carbon atoms, preferably from 1 to 16, more preferably from 1 to 8 and most preferably from 1 to 4, or amino bearing linear or branched, substituted or unsubstituted alkyl groups, alkenyl groups or aryl groups having from 1 to 30 carbon atoms, more preferably from 1 to 16, even more preferably from 1 to 8 and most preferably from 1 to 4. Preferably $R_2$ is hydrogen, or a linear or branched alkyl group, alkenyl group or aryl group having from 1 to 30 carbon atoms, more preferably from 1 to 16, even more preferably from 1 to 8, and most preferably $R_2$ is methyl, or hydrogen. Preferably n is an integer from 5 to 1000, more preferably from 10 to 100, even more preferably from 20 to 60 and most preferably from 30 to 50.

The preferred polyalkoxylene glycols, mono and dicapped polyalkoxylene glycols which can be used in the present hard surface cleaning compositions have a molecular weight of at least 200, more preferably from 400 to 5000 and most preferably from 800 to 3000.

Suitable monocapped polyalkoxylene glycols which can be used herein include 2-aminopropyl polyethylene glycol (MW 2000), methyl polyethylene glycol (MW 1800) and the like. Such monocapped polyalkoxylene glycols may be commercially available from Hoescht under the polyglycol series or Hunstman under the tradename XTJ®. Preferred polyalkoxylene glycols are polyethylene glycols like polyethylene glycol (MW 2000).

Optionally the antiresoiling agent is a dicapped polyalkoxylene glycol as defined herein or a mixture thereof. Suitable dicapped polyalkoxylene glycols which can be used herein include O,O'-bis(2-aminopropyl)polyethylene glycol (MW 2000), O,O'-bis(2-aminopropyl)polyethylene glycol (MW 400), O,O'-dimethyl polyethylene glycol (MW 2000), dimethyl polyethylene glycol (MW 2000) or mixtures thereof. Preferred dicapped polyalkoxylene glycol for use herein is dimethyl polyethylene glycol (MW 2000). For instance dimethyl polyethylene glycol may be commercially available from Hoescht as the polyglycol series, e.g. PEG DME-2000®, or from Huntsman under the tradename Jeffamine® and XTJ®.

In a preferred embodiment of the present invention wherein the dicapped polyalkoxylene glycol is an amino dicapped polyalkoxylene glycol, it is preferred for cleaning performance reasons to formulate the liquid compositions herein at a pH equal or lower than the pKa of said amino dicapped polyalkoxylene glycol. Indeed, it has been found that the next-time cleaning performance is especially improved at those pHs when the compositions according to the present invention comprise such an amino dicapped polyalkoxylene glycol, as the dicapped polyalkoxylene glycol.

The non-amino dicapped polyalkoxylene glycols as defined herein are pH independent, i.e., the pH of the composition has no influence on the next-time cleaning performance delivered by a composition comprising such a non-amino dicapped polyalkoxylene glycol, as the dicapped polyalkoxylene glycol.

By "amino dicapped polyalkoxylene glycol", it is meant herein a dicapped polyalkoxylene glycol according to the formula $R_1—O—(CH_2—CHR_2O)_n—R_3$, wherein substituents $R_1$, $R_2$, $R_3$ and n are as defined herein before, and wherein at least substituent $R_1$ or $R_3$ is an amino bearing linear or branched, substituted or unsubstituted hydrocarbon chain of from 1 to 30 carbon atoms.

By "non-amino dicapped polyalkoxylene glycol" it is meant herein a dicapped polyalkoxylene glycol according to the formula $R_1—O—(CH_2—CHR_2O)_n—R_3$, wherein substituents $R_1$, $R_2$, $R_3$ and n are as defined herein before, and wherein none of the substituents $R_1$ or $R_3$ is an amino bearing linear or branched, substituted or unsubstituted hydrocarbon chain of from 1 to 30 carbon atoms.

Although the polyalkoxylene glycols and monocapped polyalkoxylene glycols contribute to the next-time cleaning performance delivered by the compositions herein, the dicapped polyalkoxylene glycols are preferred herein as the next-time cleaning performance associated thereto is further improved. Indeed, it has surprisingly been found that dicapping a polyalkoxylene glycol imparts outstanding improved antiresoiling properties to such a compound, as compared to the corresponding non-capped polyalkoxylene glycol, or non-capped polyalkoxylene glycol of equal molecular weight.

2) PVP Homopolymers or Copolymers Thereof

The hard surface cleaning compositions according to the present invention may contain a vinylpyrrolidone homopolymer or copolymer or a mixture thereof. The compositions of the present invention comprise from 0.001% to 20% by weight of the total composition of a vinylpyrrolidone homopolymer or copolymer or a mixture thereof, preferably from 0.01% to 10%, more preferably from 0.1% to 5% and most preferably from 0.2% to 2%, when PVP homopolymers or copolymers are present.

Suitable vinylpyrrolidone homopolymers which can be used herein is an homopolymer of N-vinylpyrrolidone having the following repeating monomer:

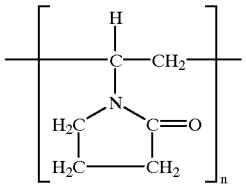

wherein n (degree of polymerization) is an integer of from 10 to 1,000,000, preferably from 20 to 100,000, and more preferably from 20 to 10,000.

Accordingly, suitable vinylpyrrolidone homopolymers ("PVP") which can be used herein have an average molecular weight of from 1,000 to 100,000,000, preferably from 2,000 to 10,000,000, more preferably from 5,000 to 1,000,000, and most preferably from 50,000 to 500,000.

Suitable vinylpyrrolidone homopolymers are commercially available from ISP Corporation, New York, N.Y. and Montreal, Canada under the product names PVP K-15® (viscosity molecular weight of 10,000), PVP K-30® (average molecular weight of 40,000), PVP K-60® (average molecular weight of 160,000), and PVP K-90® (average molecular weight of 360,000). Other suitable vinylpyrrolidone homopolymers which are commercially available from BASF Cooperation include Sokalan HP 165® and Sokalan HP 12®; vinylpyrrolidone homopolymers known to persons skilled in the detergent field (see for example EP-A-262,897 and EP-A-256,696).

Suitable copolymers of vinylpyrrolidone which can be used herein include copolymers of N-vinylpyrrolidone and alkylenically unsaturated monomers or mixtures thereof.

The alkylenically unsaturated monomers of the copolymers herein include unsaturated dicarboxylic acids such as maleic acid, chloromaleic acid, fumaric acid, itaconic acid, citraconic acid, phenylmaleic acid, aconitic acid, acrylic acid, N-vinylimidazole and vinyl acetate. Any of the anhydrides of the unsaturated acids may be employed, for example acrylate, methacrylate. Aromatic monomers like styrene, sulphonated styrene, alpha-methyl styrene, vinyl toluene, t-butyl styrene and similar well known monomers may be used.

The molecular weight of the copolymer of vinylpyrrolidone is not especially critical so long as the copolymer is water-soluble, has some surface activity and is adsorbed to the hard-surface from the liquid composition or solution (i.e. under dilute usage conditions) comprising it in such a manner as to increase the hydrophilicity of the surface. However, the preferred copolymers of N-vinylpyrrolidone and alkylenically unsaturated monomers or mixtures thereof, have a molecular weight of between 1,000 and 1,000,000, preferably between 10,000 and 500,000 and more preferably between 10,000 and 200,000.

For example particularly suitable N-vinylimidazole N-vinylpyrrolidone polymers for use herein have an average molecular weight range from 5,000–1,000,000, preferably from 5,000 to 500,000, and more preferably from 10,000 to 200,000. The average molecular weight range was determined by light scattering as described in Barth H. G. and Mays J. W. Chemical Analysis Vol. 113,"Modern Methods of Polymer Characterization".

Such copolymers of N-vinylpyrrolidone and alkylenically unsaturated monomers like PVP/vinyl acetate copolymers are commercially available under the trade name Luviskol® series from BASF.

Particular preferred copolymers of vinylpyrrolidone for use in the compositions of the present invention are quaternized or unquaternized vinylpyrrolidone/dialkylaminoalkyl acrylate or methacrylate copolymers.

The vinylpyrrolidone/dialkylaminoalkyl acrylate or methacrylate copolymers (quaternised or unquaternised) suitable for use in the compositions of the present invention are according to the following formula:

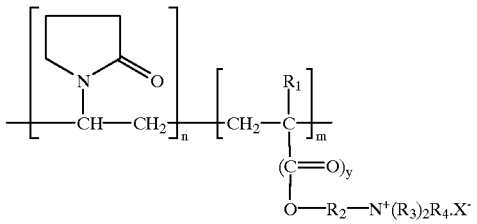

in which n is between 20 and 99 and preferably between 40 and 90 mol % and m is between 1 and 80 and preferably between 5 and 40 mol %; $R_1$ represents H or $CH_3$; y denotes 0 or 1; $R_2$ is —$CH_2$—CHOH—$CH_2$— or $C_xH_{2x}$, in which x=2 to 18; $R_3$ represents a lower alkyl group of from 1 to 4 carbon atoms, preferably methyl or ethyl, or benzyl; $R_4$ denotes a lower alkyl group of from 1 to 4 carbon atoms, preferably methyl or ethyl; $X^-$ is chosen from the group consisting of Cl, Br, I, $1/2SO_4$, $HSO_4$ and $CH_3SO_3$. The polymers can be prepared by the process described in French Pat. Nos. 2,077,143 and 2,393,573.

The preferred quaternized or unquaternized vinylpyrrolidone/dialkylaminoalkyl acrylate or methacrylate copolymers suitable for use herein have a molecular weight of between 1,000 and 1,000,000, preferably between 10,000 and 500,000 and more preferably between 10,000 and 100,000.

Such vinylpyrrolidone/dialkylaminoalkyl acrylate or methacrylate copolymers are commercially available under the name copolymer 845®, Gafquat 734®, or Gafquat 755® from ISP Corporation, New York, N.Y. and Montreal, Canada or from BASF under the tradename Luviquat®.

Most preferred herein is quaternized copolymers of vinyl pyrrolidone and dimethyl aminoethymethacrylate (polyquaternium-11) available from BASF.

3) Polycarboxylate

The hard surface cleaning composition of the present invention may optionally contain a polycarboxylate polymer. When present the polycarboxylate polymer will be preferably from about 0.001% to about 10% , more preferably from about 0.01% to about 5%, even more preferably about 0.1% to 2.5%, by weight of composition.

Polycarboxylate polymers can be those formed by polymerization of monomers, at least some of which contain carboxylic functionality. Common monomers include acrylic acid, maleic acid, ethylene, vinyl pyrrollidone, methacrylic acid, methacryloylethylbetaine, etc. In general, the polymers should have molecular weights of more than 10,000, preferably more than about 20,000, more preferably more than about 300,000, and even more preferably more than about 400,000. It has also been found that higher molecular weight polymers, e.g., those having molecular weights of more than about 3,000,000, are extremely difficult to formulate and are less effective in providing anti-spotting benefits than lower molecular weight polymers. Accordingly, the molecular weight should normally be, especially for polyacrylates, from about 20,000 to about 3,000,000; preferably from about 20,000 to about 2,500,000; more preferably from about 300,000 to about 2,000,000; and even more preferably from about 400,000 to about 1,500,000.

An advantage for some polycarboxylate polymers is the detergent builder effectiveness of such polymers. Surprisingly, such polymers do not hurt filming/streaking and like other detergent builders, they provide increased cleaning effectiveness on typical, common "hard-to-remove" soils that contain particulate matter.

Some polymers, especially polycarboxylate polymers, thicken the compositions that are aqueous liquids. This can be desirable. However, when the compositions are placed in containers with trigger spray devices, the compositions are desirably not so thick as to require excessive trigger pressure. Typically, the viscosity under shear should be less than about 200 cp, preferably less than about 100 cp, more preferably less than about 50 cp. It can be desirable, however, to have thick compositions to inhibit the flow of the composition off the surface, especially vertical surfaces.

4) Sulfonated Polystyrene Polymer

Another suitable materials which can be included in to the hard surface cleaning composition of the invention are high molecular weight sulfonated polymers such as sulfonated polystyrene. A typical formula is as follows.

$$—[CH(C_6H_4SO_3Na)—CH_2]_n—CH(C_6H_5)—CH_2—$$

wherein n is a number to give the appropriate molecular weight as disclosed below.

Typical molecular weights are from about 10,000 to about 1,000,000, preferably from about 200,000 to about 700,00.

Examples of suitable materials for use herein include poly(vinyl pyrrolidone/acrylic acid) sold under the name "Acrylidone"® by ISP and poly(acrylic acid) sold under the name "Accumer"® by Rohm & Haas. Other suitable materials include sulfonated polystyrene polymers sold under the name Versaflex® sold by National Starch and Chemical Company, especially Versaflex 7000.

The level of polymer should normally be, when polymer is present in the hard surface cleaning composition, from about 0.01% to about 10%, preferably from about 0.05% to about 0.5%, more preferably from about 0.1% to about 0.3%.

f) pH Adjusting Material

The hard surface cleaning compositions of the present invention can be formulated at any pH. That is, the hard surface cleaning compositions of the present invention can have a pH from 0 to 14. Typically, the pH range is selected depending upon the end use of the composition, that is what surface the composition is intended to be used on. Alternatively, the pH can be dependent upon the components present in the composition. That is, glass cleaners will typically have an alkaline pH, i.e. pH greater than 7, preferably a pH from about 8 to about 12, more preferably from about 9 to about 12. All purpose cleaners also typically have an alkaline pH, preferably a pH from about 8 to about 12, more preferably from about 9 to about 12. Bath cleaners or acidic cleaners will have an acidic pH, i.e. pH less than 7, preferably a pH from about 0.5 to about 5.5, more preferably from about 1 to about 5. In bleach containing cleaners the pH of the composition depends upon the bleaching agent used, for example, if hydrogenperoxide is the bleach then the composition is acidic, but if the bleach is a chlorine bleach then the pH will be alkaline. Compositions for use on delicate surfaces, such as marble and lacqured wood, will have a mildly acidic to mildly alkaline pH, preferably the pH is from about 6 to 9, more preferably from about 6.5 to 8 and even more preferably from about 7 to about 7.5. The pH adjusting material, if required, can be then selected with the end use and components present in the composition, to give the composition a pH in the desired range.

The compositions herein may be optionally formulated in a mildly acidic to mildly alkaline range when the composition is designed to clean delicate surfaces. Accordingly, the compositions for use on delicate surfaces preferably have a pH between 6 and 9, more preferably between 6.5 and 8, and most preferably between 7 and 7.5. At lower pH, the composition would damage marble while, at higher pH, it would damage lacquers. Interestingly, even in neutral pH in which the compositions herein can be formulated, damage to marble would be observed in the absence of the saturated citrate. The pH of the compositions herein can be adjusted by any of the means well known to the man skilled in the art, such as addition of NaOH, KOH, MEA,TEA, MDEA, K2CO3, Na2CO3 and the like, or citric acid, sulphuric acid, nitric acid, hydrochloric acid, maleic acid, acetic acid and the like.

Particularly preferred compositions herein comprise an effective amount of a carbonate of the formula $XHCO_3$ or, if the builder used is not a phosphate-type builder, a phosphate of the formula $X_aH_bPO_4$, where a+b=3 and a or b can be 0, $X_aH_bP_2O_7$ where a+b=4 and a or b can be 0, or $X_aH_bP_3O_{10}$ where a+b=5 and a or b can be 0, and where X is an alkali metal, particularly $K^+$, $Na^+$, or $NH_4^+$. Indeed, apart from the pH adjusting effect just described, we have found that the presence of those compounds further improves the safety of the compositions herein to delicate surfaces. Without wishing to be bound by theory, it is believed that the compounds react with the calcium on the surface of marble, to form an insoluble calcium carbonate salt at the marble/solution interface, creating a protective layer. Using these compounds in addition to the saturation technology described hereinabove provides a synergetic effect on delicate surface safety. The amount of these compounds needed in the compositions for use on delicate surfaces can be determined by trial and error, but appears to lie in the range of from 0.05% to 0.4% by weight of the total composition, preferably from 0.05% to 0.1%. Caution needs to be exercised however in that we have observed that too high an amount of $XHCO_3$ may raise be detrimental to surface safety on lacquered wood.

The liquid compositions herein may be formulated in the full pH range of 0 to 14, preferably 1 to 13. Some of the compositions herein are formulated in a neutral to highly alkaline pH range from 7 to 13, preferably from 9 to 11 and more preferably from 9.5 to 11, dependent upon their use and the components present in the composition. The pH of the compositions herein can be adjusted by any of the means well-known to those skilled in the art such as acidifying agents like organic or inorganic acids, or alkalinizing agents like NaOH, KOH, K2CO3, Na2CO3 and the like. Preferred organic acids for use herein have a pK of less than 6. Suitable organic acids are selected from the group consisting of citric acid, lactic acid, glycolic acid, succinic acid, glutaric acid and adipic acid and mixtures thereof. A mixture of said acids may be commercially available from BASF under the trade name Sokalan® DCS.

The compositions according to the present invention may further comprise an alkanolamine, or mixtures thereof, in amounts ranging from 0.1% to 10% by weight of the composition, preferably from 0.1% to 7%, most preferably from 0.1% to 5%. At such levels, the alkanolamine has a buffering effect for alkaline products in the undiluted product, as well as an unexpected boosting effect on the cleaning performance of the diluted compositions. Suitable alkanolamines for use in the compositions according to the present include monoalkanolamines, dialkanolamines, trialkanolamines, alkylalkanolamines, dialkylalkanolamines and alkoxyalkanolamines. Preferred alkanolamines to be used according to the present invention include monoethanolamine, triethanolamine, aminoethylpropanediol, 2-aminomethyl propanol, and ethoxyethanolamine. Particularly preferred are monoethanolamine, triethanolamine and ethoxyethanolamine.

Monoethanolamine and/or beta-alkanolamine, when present in the composition are used at a level of from about 0.05% to about 10%, preferably from about 0.2% to about 5%.

Preferred beta-aminoalkanols have a primary hydroxy group. Suitable beta-aminoalkanols have the formula:

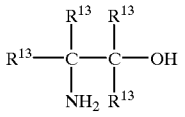

wherein each $R^{13}$ is selected from the group consisting of hydrogen and alkyl groups containing from one to four carbon atoms and the total of carbon atoms in the compound is from three to six, preferably four. The amine group is preferably not attached to a primary carbon atom. More preferably the amine group is attached to a tertiary carbon atom to minimize the reactivity of the amine group Specific preferred beta-aminoalkanols are 2-amino, 1-butanol; 2-amino,2-methylpropanol; and mixtures thereof. The most preferred beta-aminoalkanol is 2-amino,2-methylpropanol since it has the lowest molecular weight of any beta-aminoalkanol which has the amine group attached to a tertiary carbon atom. The beta-aminoalkanols preferably have boiling points below about 175° C. Preferably, the boiling point is within about 5° C. of 165° C.

Such beta-aminoalkanols are excellent materials for hard surface cleaning in general and, in the present application, have certain desirable characteristics.

Beta-aminoalkanols, and especially the preferred 2-amino-2-methylpropanol, are surprisingly volatile from cleaned surfaces considering their relatively high molecular weights.

The compositions can optionally contain, either alone or in addition to the preferred alkanolamines, more conventional alkaline buffers such as ammonia; other $C_{2-4}$ alkanolamines; alkali metal hydroxides; silicates; borates; carbonates; and/or bicarbonates. Thus, the buffers that are present usually comprise the preferred monoethanolamine and/or beta-aminoalkanol and additional conventional alkaline material.

g) Hydrotropes

Hydrotropes are highly preferred optional ingredients. In addition to providing the normal benefits associated with hydrotropes, e.g., phase stability and/or viscosity reduction, hydrotropes can also provide improved suds characteristics. Specifically, when the zwitterionic and/or amphoteric co-surfactants contain a carboxy group as the anionic group, the hydrotrope can improve both the quantity of suds generated, especially when the product is dispensed from a sprayer or foamer, and, at the same time, reduce the amount of time required for the foam to "break", i.e., the time until the foam has disappeared. Both of these characteristics are valued by consumers, but they are usually considered to be mutually incompatible. The hydrotropes that provide the optimum suds improvements are anionic, especially the benzene and/or alkyl benzene sulfonates. The usual examples of such hydrotropes are the benzene, toluene, xylene, and cumene sulfonates. Typically, these hydrotopes are available as their salts, most commonly the sodium salts. Preferably, the hydrotrope is present in at least about molar equivalency to the zwitterionic and/or amphoteric co-surfactants, when these are present. Preferable levels of hydrotropes, when present, are from about 0.1% to about 5%, more preferably from about 1% to about 3% by weight of composition.

Bleach

The compositions herein may also comprise a bleaching component. Any bleach known to those skilled in the art may be suitable to be used herein including any peroxygen bleach as well as a chlorine releasing component.

Suitable peroxygen bleaches for use herein include hydrogen peroxide or sources thereof. As used herein a source of hydrogen peroxide refers to any compound which produces active oxygen when said compound is in contact with water. Suitable water-soluble sources of hydrogen peroxide for use herein include percarbonates, preformed percarboxylic acids, persilicates, persulphates, perborates, organic and inorganic peroxides and/or hydroperoxides.

Suitable chlorine releasing component for use herein is an alkali metal hypochlorite. Advantageously, the composition of the invention are stable in presence of this bleaching component. Although alkali metal hypochlorites are preferred, other hypochlorite compounds may also be used herein and can be selected from calcium and magnesium hypochlorite. A preferred alkali metal hypochlorite for use herein is sodium hypochlorite.

The compositions of the present invention that comprise a peroxygen bleach may further comprise a bleach activator or mixtures thereof. By "bleach activator", it is meant herein a compound which reacts with peroxygen bleach like hydrogen peroxide to form a peracid. The peracid thus formed constitutes the activated bleach. Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition.

The source of active oxygen according to the present invention acts as an oxidizing agent, it increases the ability of the compositions to remove colored stains and organic stains in general, to destroy malodorous molecules and to kill germs. Suitable sources of active oxygen are hydrogen peroxide or sources thereof. As used herein a hydrogen peroxide source refers to any compound which produces hydrogen peroxide when said compound is in contact with water. Suitable water-soluble inorganic sources of hydrogen peroxide for use herein include persulfate salts (i.e., dipersulfate and monopersulfate salts), persulfuric acid, percarbonates, metal peroxides, perborates and persilicate salts.

In addition, other classes of peroxides can be used as an alternative to hydrogen peroxide and sources thereof or in combination with hydrogen peroxide and sources thereof. Suitable classes include dialkylperoxides, diacylperoxide, performed percarboxylic acids, organic and inorganic peroxides and/or hydroperoxides. Suitable organic peroxides/hydroperoxides include diacyl and dialkyl peroxides/hydroperoxides such as dibenzoyl peroxide, t-butyl hydroperoxide, dilauroyl peroxide, dicumyl peroxide, and mixtures thereof. Suitable preformed peroxyacids for use in the compositions according to the present invention include diperoxydodecandioic acid DPDA, magnesium perphthalic acid, perlauric acid, perbenzoic acid, diperoxyazelaic acid and mixtures thereof.

Persulfate salts, or mixtures thereof, are the preferred sources of active oxygen to be used in the compositions according to the present invention. Preferred persulfate salt to be used herein is the monopersulfate triple salt. One example of monopersulfate salt commercially available is potassium monopersulfate commercialized by Peroxide Chemie GMBH under the trade name Curox®, by Degussa under the trade name Caroat and from Du Pont under the trade name Oxone. Other persulfate salts such as dipersulfate salts commercially available from Peroxide Chemie GMBH can be used in the compositions according to the present invention.

The compositions according to the present invention may optionally comprise up to 30% by weight of the total composition of said bleach, or mixtures thereof, preferably from 0.1% to 20%, more preferably from 0.1% to 10%, and most preferably from 0.1% to 5%.

Chelating Agents

The hard surface cleaning compositions herein may also optionally contain one or more transition metal chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.01% to about 3.0% by weight of such compositions.

Optional Components

The hard surface cleaning compositions of the present invention may further comprise one or more optional components known for use in hard surface cleaning compositions provided that the optional components are physically and chemically compatible with the essential component described herein, or do not otherwise unduly impair product stability, aesthetics or performance. Concentrations of such optional components typically range from about 0.001% to about 30% by weight of the hard surface cleaning compositions, when present.

Optional components include dyes, diluents, antimicrobial agents, antifungal agents, anti mould agents, antimildue agents, inscet repellent, suds suppressors, enzymes, thickeners, thinners, reheology agents (i.e. agents which change or stabilize the rehology of a composition), thixotropic agents, foam boosters, perfumes, preservatives, antioxidants; and aesthetic components such as fragrances, colorings, and the like. This list of optional components is not meant to be exclusive, and other optional components can be used.

Packaging Form of the Compositions

The compositions herein may be packaged in a variety of suitable detergent packaging known to those skilled in the art. The liquid compositions are preferably packaged in conventional detergent plastic bottles.

In one embodiment the compositions herein may be packaged in manually operated spray dispensing containers, which are usually made of synthetic organic polymeric plastic materials. Accordingly, the present invention also encompasses liquid cleaning compositions of the invention packaged in a spray dispenser, preferably in a trigger spray dispenser or pump spray dispenser.

Indeed, said spray-type dispensers allow to uniformly apply to a relatively large area of a surface to be cleaned the liquid cleaning compositions suitable for use according to the present invention. Such spray-type dispensers are particularly suitable to clean vertical surfaces.

Suitable spray-type dispensers to be used according to the present invention include manually operated foam trigger-type dispensers sold for example by Specialty Packaging Products, Inc. or Continental Sprayers, Inc. These types of dispensers are disclosed, for instance, in U.S. Pat. No. 4,701,311 to Dunnining et al. and U.S. Pat. Nos. 4,646,973 and 4,538,745 both to Focarracci. Particularly preferred to be used herein are spray-type dispensers such as T 8500® commercially available from Continental Spray International or T 8100® commercially available from Canyon, Northern Ireland. In such a dispenser the liquid composition is divided in fine liquid droplets resulting in a spray that is directed onto the surface to be treated. Indeed, in such a spray-type dispenser the composition contained in the body of said dispenser is directed through the spray-type dispenser head via energy communicated to a pumping mechanism by the user as said user activates said pumping mechanism. More particularly, in said spray-type dispenser head the composition is forced against an obstacle, e.g. a grid or a cone or the like, thereby providing shocks to help atomize the liquid composition, i.e. to help the formation of liquid droplets.

The present invention also comprises a detergent composition containing the modified alkylbenzene sulfonate surfactant mixture disclosed herein, in a container in association with instructions to use it with an absorbent structure comprising an effective amount of a superabsorbent material, and, optionally, in a container in a kit comprising the implement, or, at least, a disposable cleaning pad comprising a superabsorbent material.

The container is based on providing the convenience of a cleaning pad, preferably removable and/or disposable, that contains a superabsorbent material and which preferably also provides significant cleaning benefits. The preferred cleaning performance benefits are related to the preferred structural characteristics described below, combined with the ability of the pad to remove solubilized soils. The cleaning pad, as described herein requires the use of the detergent composition containing the modified alkylbenzene sulfonate surfactant mixture to provide optimum performance.

The cleaning pads will preferably have an absorbent capacity when measured under a confining pressure of 0.09 psi after 20 minutes (1200 seconds) (hereafter refered to as "$t_{1200}$ absorbent capacity") of at least about 10 g deionized water per g of the cleaning pad. The cleaning pads will also preferably, but not necessarily, have a total fluid capacity (of deionized water) of at least about 100 g. Each of the components of the absorbent pad are described in detail.

The absorbent layer is the essential component which serves to retain any fluid and soil absorbed by the cleaning pad during use. While the preferred scrubbing layer, described hereinafter, has some affect on the pad's ability to absorb fluid, the absorbent layer plays the major role in achieving the desired overall absorbency.

From the essential fluid absorbency perspective, the absorbent layer will be capable of removing fluid and soil from any "scrubbing layer" so that the scrubbing layer will have capacity to continually remove soil from the surface.

The absorbent layer will comprise any material that is capable of absorbing and retaining fluid during use. To achieve desired total fluid capacities, it will be preferred to include in the absorbent layer a material having a relatively high capacity (in terms of grams of fluid per gram of absorbent material). As used herein, the term "superabsorbent material" means any absorbent material having a g/g capacity for water of at least about 15 g/g, when measured under a confining pressure of 0.3 psi.

Representative superabsorbent materials include water insoluble, water-swellable superabsorbent gelling polymers (referred to herein as "superabsorbent gelling polymers") which are well known in the literature. These materials demonstrate very high absorbent capacities for water. The superabsorbent gelling polymers useful in the present invention can have a size, shape and/or morphology varying over a wide range. These polymers can be in the form of particles that do not have a large ratio of greatest dimension to smallest dimension (e.g., granules, flakes, pulverulents, interparticle aggregates, interparticle crosslinked aggregates, and the like) or they can be in the form of fibers, sheets, films, foams, laminates, and the like. The use of superabsorbent gelling polymers in fibrous form provides the benefit of providing enhanced retention of the superabsorbent material, relative to particles, during the cleaning process. While their capacity is generally lower for aqueous-based mixtures, these materials still demonstrate significant absorbent capacity for such mixtures. The patent literature is replete with disclosures of water-swellable materials. See, for example, U.S. Pat. No. 3,699,103 (Harper et al.), issued Jun. 13, 1972; U.S. Pat. No. 3,770,731 (Harmon), issued Jun. 20, 1972; U.S. Reissue Pat. No. 32,649 (Brandt et al.), reissued Apr. 19, 1989; U.S. Pat. No. 4,834,735 (Alemany et al.), issued May 30, 1989.

Most preferred polymer materials for use in making the superabsorbent gelling polymers are slightly network crosslinked polymers of partially neutralized polyacrylic acids and starch derivatives thereof. Most preferably, the hydrogel-forming absorbent polymers comprise from about 50 to about 95%, preferably about 75%, neutralized, slightly network crosslinked, polyacrylic acid (i.e. poly (sodium acrylate/acrylic acid)). Network crosslinking renders the polymer substantially water-insoluble and, in part, determines the absorptive capacity and extractable polymer content characteristics of the superabsorbent gelling polymers. Processes for network crosslinking these polymers and typical network crosslinking agents are described in greater detail in U.S. Pat. No. 4,076,663.

Other useful superbsorbent materials include hydrophilic polymeric foams, such as those described in commonly assigned copending U.S. patent application Ser. No. 08/563,866 (DesMarais et al.), filed Nov. 29, 1995 and U.S. Pat. No. 5,387,207 (Dyer et al.), issued Feb. 7, 1995.

The absorbent layer may also consist of or comprise fibrous material. Fibers useful in the present invention include those that are naturally occurring (modified or unmodified), as well as synthetically made fibers.

The fibers useful herein can be hydrophilic, hydrophobic or can be a combination of both hydrophilic and hydrophobic fibers.

Suitable wood pulp fibers can be obtained from well-known chemical processes such as the Kraft and sulfite processes.

Another type of hydrophilic fiber for use in the present invention is chemically stiffened cellulosic fibers. As used herein, the term "chemically stiffened cellulosic fibers" means cellulosic fibers that have been stiffened by chemical means to increase the stiffness of the fibers under both dry and aqueous conditions.

Optional but Preferred, Scrubbing Layer

The scrubbing layer is the portion of the cleaning pad that contacts the soiled surface during cleaning. As such, materials useful as the scrubbing layer must be sufficiently durable that the layer will retain its integrity during the cleaning process. In addition, when the cleaning pad is used in combination with a solution, the scrubbing layer must be capable of absorbing liquids and soils, and relinquishing those liquids and soils to the absorbent layer. This will ensure that the scrubbing layer will continually be able to remove additional material from the surface being cleaned.

In order to provide desired integrity, materials particularly suitable for the scrubbing layer include synthetics such as polyolefins (e.g., polyethylene and polypropylene), polyesters, polyamides, synthetic cellulosics (e.g., Rayon®, and blends thereof. Such synthetic materials may be manufactured using known process such as carded, spunbond, meltblown, airlaid, needlepunched and the like.

Optional Attachment Layer

The cleaning pads of the present invention can optionally have an attachment layer that allows the pad to be connected to an implement's handle or the support head in preferred implements. The attachment layer will be necessary in those embodiments where the absorbent layer is not suitable for attaching the pad to the support head of the handle. The attachment layer may also function as a means to prevent fluid flow through the top surface (i.e., the handle-contacting surface) of the cleaning pad, and may further provide enhanced integrity of the pad. As with the scrubbing and absorbent layers, the attachment layer may consist of a mono-layer or a multi-layer structure, so long as it meets the above requirements.

In a preferred embodiment of the present invention, the attachment layer will comprise a surface which is capable of being mechanically attached to the handle's support head by use of known hook and loop technology. In such an embodiment, the attachment layer will comprise at least one surface which is mechanically attachable to hooks that are permanently affixed to the bottom surface of the handle's support head.

Detergent Composition

Detergent compositions containing the modified alkylbenzene sulfonate surfactant mixture which are to be used with an implement containing a superabsorbent material require sufficient detergent to enable the solution to provide cleaning without overloading the superabsorbent material with solution, but cannot have more than about 0.5% detergent surfactant without the performance suffering. Therefore, the level of detergent surfactant should be from about 0.01% to about 0.5%, preferably from about 0.1% to about 0.45%, more preferably from about 0.2% to about 0.45%; the level of hydrophobic materials, including solvent, should be less than about 0.5%, preferably less than about 0.2%, more preferably less than about 0/1%; and the pH should be more than about 9.3.

Preferably the compositions containing the modified alkylbenzene sulfonate surfactant mixture which are to be used in combination with the cleaning implement contain a solvent. Suitable solvents include short chain (e.g., C1–C6) derivatives of oxyethylene glygol and oxypropylene glycol, such as mono- and di-ethylene glycol n-hexyl ether, mono-, di- and tri-propylene glycol n-butyl ether, and the like. The level of hydrophobic solvents, e.g., those having solubilities in water of less than about 3%, more preferably less than about 2%.

Preferably the compositions containing the modified alkylbenzene sulfonate surfactant mixture which are to be used in combination with the cleaning implement contain a builder. Suitable builders include those derived from phosphorous sources, such as orthophosphate and pyrophosphate, and non-phosphorous sources, such as nitrilotriacetic acid, S,S-ethylene diamine disuccinic acid, and the like. Suitable chelants include ethylenediaminetetraacetic acid and citric acid, and the like. Suitable suds suppressors include silicone polymers and linear or branched C10–C18 fatty acids or alcohols. Suitable enzymes include lipases, proteases, amylases and other enzymes known to be useful for catalysis of soil degradation. The total level of such ingredients is low, preferably less than about 0.1%, more preferably less than about 0.05%, to avoid causing filming streaking problems. Preferably, the compositions should be essentially free of materials that cause filming streaking problems. Accordingly, it is desirable to use alkaline materials that do not cause filming and/or streaking for the majority of the buffering. Suitable alkaline buffers are carbonate, bicarbonate, citrate, etc. The preferred alkaline buffers are alkanol amines having the formula:

$$CR_2(NH_2)CR_2OH$$

wherein each R is selected from the group consisting of hydrogen and alkyl groups containing from one to four carbon atoms and the total of carbon atoms in the compound is from three to six, preferably, 2-amino,2-methylpropanol.

The compositions containing the modified alkylbenzene sulfonate surfactant mixture which are to be used in combination with the cleaning implement preferably contain a polymer. The level of polymer should be low, e.g., that is from about 0.0001% to about 0.2%, preferably from about 0.0001% to about 0.1% more preferably from about 0.0005% to about 0.08%, by weight of the composition. This very low level is all that is required to produce a better end result cleaning and higher levels can cause streaking/filming, build up, and/or stickiness.

While not wishing to be limited by theory, two physical properties are considered critical for the polymer: 1) Hydrophilic nature and 2) Shear-thinning ability. The polymer hydrophilicity is important to ensure strippability in-between cleanings to avoid build-up. The shear-thinning characteristic is important in aiding to spread solution out evenly during use and combined with hydrophilic characterstic helps provide leveling effect. By leveling effect we mean minimizing solution de-wetting and molecular aggregation which typically occurs during dry down. Molecular aggregation leads to visual streaking/filming which is a signal of poor end result cleaning.

Suitable examples of polymers include cellulose materials, e.g., carboxymethylcellulose, hydroxymethylcellulose, etc., and synthetic hydrophilic polymers such as polystyrene sulfonate. More preferred are naturally occurring polymers like gum arabic, pectin, guar gum and xanthan gum. Xanthan gum is pariticularly preferred. Xanthan gum is disclosed in U.S. Pat. No. 4,788,006, Bolich, issued Nov. 29, 1986, at Col. 5, line 55 through Col. 6, line 2, said patent being incorporated herein by reference. Many synthetic polymers can provide this benefit, especially polymers that contain hydrophilic groups, e.g., carboxylate groups. Other polymers that can provide shear-thinning and hydrophilicity include cationic materials that also contain hydrophilic groups and polymers that contain multiple ether linkages. Cationic materials include cationic sugar and/or starch derivatives.

Preferred polymers are those having higher molecular weights, although molecular weights down to about 5,000 can provide some results. In general, the polymers should have molecular weights of more than about 10,000, preferably more than about 100,000, more preferably more than about 250,000, and even more preferably more than about 500,000. The molecular weight should normally be, from about 10,000 to about 100,000; preferably from about 100,000 to about 1,000,000; more preferably from about 1,000,000 to about 4,000,000; and even more preferably greater than 4,000,000 million.

Examples of suitable materials for use herein include polymers preferably selected from the group consisting of xanthan gums, guar gums, gum arabic, pectin poly(styrene sulfonate), and mixtures thereof of monomers and/or polymers. These polymers can also be used in combination with polymers that do not provide the benefit or provide the benefit to lesser extent to achieve an improved end result cleaning. The most preferred is xanthan gum.

Cleaning Implements

The detergent compositions containing the modified alkylbenzene sulfonate surfactant mixture can be used with an implement for cleaning a surface, the implement preferably comprising:

a. a handle; and b. a removable cleaning pad containing an effective amount of a superabsorbent material, and having a plurality of substantially planar surfaces, wherein each of the substantially planar surfaces contacts the surface being cleaned, more preferably said pad is a removable cleaning pad having a length and a width, the pad comprising i. a scrubbing layer; and ii. an absorbent layer comprising a first layer and a second layer, where the first layer is located between the scrubbing layer and the second layer (i.e., the first layer is below the second layer) and has a smaller width than the second layer.

The Handle

The handle of the above cleaning implement can be any material that will facilitate gripping of the cleaning implement. The handle of the cleaning implement will preferably comprise any elongated, durable material that will provide practical cleaning. The length of the handle will be dictated by the end-use of the implement.

The handle will preferably comprise at one end a support head to which the cleaning pad can be releasably attached. To facilitate ease of use, the support head can be pivotably attached to the handle using known joint assemblies. Any suitable means for attaching the cleaning pad to the support head may be utilized, so long as the cleaning pad remains afixed during the cleaning process. Examples of suitable fastening means include clamps, hooks & loops (e.g., Velcro®), and the like. In a preferred embodiment, the support head will comprise hooks on its lower surface that will mechanically attach to the upper layer (preferably a distinct attachment layer) of the absorbent cleaning pad.

A preferred handle, comprising a fluid dispensing means, is depicted in FIG. 1 and is fully described in co-pending U.S. Pat. application Ser. No. 08/756,774, filed Nov. 26, 1996 by V. S. Ping, et al., which is incorporated by reference herein. Another preferred handle, which does not contain a fluid dispensing means, is depicted in FIGS. 1*a* and 1*b*, and is fully described in co-pending U.S. patent application Ser. No. 08/716,755, filed Sep. 23, 1996 by A. J. Irwin, which is incorporated by reference herein.

The Cleaning Pad

The cleaning pads described hereinbefore can be used without attachment to a handle, or as part of the above cleaning implement. They may therefore be constructed without the need to be attachable to a handle, i.e., such that they may be used either in combination with the handle or as a stand-alone product. As such, it may be preferred to prepare the pads with an optional attachment layer as described hereinbefore. With the exception of an attachment layer, the pads themselves are as described above.

More information on these cleaning implements including other possible embodiments can be found in U.S. patent application Ser. No. 09/381,550, filed Sep. 20, 1999 by R. A. Masters, et al.

EXAMPLES

In these Examples, the following abbreviation is used for a modified alkylbenzene sulfonate, sodium salt form or potassium salt form, prepared according to any of the preceding process examples: MLAS

Example 25

| | A | B | C | D | E | F | G |
|---|---|---|---|---|---|---|---|
| MLAS | 3.0 | 3.0 | 5.0 | 3.2 | 3.2 | 3.2 | 8.0 |
| Dobanol ® 23-3 | 1.0 | 1.0 | 1.5 | 1.3 | 1.3 | 1.5 | 3.0 |
| Empilan KBE2l+ | 2.0 | 2.0 | 2.5 | 1.9 | 1.9 | 2.0 | 5.0 |
| NaPS | 2.0 | 1.5 | 1.2 | 1.2 | 1.0 | 1.7 | 3.0 |
| NaCS | 1.2 | 3.0 | 2.2 | 2.0 | 2.0 | 1.5 | 4.0 |
| MgSO4 | 0.20 | 0.9 | 0.30 | 0.50 | 1.3 | 2.0 | 1.0 |
| Citrate | 0.3 | 1.0 | 0.5 | 0.75 | 1.8 | 3.0 | 1.5 |
| NaHCO3 | 0.06 | 0.1 | — | 0.1 | — | 0.2 | — |
| Na2HPO4 | — | — | 0.1 | — | 0.3 | — | — |
| Na2H2P2O7 | — | — | — | — | — | — | 0.2 |
| pH | 8.0 | 7.5 | 7.0 | 7.25 | 8.0 | 7.4 | 7.5 |
| Water and Minors | | | q.s. to 100% | | | | |

As used hereinabove:

NaPS stands for Na paraffin sulphonate

NaCS stands for Na cumene sulphonate

Dobanol® 23-3 is a C12–13 alcohol ethoxylated with an average ethoxylation degree of 3.

Empilan KBE21 is a C12–14 alcohol ethoxylated with an average ethoxylation degree of 21.

Example 26

| | I | J | K | L | M | N |
|---|---|---|---|---|---|---|
| C13-15 EO30 | 1 | — | — | — | — | — |
| C12-14 EO20 | — | — | 1 | 1.7 | — | — |
| C12-14PO3EO7 | — | — | — | — | — | 2 |
| C12-14 EO10 | — | — | — | — | 2 | — |
| C10-12EO10 | — | 1.5 | — | — | — | — |
| MLAS | 2.8 | — | 2.4 | — | 2.4 | 2.4 |
| C11EO5 | — | — | — | 5 | — | — |
| C12–14 EO5 | 4.2 | 3.0 | 3.6 | — | 3.6 | 3.6 |
| C9–11 EO4 | — | 3.0 | — | — | — | — |
| C12-OH | — | 0.3 | — | — | — | — |
| 2-Hexyl decanol | — | — | — | 0.4 | — | — |
| 2-Butyl octanol | 0.3 | — | 0.3 | — | 0.3 | 0.3 |
| MBAS** | — | — | 1.0 | — | 1.0 | 1.0 |
| MBAES*** | 1.0 | 1.3 | — | 1.5 | — | — |
| Citrate | 0.7 | 1.0 | 0.7 | 1.0 | 0.7 | 0.7 |
| Na2CO3 | 0.6 | 0.7 | 0.6 | 0.3 | 0.6 | 0.6 |

| | O | P | Q | R | S |
|---|---|---|---|---|---|
| C12–14 EO20 | — | 1.4 | — | 2.5 | 1.8 |
| C12–14PO3EO7 | — | — | — | — | — |
| C12–14 EO10 | — | — | — | — | — |
| C10–12EO10 | 2.0 | — | 1.0 | — | — |
| C9–11EO5 | — | 2.0 | — | 6 | 4.3 |

-continued

| | | | | | |
|---|---|---|---|---|---|
| C11EO5 | 4.0 | — | — | — | — |
| C12–14 EO5 | — | 3.6 | 4.5 | 9 | 6.4 |
| MLAS* | 1.2 | 1.5 | 3.0 | 2.5 | 1.8 |
| C12-OH | — | — | — | — | — |
| 2-Hexyl decanol | — | 0.3 | — | — | — |
| 2-Butyl octanol | 0.3 | — | 0.2 | 0.5 | 0.5 |
| Citrate | 0.5 | 1.0 | 0.5 | 0.7 | 0.7 |
| Na2CO3 | 0.3 | 0.4 | 0.4 | 1 | 1.0 |

Example 27

| | Compositions (weight %): | | | | | |
|---|---|---|---|---|---|---|
| | T | U | V | W | X | Y |
| Nonionic surfactants | | | | | | |
| C12,14 EO5 | 3.6 | 2.9 | 2.5 | 2.5 | — | 2.5 |
| C7-9 EO6 | — | — | — | — | 3.2 | — |
| Dobanol ® 23-3 | — | — | — | — | 1.3 | — |
| AO21 | 1.0 | 0.8 | 4.0 | — | 1.9 | 2.0 |
| Anionic surfactants | | | | | | |
| NaPS | — | — | — | — | — | — |
| NaLAS | — | — | — | — | 0.9 | 0.8 |
| NaCS | 1.5 | 2.6 | — | 2.3 | 1.2 | 1.5 |
| MLAS | 2.4 | 1.9 | 2.5 | 4.0 | 0.8 | 2.5 |
| Isalchem ® AS | 0.6 | 0.6 | — | — | — | — |
| Buffer | | | | | | |
| $Na_2CO_3$ | 0.6 | 0.13 | 0.6 | 1.0 | 1.0 | 0.1 |
| Citrate | 0.5 | 0.56 | 0.5 | — | — | 0.6 |
| Caustic | 0.3 | 0.33 | 0.3 | — | — | 0.3 |
| Suds control | | | | | | |
| Fatty Acid | 0.6 | 0.3 | 0.5 | 0.4 | 0.4 | 0.5 |
| Isofol 12 ® | 0.3 | 0.3 | — | 0.3 | 0.3 | 0.3 |
| Polymers | | | | | | |
| PEG DME-2000 ® | 0.4 | — | 0.3 | — | — | 0.35 |
| Jeffamine ® ED-2001 | — | 0.4 | — | — | — | — |
| Polyglycol AM ® 1100 | — | — | — | 0.5 | — | — |
| PVP K60 ® | — | 0.4 | 0.6 | 0.3 | — | 0.3 |
| PEG (2000) | — | — | — | — | 0.5 | — |
| Minors and water | | | up to 100% | | | |
| pH | 9.5 | 7.4 | 9.5 | 10.5 | 10.75 | 7.5 |

| | Z | AA | BB | CC | DD | EE |
|---|---|---|---|---|---|---|
| Nonionic surfactants | | | | | | |
| C 9–11 EO5 | — | — | 2.5 | — | — | — |
| C12,14 EO5 | — | — | | 3.6 | — | — |
| Dobanol ® 23-3 | 1.3 | 3.2 | 2.5 | 2.0 | 1.3 | — |
| AO21 | 1.9 | 4.8 | — | 1.0 | 1.9 | 2.0 |
| Anionic surfactants | | | | | | |
| NaPS | | | 2.0 | — | — | — |
| NaLAS | — | — | — | — | 0.9 | 0.8 |
| NaCS | — | — | 0.8 | 1.5 | 1.2 | 1.5 |
| MLAS | 1.2 | 3.0 | 1.5 | 0.4 | 0.8 | 5.0 |
| Isalchem ® AS | 4.0 | 10.0 | — | 0.6 | — | — |
| Buffer | | | | | | |
| $Na_2CO_3$ | 1.0 | 2.0 | 0.2 | 0.6 | 1.0 | 0.2 |
| Citrate | — | — | 0.75 | 0.5 | — | 0.75 |
| Caustic | — | — | 0.5 | 0.3 | — | 0.5 |
| Suds control | | | | | | |
| Fatty Acid | 0.4 | 0.8 | 0.4 | 0.6 | 0.4 | 0.4 |
| Isofol 12 ® | 0.3 | — | 0.3 | 0.3 | 0.3 | 0.3 |
| Polymers | | | | | | |
| PEG DME-2000 ® | 0.5 | 0.75 | 0.5 | — | — | — |

-continued

| | Compositions (weight %): | | | | | |
|---|---|---|---|---|---|---|
| PVP K60 ® | — | 0.5 | 0.5 | — | — | 0.5 |
| Polyquat 11 ® | 0.5 | — | — | 0.5 | 0.5 | — |
| MME PEG (2000) | — | — | — | 0.5 | — | 0.5 |
| PEG (2000) | — | — | — | — | 0.5 | — |
| Minors and water | | | up to 100% | | | |
| pH | 10.7 | 10.75 | 9.5 | 9.5 | 10.75 | 9.5 |

PVP K60® is a vinylpyrrolidone homopolymer (average molecular weight of 160,000), commercially available from ISP Corporation, New York, N.Y. and Montreal, Canada.

Polyquat 11® is a quaternized copolymers of vinyl pyrrolidone and dimethyl aminoethylmethacrylate commercially available from BASF.

PEG DME-2000® is dimethyl polyethylene glycol (MW 2000) commercially available from Hoescht.

Jeffamine® ED-2001 is a capped polyethylene glycol commercially available from Huntsman.

PEG (2000) is polyethylene glycol (MW 2000).

MME PEG (2000) is monomethyl ether polyethylene glycol (MW 2000) which was obtained from Fluka Chemie AG.

Isofol 12® is 2-butyl octanol

Dobanol® 23-3 is a C12–C13 EO 3 nonionic surfactant commercially available from SHELL.

C8-AS is octyl sulphate available from Albright and Wilson, under the tradename Empimin® LV 33.

AO21 is a C12–14 EO21 alcohol ethoxylate.

Isalchem® AS is a branched alcohol alkyl sulphate commercially available from Enichem.

Example 28

| | Weight % | | | | | | | |
|---|---|---|---|---|---|---|---|---|
| Ingredients | FF | GG | HH | II | JJ | KK | LL | MM |
| Sodium paraffin sulfonate | | | | | 3 | — | — | — |
| MLAS | 4 | 3 | 3 | 4 | 1 | 3 | 6 | 3 |
| Alcohol ethoxylate 30EO (1) | 2 | — | — | 2 | 2 | 2 | 1.0 | 1.0 |
| Alcohol ethoxylate 12EO (2) | — | 3 | — | — | | | | |
| Alcohol ethoxylate 7EO (3) | | | | | — | 1 | — | — |
| Alcohol benzene ethoxylate 10EO (4) | — | — | 3 | — | | | | |
| Citric acid | 2 | 2 | 2 | 3 | 4 | 3 | 4 | — |
| Tetrapotassium pyrophosphate | | | | | — | — | — | 4 |
| Butylcarbitol $^{R}$ | 4 | 4 | 4 | 7 | 4 | 4 | 6 | 5 |
| n-butoxypropoxypropanol | — | — | — | 2.5 | — | — | — | 2 |
| Triethanolamine | 1 | 1 | 2 | 1 | — | 1 | 2 | — |
| Monoethanolamine | | | | | 2 | — | — | — |
| Ethoxyethanolamine | | | | | — | — | — | 2 |
| water & minors | | | q.s. to 100% | | | | | |

In the examples hereinabove, (1) is a highly ethoxylated nonionic surfactant wherein R is a mixture of $C_{13}$ and $C_{15}$ alkyl chains and n is 30. (2) is a highly ethoxylated nonionic surfactant wherein R is a mixture of $C_{13}$ and $C_{15}$ alkyl chains and n is 12. (3) is a lower ethoxylated nonionic surfactant wherein n is 7. (4) is a highly ethoxylated nonionic surfactant wherein R is a mixture of $C_{19}$ and $C_{21}$ alkyl benzene chains and n is 10.

Compositions FF-MM described hereinabove can be used neat or diluted.

Example 29

| | Weight % | | |
|---|---|---|---|
| Ingredients | NN | OO | PP |
| Sodium paraffin sulfonate | 1.0 | 3 | 3 |
| Alcohol ethoxylate 7EO | 4 | — | — |
| Alcohol ethoxylate 30EO | — | 3 | 2 |
| C12–14 EO21 alcohol ethoxylate | 1.0 | — | — |
| MLAS | 5.0 | 1 | 2 |
| Sodium Citrate | 3 | 3 | 3 |
| Butylcarbitol$^{R}$ | 4 | 4 | 4 |
| Triethanolamine | 1 | 1 | 1 |
| water & minors | | up to 100% | |

Example 30

| | QQ | RR | SS | TT | UU |
|---|---|---|---|---|---|
| N-2-ethylhexyl sulfosuccinamate | 3.0 | — | 3.0 | — | 3.0 |
| N-2-propylheptyl sulfosuccinamate | — | 3.0 | — | 3.0 | — |
| $C_{11}EO_5$ | 7.0 | 14.0 | 14.0 | — | — |
| $C_{11}EO_7$ | — | — | — | 7.0 | 7.0 |
| $C_{10}EO_7$ | 7.0 | — | — | 7.0 | 7.0 |
| MLAS | 3.0 | 3.0 | 3.0 | 3.0 | 3.0 |
| Trisodium citrate | 1.0 | 1.0 | — | 1.0 | 1.0 |
| Potassium carbonate | 0.2 | 0.2 | 0.2 | 0.2 | 0.2 |
| Triethanol amine | — | — | 1.0 | — | — |
| Polycarboxylate co-polymer** | — | — | 0.25 | — | — |

-continued

| | QQ | RR | SS | TT | UU |
|---|---|---|---|---|---|
| Perfume | 1.0 | 1.0 | 1.0 | 1.0 | 1.0 |
| Alkalinity adjusted to pH | 10.5 | 10.5 | 7.4 | 10.5 | 10.5 |
| Water, salts, fillers | balance | balance | balance | balance | balance |

**SOKALAN CP-9.

Example 31

| Ingredient | VV | WW | XX | YY | ZZ |
|---|---|---|---|---|---|
| IPA[1] | 2.0 | 2.0 | 2.0 | 2.0 | 2.0 |
| BP[2] | 2.0 | 2.0 | 2.0 | 2.0 | 2.0 |
| MLAS | 0.3 | 0.3 | 0.2 | 0.2 | 0.2 |
| MEA[4] | 0.25 | 0.25 | 0.25 | 0.25 | 0.25 |
| Cocoamidopropyl-hydroxy-sultaine | 0.1 | 0.1 | 0.1 | 0.1 | 0.1 |
| Capryloamido(carboxy-methoxyethyl)glycinate | 0.05 | 0.05 | 0.05 | 0.05 | 0.05 |
| Polymer Additive | 0.5[7] | 0.2[5] | 0.2[6] | 0.2[7] | 0.2[8] |
| Water and pH adjusted to 9.5 Balance | <=======BALANCE=======> | | | | |

[1]Isopropanol
[2]Butoxypropanol
[4]Monoethanolamine
[5]Vinyl pyrrolidone/acrylic acid copolymer (MW about 250,000)
[6]Sodium Polyacrylate (MW about 2,000)
[7]Sodium Polyacrylate (MW about 450,000)
[8]Sodium Polyacrylate (MW about 3,000,000)

Example 32

| Ingredient | AAA | BBB | CCC |
|---|---|---|---|
| IPA | 4.0 | 4.0 | 4.0 |
| Ethylene Glycol Monobutyl Ether | 2.5 | 2.5 | 2.5 |
| MLAS | 0.2 | 0.2 | 0.2 |
| Sodium Lauryl Sulfate | 0.1 | 0.1 | 0.1 |
| FC-129 Fluorosurfactant | 0.06 | 0.06 | 0.06 |
| Sodium Polyacrylate | 0.1[9] | 0.2[8] | 0.2[9] |
| Ammonia | 0.16 | 0.16 | 0.16 |
| Deionized (DI) Water and pH adjusted to 11 Balance | <===BALANCE===> | | |

[8]Sodium Polyacrylate (MW 2,000)
[9]Sodium Polyacrylate (MW 450,000)

EXAMPLE 33

| Ingredient | DDD | EEE | FFF |
|---|---|---|---|
| IPA | 3.0 | 3.0 | 3.0 |
| Ethylene Glycol Monohexyl Ether | 0.75 | 0.75 | 0.75 |
| MLAS | 0.25 | 0.25 | 0.25 |
| Sodium Dodecylbenzenesulfonate | 0.25 | 0.25 | 0.25 |
| Perfume | 0.02 | 0.02 | 0.2 |
| Sodium Polyacrylate (MW450,000) | 0.04 | 0.2 | 0.02 |
| Ammonia | 0.15 | 0.15 | 0.15 |
| pH adjusted to | 10.5 | 11.5 | 9.5 |
| Deionized (DI) Water to Balance | <===BALANCE===> | | |

Example 34

| Ingredient | GGG | HHH | III |
|---|---|---|---|
| Ethanol | 2.8 | 2.8 | 2.8 |
| Ethylene Glycol Monobutyl Ether | 2.8 | 2.8 | 2.8 |
| MLAS | 0.3 | 0.3 | 0.3 |
| Sodium Alkyl ($C_8$, $C_{12}$, and $C_{14}$) Sulfate | 0.2 | 0.2 | 0.2 |
| Versaflex 7000 | — | — | 0.1 |
| Versaflex 2004 | — | 0.1 | — |
| Polymer[4] | 0.1 | — | — |

-continued

| Ingredient | GGG | HHH | III |
|---|---|---|---|
| Perfume, NaOH (to adjust pH to 9.5), and Soft Water to Balance | <===BALANCE===> | | |

Versaflex 2004 and 7000 are sodium sulfonated polystyrenes from National Starch and Chemical Company.
[4]Vinyl pyrrolidone/acrylic acid copolymer (MW about 250,000)

Example 35

| Ingredient | Wt. % |
|---|---|
| 3-(N-dodecyl-N,N-dimethyl)-2-hydroxy-propane-1-sulfonate (DDHPS)[1] | 2.0 |
| Octyl polyethoxylate (2.5) (OPE2.5) | 1.1 |
| MLAS | 2.0 |
| Octyl polyethoxylate (6.0) (OPE6) | 2.9 |
| Butoxy Propoxy Propanol (BPP) | 5.0 |
| Succinic Acid | 10.0 |
| Sodium Cumene Sulfonate (SCS) | 4.2 |
| Water, Buffering Agents, and Minors | up to 100 |
| pH | 3.0 |

[1]Varion CAS

Example 36

| Ingredient | Wt. % |
|---|---|
| N-(Coconutamidoethylene)-N-(hydroxyethyl)-glycine[1] | 2.0 |
| $C_{9-11}$ Polyethoxylate (6) (C91E6)[2] | 2.0 |
| MLAS | 8.0 |
| Citric Acid | 10.0 |
| Butoxy Propoxy Propanol (BPP) | 5.0 |
| SCS | 1.6 |
| Water, Buffering Agents, and Minors | up to 100 |
| pH | 2.97 |

[1]Rewoteric AM-V
[2]Neodol 91-6

Example 37

| Ingredient | JJJ | KKK | LLL |
|---|---|---|---|
| 3-(N-dodecyl-N,N-dimethyl)-2-hydroxy-propane-1-sulfonate (DDHPS)[1] | 2.0 | — | — |
| MLAS | 2.0 | 2.0 | 2.0 |
| $C_{9-11}$ Polyethoxylate (6) (C91E6)[2] | 2.0 | — | — |
| $C_{8-10}$ E6 | — | 2.0 | 2.0 |
| Cocoamido propyl betaine[3] | — | 2.0 | — |
| N-(Coconutamidoethylene)-N-(hydroxyethyl)-glycine[4] | — | — | 2.0 |
| BPP | 8.0 | 8.0 | 8.0 |
| Citric Acid | 6.0 | 6.0 | 6.0 |
| SCS | 1.6 | 1.6 | 1.6 |
| Water, Buffering Agents, and Minors | q.s. to 100 | | |
| pH | 2.97 | 2.97 | 2.97 |

[1]Varion CAS
[3]Neodol 91-6
[4]Betaine AMB-15
[5]Rewoteric AM-V

Example 38

| Ingredient | MMM | NNN | OOO | PPP |
|---|---|---|---|---|
| 3-(N-dodecyl-N,N-dimethyl)-2-hydroxy-propane-1-sulfonate (DDHPS)[1] | 2.0 | 2.0 | 2.0 | 2.0 |
| $C_{9-11}$ Polyethoxylate (6) (C91E6)[2] | 2.0 | — | — | — |
| $C_{10}E6$[3] | — | 2.0 | — | — |
| MLAS | 3.0 | 4.0 | 4.0 | 5.0 |
| $C_8E6$[5] | — | — | 2.0 | — |
| $C_6E6$[6] | — | — | — | 2.0 |
| BPP | 8.0 | 8.0 | 8.0 | 8.0 |
| Citric Acid | 6.0 | 6.0 | 6.0 | 6.0 |
| SCS | 1.6 | 1.6 | 1.6 | 1.6 |
| pH | 2.97 | 2.98 | 2.98 | 3.10 |
| Water, Buffering Agents and Minors | q.s. to 100 | | | |

[1]Varion CAS
[2]Neodol 91-6
[3]Sulfonic L10-6
[5]Sulfonic L8-6
[6]Sulfonic L6-6

Example 39

| Ingredient | QQQ | RRR | SSS | TTT | UUU | VVV | WWW | XXX |
|---|---|---|---|---|---|---|---|---|
| 3-(N-dodecyl-N,N-dimethy1)2-hydroxy-propane-1-sulfonate (DDHPS)[1] | 2.0 | — | — | — | — | — | — | — |
| $C_{9-11}$ Polyethoxylate (6) (C91E6)[2] | 2.0 | 2.0 | 2.0 | 2.0 | 2.0 | 2.0 | 2.0 | 2.0 |
| $C_{8-10}$ E6 | — | 2.0 | 2.0 | — | — | — | 2.0 | 2.0 |
| MLAS | 2 | 1 | 1 | 2 | 3 | 3 | 1 | 1 |
| Lauroamphoglycinate[4] | — | 2.0 | — | — | — | — | — | — |
| Cocamphopropionate[5] | — | — | — | 2.0 | — | — | — | — |
| Tallow Glycinate[6] | — | — | 2.0 | — | — | — | — | — |
| Sodium Lauryliminodipropionate[7] | — | — | — | — | 2.0 | — | — | — |
| Cocamido Propyl Betaine[8] | — | — | — | — | — | 2.0 | — | — |
| Coco Amidopropyl Betaine[9] | — | — | — | — | — | — | 2.0 | — |
| Lauryl Betaine[10] | — | — | — | — | — | — | — | 2.0 |
| BPP | 8.0 | 8.0 | 8.0 | 8.0 | 8.0 | 4.0 | 4.0 | 4.0 |
| Citric Acid | 6.0 | 6.0 | 6.0 | 6.0 | 6.0 | 3.0 | 3.0 | 3.0 |
| SCS | 3.0 | 3.0 | 3.0 | 3.0 | 3.0 | 1.0 | 1.0 | 1.0 |
| pH adjusted to | 2.95 | 3.23 | 3.05 | 3.34 | 3.37 | 3.5 | 3.5 | 3.5 |
| Water, Buffering Agents and Minors | q.s. to 100 | | | | | | | |

[1]Varion CAS
[2]Neodol 91-6
[4]Rewoteric AM 2L-35
[5]Rewoteric AM 2CSF
[6]Rewoteric AM TEG
[7]Rewoteric AM LP
[8]Rewoteric AM B14-U
[9]Rewoteric AM B15-U
[10]Rewoteric DML-35

Example 40

| Ingredient | YYY | ZZZ |
|---|---|---|
| 3-(N-dodecyl-N,N-dimethyl)-2-hydroxy-propane-1-sulfonate (DDHPS)[1] | 2.0 | 2.0 |
| $C_{9-11}$ Polyethoxylate (6) (C91E6)[2] | 2.0 | 2.0 |

-continued

| Ingredient | YYY | ZZZ |
|---|---|---|
| MLAS | 4 | 1 |
| BPP | 8.0 | 8.0 |
| Citric Acid | 6.0 | — |
| Succinic Acid | — | 6.0 |
| SCS | 3.0 | 3.0 |
| pH | 2.95 | 3.01 |
| Water, Buffering Agents and Minors | q.s. to 100 | |

[1]Varion CAS
[2]Neodol 91-6

Example 41

| Ingredient | AAAA | BBBB |
|---|---|---|
| $C_{8-10}$ E6 | 2.0 | 2.0 |
| Cocoamido propyl betaine[1] | 2.0 | 2.0 |
| MLAS | 1.0 | 3.0 |
| BPP | 8.0 | 8.0 |

-continued

| Ingredient | AAAA | BBBB |
|---|---|---|
| Succinic Acid | 6.0 | 6.0 |
| SCS | 1.6 | 1.6 |
| Water, Buffering Agents and Minors | q.s. to 100 | |

-continued

| Ingredient | AAAA | BBBB |
|---|---|---|
| pH | 2.00 | 4.5 |

[1]Betaine AMB-15

Example 42

| Ingredient | CCCC | DDDD | EEEE |
|---|---|---|---|
| 3-(N-dodecyl-N,N-dimethyl)-2-hydroxy-propane-1-sulfonate (DDHPS)[1] | 2.0 | — | — |
| Cocoylamidopropyl Betaine[2] | — | 1.75 | 1.75 |
| $C_{9-11}$ Polyethoxylate (6) (C91E6)[3] | 2.0 | — | — |
| $C_{8-10}$ Polyethoxylate (6) (peaked cut $C_{8-10}E_6$)[4] | — | 2.0 | 2.0 |
| MLAS | 2.0 | 1.5 | 1.5 |
| BPP | 8.0 | 6.0 | 6.0 |
| Citric Acid | 6.0 | 6.0 | 6.0 |
| SCS | 3.0 | — | 2.0 |
| Water, Buffering Agents and Minors | | q.s. to 100 | |
| pH | 3.0 | 3.0 | 3.0 |

[1]Varion CAS
[2]Betaine AMB-15-V
[3]Neodol 91-6
[4]Peaked cut $C_{8-0}E_6$ as described hereinbefore.

Example 43

| Ingredient | FFFF | GGGG | HHHH |
|---|---|---|---|
| 3-(N-dodecyl-N,N-dimethyl)-2-hydroxy-propane-1-sulfonate (DDHPS)[1] | 2.0 | — | — |
| Cocoylamidopropyl Betaine[2] | — | 1.75 | 1.75 |
| $C_{9-11}$ Polyethoxylate (6) (C91E6)[3] | 2.0 | — | — |
| $C_{8-10}$ Polyethoxylate (6) (peaked cut $C_{8-10}E_6$)[4] | — | 2.0 | 2.0 |
| MLAS | 2.0 | 1.5 | 1.5 |
| BPP | 8.0 | 6.0 | 6.0 |
| Citric Acid | 6.0 | 6.0 | 6.0 |
| SCS | 3.0 | — | 2.0 |
| Xanthan Gum | 0.23 | 0.23 | 0.23 |
| Water, Buffering Agents and Minors | | q.s. to 100 | |
| pH | 3.0 | 3.0 | 3.0 |

[1]Varion CAS
[2]Betaine AMB-15-V
[3]Neodol 91-6
[4]Peaked cut $C_{8-0}E_6$ as described hereinbefore.

Example 44

| Ingredient | % Concentration |
|---|---|
| MLAS | 0.45 |
| Perfume | 0.015 |
| K2CO3 | 0.01 |
| 1-amino-2-methyl-1-propanol | 0.5 |
| Suds supressor | 0.0025 |
| Xanthum gum | 0.05 |
| Deionized Water | q.s. to 100% |
| pH | adjusted to 7 or higher |

*The suds suppressor contains: Polyethylene glycol stearate, Methylated silica Octamethyl cyclotetrasiloxane.

The suds suppressor at an effective level, typically from about 0.0005 to about 0.02, preferably from about 0.001 to about 0.01, more preferably from about 0.002 to about 0.003, provides a technical improvement in spotting and filming, particularly on ceramic surfaces. The reason for this is the group lines on ceramic create low spots as the mop moves across, generating suds. If too high a level of suds is generated, it can dry down into streaks. Furthermore, consumer research shows that suds seen on floor during mopping is perceived by some consumers as leading to film/streaking.

Lowering suds on floor during mopping can provide varying degrees of technical and perceptual benefits for not leaving film/streaks. The degree of benefit depends on the level of suds created and to what degree the level of suds is controlled. particularly during mopping.

Known suds suppressors can be used, but it is highly desirable to use a silicone suds suppressor since they are effective at very low levels and therefore can minimize the total water insoluble material needed while having at least an effective amount of suds suppressor present.

What is claimed is:

1. A hard surface cleaning composition comprising:

(i) from about 0.01% to about 95% by weight of composition of a modified alkylbenzene sulfonate surfactant mixture comprising:

(a) from about 60% to about 95% by weight of surfactant mixture, a mixture of branched alkylbenzene sulfonates having formula (I):

(I)

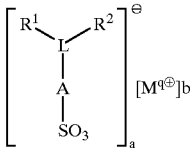

wherein L is an acyclic aliphatic moiety consisting of carbon and hydrogen, said L having two methyl termini and said L having no substituents other than A, $R^1$ and $R^2$; and wherein said mixture of branched alkylbenzene sulfonates contains two or more of said branched alkylbenzene sulfonates differing in molecular weight of the anion of said formula (I) and wherein said mixture of branched alkylbenzene sulfonates has a sum of carbon atoms in $R^1$, L and $R^2$ of from 9 to 15;

an average aliphatic carbon content of from about 10.0 to about 14.0 carbon atoms; M is a cation or cation mixture having a valence q; a and b are integers selected such that said branched alkylbenzene sulfonates are electroneutral; $R^1$ is $C_1$–$C_3$ alkyl; $R^2$ is selected from H and $C_1$–$C_3$ alkyl; A is a benzene moiety; and (b) from about 5% to about 40% by weight of surfactant mixture, of a mixture of nonbranched alkylbenzene sulfonates having formula (II):

(II)

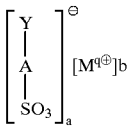

wherein a, b, M, A and q are as defined hereinbefore and Y is an unsubstituted linear aliphatic moiety consisting of carbon and hydrogen having two methyl termini, and wherein said Y has a sum of carbon atoms of from 9 to 15, preferably from 10 to 14, and said Y has an average aliphatic carbon content of from about 10.0 to about 14.0; and wherein said modified alkylbenzene sulfonate surfactant mixture is further characterized by a 2/3-phenyl index of from about 275 to about 10,000;

(ii) from about 0.001% to 99.9% by weight of a conventional surface cleansing additive;

wherein said composition is further characterized by a 2/3-phenyl index of from about 275 to about 10,000.

2. A hard surface cleaning composition according to claim 1 wherein said M is selected from H, Na, K and mixtures thereof, said a=1, said b=1, said q=1, and said modified alkylbenzene sulfonate surfactant mixture has a 2-methyl-2-phenyl index of less than about 0.3.

3. A hard surface cleaning composition according to claim 2 wherein said 2-methyl-2-phenyl index is from 0 to about 0.11.

4. A hard surface cleaning composition according to claim 3 wherein said modified alkylbenzene sulfonate surfactant mixture is the product of a process using as catalyst a zeolite selected from mordenite, offretite and H-ZSM-12 in at least partially acidic form.

5. A hard surface cleaning composition according to claim 4 wherein said catalyst is an acidic mordenite.

6. A hard surface cleaning composition comprising:

(i) from about 0.1% to about 95% by weight of composition of a medium 2/3-phenyl surfactant system consisting essentially of:

(1) from 1% to about 60% by weight of surfactant system of a first alkylbenzene sulfonate surfactant, wherein said first alkylbenzene sulfonate surfactant is a modified alkylbenzene sulfonate surfactant mixture, said surfactant mixture comprising:

(a) from about 60% to about 95% by weight of surfactant mixture, a mixture of branched alkylbenzene sulfonates having formula (I):

(I)

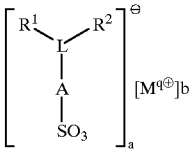

wherein L is an acyclic aliphatic moiety consisting of carbon and hydrogen, said L having two methyl termini and said L having no substituents other than A, $R^1$ and $R^2$; and wherein said mixture of branched alkylbenzene sulfonates contains two or more of said branched alkylbenzene sulfonates differing in molecular weight of the anion of said formula (I) and wherein said mixture of branched alkylbenzene sulfonates has a sum of carbon atoms in $R^1$, L and $R^2$ of from 9 to 15;

an average aliphatic carbon content of from about 10.0 to about 14.0 carbon atoms; M is a cation or cation mixture having a valence q; a and b are integers selected such that said branched alkylbenzene sulfonates are electroneutral; $R^1$ is $C_1$–$C_3$ alkyl; $R^2$ is selected from H and $C_1$–$C_3$ alkyl; A is a benzene moiety; and (b) from about 5% to about 40% by weight of surfactant mixture, of a mixture of nonbranched alkylbenzene sulfonates having formula (II):

(II)

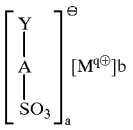

wherein a, b, M, A and q are as defined hereinbefore and Y is an unsubstituted linear aliphatic moiety consisting of carbon and hydrogen having two methyl termini, and wherein said Y has a sum of carbon atoms of from 9 to 15, preferably from 10 to 14, and said Y has an average aliphatic carbon content of from about 10.0 to about 14.0; and wherein said modified alkylbenzene sulfonate surfactant mixture is further characterized by a 2/3-phenyl index of from about 275 to about 10,000; and (2) from 40% to about 99%, by weight of surfactant system of a second alkylbenzene sulfonate surfactant, wherein said second alkylbenzene sulfonate surfactant is an alkylbenzene sulfonate surfactant mixture other than said modified alkylbenzene sulfonate surfactant mixture (1), and wherein said second alkylbenzene sulfonate surfactant has a 2/3-phenyl index of from about 75 to about 160;

provided that said medium 2/3-phenyl surfactant system has a 2/3-phenyl index of from about 160 to about 275;

(ii) from about 0.001% to 99.9% by weight of a conventional surface cleansing additive.

7. A hard surface cleaning composition according to claim 2 wherein said modified alkylbenzene sulfonate surfactant mixture consists essentially of said mixture of (a) and (b), wherein said 2-methyl-2-phenyl index of said modified alkylbenzene sulfonate surfactant mixture is less than about 0.1, and wherein in said mixture of branched and nonbranched alkylbenzene sulfonates, said average aliphatic carbon content is from about 11.5 to about 12.5 carbon atoms; said $R^1$ is methyl; said $R^2$ is selected from H and methyl provided that in at least about 0.7 mole fraction of said branched alkylbenzene sulfonates $R^2$ is H; and wherein said sum of carbon atoms in $R^1$, L and $R^2$ is from 10 to 14; and further wherein in said mixture if nonbranched alkylbenzene sulfonates, said Y has a sum of carbon atoms of from 10 to 14 carbon atoms, said average aliphatic carbon content of said nonbranched alkylbenzene sulfonates is from about 11.5 to about 12.5 carbon atoms, and said M is a monovalent cation or cation mixture selected from H, Na and mixtures thereof.

8. A hard surface cleaning composition comprising:

(i) a modified alkylbenzene sulfonate surfactant mixture comprising the product of a process comprising the steps of:

(I) alkylating benzene with an alkylating mixture;

(II) sulfonating the product of (I); and (III) neutralizing the product of (II);

wherein said alkylating mixture comprises:

(a) from about 1% to about 99.9%, by weight of alkylating mixture of branched $C_9$–$C_{20}$ monoolefins, said branched monoolefins having structures identical with those of the branched monoolefins formed by dehydrogenating branched paraffins of formula $R^1LR^2$ wherein L is an acyclic aliphatic moiety consisting of carbon and hydrogen and containing two terminal methyls; $R^1$ is $C_1$ to $C_3$ alkyl; and $R^2$ is selected from H and $C_1$ to $C_3$ alkyl; and (b) from about 0.1% to about 85%, by weight of alkylating mixture of $C_9$–$C_{20}$ linear aliphatic olefins;

wherein said alkylating mixture contains said branched $C_9$–$C_{20}$ monoolefins having at least two different carbon numbers in said $C_9$–$C_{20}$ range, and has a mean carbon content of from about 9.0 to about 15.0 carbon atoms; and wherein said components (a) and (b) are at a weight ratio of at least about 15:85;

(ii) from about 0.001% to 99.9% by weight of a conventional surface cleansing additive;

wherein said composition is further characterized by a 2/3-phenyl index of from about 275 to about 10,000.

9. A hard surface cleaning composition comprising:

(i) A modified alkylbenzene sulfonate surfactant mixture consisting essentially of the product of a process comprising the steps, in sequence, of:

(I) alkylating benzene with an alkylating mixture;

(II) sulfonating the product of (I); and (III) neutralizing the product of (II);

wherein said alkylating mixture comprises:

(a) from about 1% to about 99.9%, by weight of alkylating mixture of a branched alkylating agent selected from the group consisting of:

(A) $C_9$–$C_{20}$ internal monoolefins $R^1LR^2$ wherein L is an acyclic olefinic moiety consisting of carbon and hydrogen and containing two terminal methyls;

(B) $C_9$–$C_{20}$ alpha monoolefins $R^1AR^2$ wherein A is an acyclic alpha-olefinic moiety consisting of carbon and hydrogen and containing one terminal methyl and one terminal olefinic methylene;

(C) $C_9$–$C_{20}$ vinylidene monoolefins $R^1BR^2$ wherein B is an acyclic vinylidene olefin moiety consisting of carbon and hydrogen and containing two terminal methyls and one internal olefinic methylene;

(D) $C_9$–$C_{20}$ primary alcohols $R^1QR^2$ wherein Q is an acyclic aliphatic primary terminal alcohol moiety consisting of carbon, hydrogen and oxygen and containing one terminal methyl;

(E) $C_9$–$C_{20}$ primary alcohols $R^1ZR^2$ wherein Z is an acyclic aliphatic primary nonterminal alcohol moiety consisting of carbon, hydrogen and oxygen and containing two terminal methyls; and (F) mixtures thereof;

wherein in any of (A)–(F), said $R^1$ is $C_1$ to $C_3$ alkyl and said $R^2$ is selected from H and $C_1$ to $C_3$ alkyl; and (b) from about 0.1% to about 85%, by weight of alkylating mixture of $C_9$–$C_{20}$ linear alkylating agent selected from $C_9$–$C_{20}$ linear aliphatic olefins, $C_9$–$C_{20}$ linear aliphatic alcohols and mixtures thereof;

wherein said alkylating mixture contains said branched alkylating agents having at least two different carbon numbers in said $C_9$–$C_{20}$ range, and has a mean carbon content of from about 9.0 to about 15.0 carbon atoms; and wherein said components (a) and (b) are at a weight ratio of at least about 15:85;

(ii) from about 0.001% to 99.9% by weight of a conventional surface cleansing additive;

wherein said composition is further characterized by a 2/3-phenyl index of from about 275 to about 10,000.

10. A hard surface cleaning composition according to claim 9 wherein said alkylating mixture consists essentially of:

(a) from about 0.5% to about 47.5%, by weight of alkylating mixture of said branched alkylating agent selected from:

(G) $C_9$–$C_{14}$ internal monoolefins $R^1LR^2$ wherein L is an acyclic olefinic moiety consisting of carbon and hydrogen and containing two terminal methyls;

(H) $C_9$–$C_{14}$ alpha monoolefins $R^1AR^2$ wherein A is an acyclic alpha-olefinic moiety consisting of carbon and hydrogen and containing one terminal methyl and one terminal olefinic methylene; and (J) mixtures thereof;

wherein in any of (G), (H) and (J), said $R^1$ is methyl, and said $R^2$ is H or methyl provided that in at least about 0.7 mole fraction of the total of said monoolefins, $R^2$ is H; and (b) from about 0.1 % to about 25%, by weight of alkylating mixture of $C_9$–$C_{14}$ linear aliphatic olefins; and (c) from about 50% to about 98.9%, by weight of alkylating mixture of carrier materials selected from paraffins and inert nonparaffinic solvents;

wherein said alkylating mixture contains said branched alkylating agents having at least two different carbon numbers in said $C_9$–$C_{14}$ range, and has a mean carbon content of from about 11.5 to about 12.5 carbon atoms; and wherein said components (a) and (b) are at a weight ratio of from about 51:49 to about 90:10.

11. A hard surface cleaning composition according to claim 10 wherein in step (I), said alkylation is performed in the presence of an alkylation catalyst, said alkylation catalyst is an intermediate acidity solid porous alkylation catalyst, and step (II) comprises removal of components other than monoalkylbenzene prior to contacting the product of step (I) with sulfonating agent.

12. A hard surface cleaning composition according to claim 10 wherein said alkylation catalyst is other than a member selected from the group consisting of HF, $AlCl_3$, sulfuric acid and mixtures thereof.

13. A hard surface cleaning composition according to claim 10 wherein a hydrotrope, hydrotrope precursor, or mixtures thereof is added after step (I).

14. A hard surface cleaning composition according to claim 10 wherein a hydrotrope, hydrotrope precursor or mixtures thereof is added during or after step (II) and prior to step (III).

15. A hard surface cleaning composition according to claim 10 wherein a hydrotrope is added during or after step (III).

16. A hard surface cleaning composition according to claim 10 wherein said alkylation catalyst is selected from the group consisting of non-fluoridated acidic mordenite-type catalyst, fluoridated acidic mordenite-type catalyst and mixtures thereof.

17. A hard surface cleaning composition according to claim 10 wherein in step (I) said alkylation is performed at a temperature of from about 125° C. to about 230° C. and at a pressure of from about 50 psig to about 1000 psig.

18. A hard surface cleaning composition according to claim 10 wherein in step (I) said alkylation is performed at a temperature of from about 175° C. to about 125° C., at a pressure of from about 100 psig to about 250 psig. and a time of from about 0.01 hour to about 18 hours.

19. A hard surface cleaning composition according to claim 10 wherein step (II) is performed using a sulfonating agent selected from the group consisting of sulfur trioxide, sulfur trioxide/air mixtures, and sulfuric acid.

20. A hard surface cleaning composition according to any of claims 1 to 19 wherein said composition is in the form of a liquid, powder, paste, gel, liquid-gel, microemulsion, or granule.

21. A hard surface cleaning composition comprising:

(i) from about 0.01% to about 95% by weight of composition of a modified alkylbenzene sulfonate surfactant mixture comprising:

(a) from about 60% to about 95% by weight of surfactant mixture, a mixture of branched alkylbenzene sulfonates having formula (I):

(I)

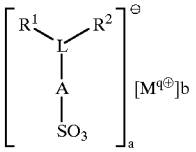

wherein L is an acyclic aliphatic moiety consisting of carbon and hydrogen, said L having two methyl termini and said L having no substituents other than A, $R^1$ and $R^2$; and wherein said mixture of branched alkylbenzene sulfonates contains two or more of said branched alkylbenzene sulfonates differing in molecular weight of the anion of said formula (I) and wherein said mixture of branched alkylbenzene sulfonates has a sum of carbon atoms in $R^1$, L and $R^2$ of from 9 to 15;

an average aliphatic carbon content of from about 10.0 to about 14.0 carbon atoms; M is a cation or cation mixture having a valence q; a and b are integers selected such that said branched alkylbenzene sulfonates are electroneutral; $R^1$ is $C_1$–$C_3$ alkyl; $R^2$ is selected from H and $C_1$–$C_3$ alkyl; A is a benzene moiety; and (b) from about 5% to about 40% by weight of surfactant mixture, of a mixture of nonbranched alkylbenzene sulfonates having formula (II):

(II)

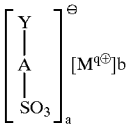

wherein a, b, M, A and q are as defined hereinbefore and Y is an unsubstituted linear aliphatic moiety consisting of carbon and hydrogen having two methyl termini, and wherein said Y has a sum of carbon atoms of from 9 to 15, preferably from 10 to 14, and said Y has an average aliphatic carbon content of from about 10.0 to about 14.0; and wherein said modified alkylbenzene sulfonate surfactant mixture is further characterized by a 2/3-phenyl index of from about 275 to about 10,000 and wherein said modified alkylbenzene sulfonate surfactant mixture has a 2-methyl-2-phenyl index of less than about 0.3;

(ii) from about 0.001% to 99.9% by weight of a conventional surface cleansing additive; and (iii) from about 0.00001% to about 99.9% of composition of a surfactant selected from the group consisting of anionic surfactants other than those of (i), nonionic surfactants, zwitterionic surfactants, cationic surfactants, amphoteric surfactant and mixtures thereof;

wherein said composition is further characterized by a 2/3-phenyl index of from about 275 to about 10,000; provided that when said composition comprises any alkylbenzene sulfonate surfactant other than said modified alkylbenzene sulfonate surfactant mixture, said composition is further characterized by an overall 2/3-phenyl index of at least about 200, wherein said overall 2/3-phenyl index is determined by measuring 2/3-phenyl index, as defined herein, on a blend of said modified alkylbenzene sulfonate surfactant mixture and said any other alkylbenzene sulfonate to be added to said composition, said blend, for purposes of measurement, being prepared from aliquots of said modified alkylbenzene sulfonate surfactant mixture and said other alkylbenzene sulfonate not yet exposed to any other of the components of said composition; and further provided that when said composition comprises any alkylbenzene sulfonate surfactant other than said modified alkylbenzene sulfonate surfactant mixture, said composition is further characterized by an overall 2-methyl-2-phenyl index of less than about 0.3, wherein said overall 2-methyl-2-phenyl index is to be determined by measuring 2-methyl-2-phenyl index, as defined herein, on a blend of said modified alkylbenzene sulfonate surfactant mixture and any other alkylbenzene sulfonate to be added to said composition, said blend, for purposes of measurement, being prepared from aliquots of said modified alkylbenzene sulfonate surfactant mixture and said other alkylbenzene sulfonate not yet exposed to any other of the components of said composition.

22. A hard surface cleaning composition according to claim 21 which is substantially free from alkylbenzene sulfonate surfactants other than said modified alkylbenzene sulfonate surfactant mixture.

23. A hard surface cleaning composition according to claim 21 which comprises, in said component (iii), at least about 0.1%, of a commercial $C_{10}$–$C_{14}$ linear alkylbenzene sulfonate surfactant.

24. A hard surface cleaning composition according to claim 21 which comprises, in said component (iii), at least about 0.1% of a commercial highly branched alkylbenzene sulfonate surfactant.

25. A hard surface cleaning composition according to claim 21 which comprises, in said component (iii), a nonionic surfactant at a level of from about 0.5% to about 25% by weight of said detergent composition, and wherein said nonionic surfactant is a polyalkoxylated alcohol in capped or non-capped form having:

a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof and a hydrophilic group selected from 1–15 ethoxylates, 1–15 propoxylates 1–15 butoxylates and mixtures thereof, in capped or uncapped form.

26. A hard surface cleaning composition according to claim 21 which comprises, in said component (iii), an alkyl sulfate surfactant at a level of from about 0.5% to about 25% by weight of said detergent composition, wherein said alkyl sulfate surfactant has a hydrophobic group selected from linear $C_{10}$–$C_{18}$ alkyl, mid-chain $C_1$–$C_3$ branched $C_{10}$–$C_{18}$ alkyl, guerbet branched $C_{10}$–$C_{18}$ alkyl, and mixtures thereof and a cation selected from Na, K and mixtures thereof.

27. A hard surface cleaning composition according to claim 21 which comprises, in said component (iii), an alkyl(polyalkoxy)sulfate surfactant at a level of from about 0.5% to about 25% by weight of said detergent composition, wherein said alkyl(polyalkoxy)sulfate surfactant has a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof, and a (polyalkoxy)sulfate hydrophilic group selected from 1–15 polyethoxysulfate, 1–15 polypropoxysulfate, 1–15 polybutoxysulfate, 1–15 mixed poly(ethoxy/propoxy/butoxy)sulfates, and mixtures thereof, in capped or uncapped form; and a cation selected from Na, K and mixtures thereof.

28. The hard surface cleaning composition according to claim 1 wherein the conventional surface cleansing additive is selected from the group consisting of aqueous liquid carrier, co-surfactant, builders, solvents, polymeric additives, pH adjusting material, hydrotrope, and mixtures thereof.

29. A kit comprising an implement containing a pad containing superabsorbent material and a detergent composition according to claim 1.

30. The Kit according to of claim 29 further comprising from about 0.0001% to 0.5% by weight of a hydrophobic material.

31. The Kit according to claim 29 further comprising from about 0.0001% to about 0.2% of hydrophilic, shear-thinning polymer that is capable of inhibiting molecular aggregation of surfactant solution on floors during the dry-down process.

32. A method of cleaning a hard surface, said method comprises applying an effective amount of the composition according to claim 1 to a hard surface in need of cleaning.

33. A method of cleaning a hard surface, said method comprises applying a diluted aqueous solution of the composition according to claim 1 to a hard surface in need of cleaning.

* * * * *